US009586784B2

(12) United States Patent
Hodatsu

(10) Patent No.: US 9,586,784 B2
(45) Date of Patent: Mar. 7, 2017

(54) PAPER SHEET HANDLING APPARATUS

(71) Applicant: GLORY LTD., Himeji-shi, Hyogo (JP)

(72) Inventor: Tsuyoshi Hodatsu, Himeji (JP)

(73) Assignee: GLORY LTD., Himeji-shi, Hyogo (JP)

( * ) Notice: Subject to any disclaimer, the term of this patent is extended or adjusted under 35 U.S.C. 154(b) by 0 days.

(21) Appl. No.: 14/829,799

(22) Filed: Aug. 19, 2015

(65) Prior Publication Data

US 2016/0060070 A1 Mar. 3, 2016

(30) Foreign Application Priority Data

Aug. 27, 2014 (CN) ..... 2014 1 0429375

(51) Int. Cl.

| | |
|---|---|
| ***B65H 43/04*** | (2006.01) |
| ***B65H 7/20*** | (2006.01) |
| ***B65H 33/00*** | (2006.01) |
| ***G07D 11/00*** | (2006.01) |

(52) U.S. Cl.

CPC ..... *B65H 43/04* (2013.01); *B65H 7/20* (2013.01); *B65H 33/00* (2013.01); *G07D 11/00* (2013.01); *G07D 11/0021* (2013.01)

(58) Field of Classification Search

CPC ..... B65H 43/04; B65H 33/00; B65H 7/20; G07D 11/00; G07D 11/0021

See application file for complete search history.

(56) References Cited

U.S. PATENT DOCUMENTS

2010/0007075 A1 1/2010 Ito et al.
2012/0235351 A1* 9/2012 Sakoguchi ..... B65H 3/063 271/265.01

FOREIGN PATENT DOCUMENTS

EP 2 518 697 A1 10/2012
WO WO 2009/040946 A1 4/2009

OTHER PUBLICATIONS

European Search Report (Application No. 15181818.4) (7 pages—dated Apr. 2, 2016).

* cited by examiner

*Primary Examiner* — David H Bollinger
(74) *Attorney, Agent, or Firm* — Renner, Kenner, Grieve, Bobak, Taylor & Weber

(57) ABSTRACT

A paper sheet handling apparatus that recognizes by using a recognition unit and counts paper sheets being transported via a transport path includes a dust tray that is arranged inside a housing of the paper sheet handling apparatus for collecting dust generated inside the housing and that can be pulled out of the paper sheet handling apparatus from a front surface thereof.

13 Claims, 24 Drawing Sheets

ANGLE a = 70 DEGREES (60≦a≦80)

ANGLE b = 15 DEGREES (0<b≦30)

ANGLE c = 95 DEGREES (70<c<120)

d = 93.0 mm (LENGTH OF SHORT EDGE OF WIDEST BANKNOTE 85 mm)

e = 71.5 mm (LENGTH OF SHORT EDGE OF WIDEST BANKNOTE 85 mm)

f = 33 mm (MAXIMUM NUMBER OF STACKABLE BANKNOTE 200)

| | STACKING UNIT | PRIORITY | DENOMINATION | FITNESS |
|---|---|---|---|---|
| PATTERN 1 | FIRST STACKING UNIT | 1 | — | — |
| | SECOND STACKING UNIT | 2 | — | — |
| PATTERN 2 | FIRST STACKING UNIT | 2 | — | — |
| | SECOND STACKING UNIT | 1 | — | — |

PAPER SHEET HANDLING APPARATUS

TECHNICAL FIELD

The present invention relates to a paper sheet handling apparatus that recognizes the kind of a paper sheet and stacks the recognized paper sheet in a stacking unit corresponding to the recognition result.

BACKGROUND ART

Conventionally, in financial institutions such as banks, paper sheet handling apparatuses that handle paper sheets such as banknotes and checks have been used. Banknote handling apparatuses are used, for example, to recognize the authenticity of a banknote, count the number and the amount of banknotes, and the like. While the banknote is being transported inside the banknote handling apparatus, dust adhering to the banknote and paper dust scraped off the surface of the banknote tends to fall inside the banknote handling apparatus. If the dust is left unattended, it can adhere to the sensor that recognizes the kind and the like of paper sheet, resulting in recognition failure, or adhere to the transport path, resulting in transport failure. Hence, it is necessary to remove the dust and the like that is generated inside the banknote handling apparatus.

A banknote handling apparatus in which it is possible to remove dust and the like is disclosed in Patent Document 1. This apparatus is constituted by a lower unit and an upper unit that can be opened upward in relation to the lower unit. A partitioning member is arranged on the side of the lower unit between the upper unit and the lower unit. Dust and the like generated when the banknote is transported over the transport path inside the upper unit falls on the partitioning member. The accumulated dust can be removed by opening the upper unit.

CITATION LIST

Patent Document

[Patent Document 1] International Publication 2008/096427

SUMMARY OF INVENTION

Technical Problem

However, the drawback of the above-described prior art is that it takes time and effort to remove the dust and the like accumulated inside the paper sheet handling apparatus. Specifically, not only is it necessary to open the upper unit of the apparatus, it is also necessary to gather the dust and the like that is spread over a wide area on the partitioning member.

The present invention has been made in order to solve the problem in prior art. It is one of objects of the present invention to provide a paper sheet handling apparatus in which the dust and the paper dust generated inside the apparatus can be easily removed.

Solution to Problem

To solve the above problems and to achieve the above objects, according to an aspect of the present invention, a paper sheet handling apparatus that recognizes by using a recognition unit and counts paper sheets being transported via a transport path includes a dust tray that is arranged inside a housing of the paper sheet handling apparatus for collecting dust generated inside the housing and that can be pulled out of the paper sheet handling apparatus from a front surface thereof.

According to another aspect of the present invention, the above paper sheet handling apparatus further includes a dust receiving plate that collects the dust present outside the dust tray into the dust tray.

According to still another aspect of the present invention, the above paper sheet handling apparatus is constituted by a lower unit and an upper unit that can be opened and closed relative to the lower unit, and the dust receiving plate is arranged inside the upper unit.

According to still another aspect of the present invention, in the above paper sheet handling apparatus, the dust receiving plate slants with the upper unit when the upper unit is opened or closed, and the dust receiving plate is arranged at a position where the dust slid down from the dust receiving plate is collected in the dust tray while the dust receiving plate slants.

According to still another aspect of the present invention, in the above paper sheet handling apparatus, the dust tray and the dust receiving plate are arranged below at least a part of the transport path.

According to still another aspect of the present invention, in the above paper sheet handling apparatus, a length of the dust receiving plate in a width direction of the transport path is greater than a width of the transport path.

According to still another aspect of the present invention, in the above paper sheet handling apparatus, the dust tray and the dust receiving plate are arranged below the recognition unit.

According to still another aspect of the present invention, in the above paper sheet handling apparatus, the recognition unit includes a thickness detection sensor that detects a thickness of the paper sheet, and at least one of the dust tray and the dust receiving plate is arranged below the thickness detection sensor.

According to still another aspect of the present invention, in the above paper sheet handling apparatus, the recognition unit includes a magnetic detection sensor that detects magnetism of the paper sheet, and at least one of the dust tray and the dust receiving plate is arranged below the magnetic detection sensor.

According to still another aspect of the present invention, in the above paper sheet handling apparatus, the recognition unit includes a thickness detection sensor that detects a thickness of the paper sheet, and a length of the dust receiving plate in a width direction of the transport path is greater than a length of the thickness detection sensor in the width direction of the transport path.

According to still another aspect of the present invention, in the above paper sheet handling apparatus, the recognition unit includes a magnetic detection sensor that detects magnetism of the paper sheet, and a length of the dust receiving plate in a width direction of the transport path is greater than a length of the magnetism detection sensor in the width direction of the transport path.

Advantageous Effects of Invention

According to the present invention, in the paper sheet handling apparatus, the dust tray for collecting the dust and the paper dust generated inside the housing of the apparatus is arranged so that the dust tray can be taken out from the front surface of the apparatus to the outside the apparatus.

The dust and the like generated inside the apparatus and accumulated in the dust tray can be easily removed and disposed by taking out the dust tray from the front surface of the apparatus. Therefore, there is no need to open the upper part of the apparatus and collect the dust and the like present inside the apparatus.

Moreover, according to the present invention, the dust receiving plate for collecting the dust and the like into the dust tray is arranged. The dust receiving plate is arranged in a slanted state so that the dust and the like collected thereon slides down into the dust tray. Consequently, the dust and the like can be collected from a wider area than the area from which dust and the like falls in the dust tray.

Moreover, according to the present invention, because the dust receiving plate arranged inside the upper unit slants and the dust and the like slides down into the dust tray when the upper unit of the paper sheet handling apparatus is opened, the dust and the like can be collected in the dust tray from a wider area.

Moreover, according to the present invention, the length of the dust receiving plate in the width direction of the transport path is longer than the widths of the transport path, the recognition unit and the plural rollers included in the recognition unit. Therefore, the dust generated by the transport path, the recognition unit, the rollers and the like, which tend to generate dust and the like, can be collected in the dust tray.

DESCRIPTION OF EMBODIMENTS

A paper sheet handling apparatus according to the present invention will be described below with reference to attached drawings. The paper sheet handling apparatus according to the present invention is capable of processing paper sheets, such as banknotes, checks, and merchandise coupons as processing objects. In the following explanation, a banknote handling apparatus that processes banknotes will be described as an example.

[External Appearance and Configuration of the Apparatus]

Figure 1:
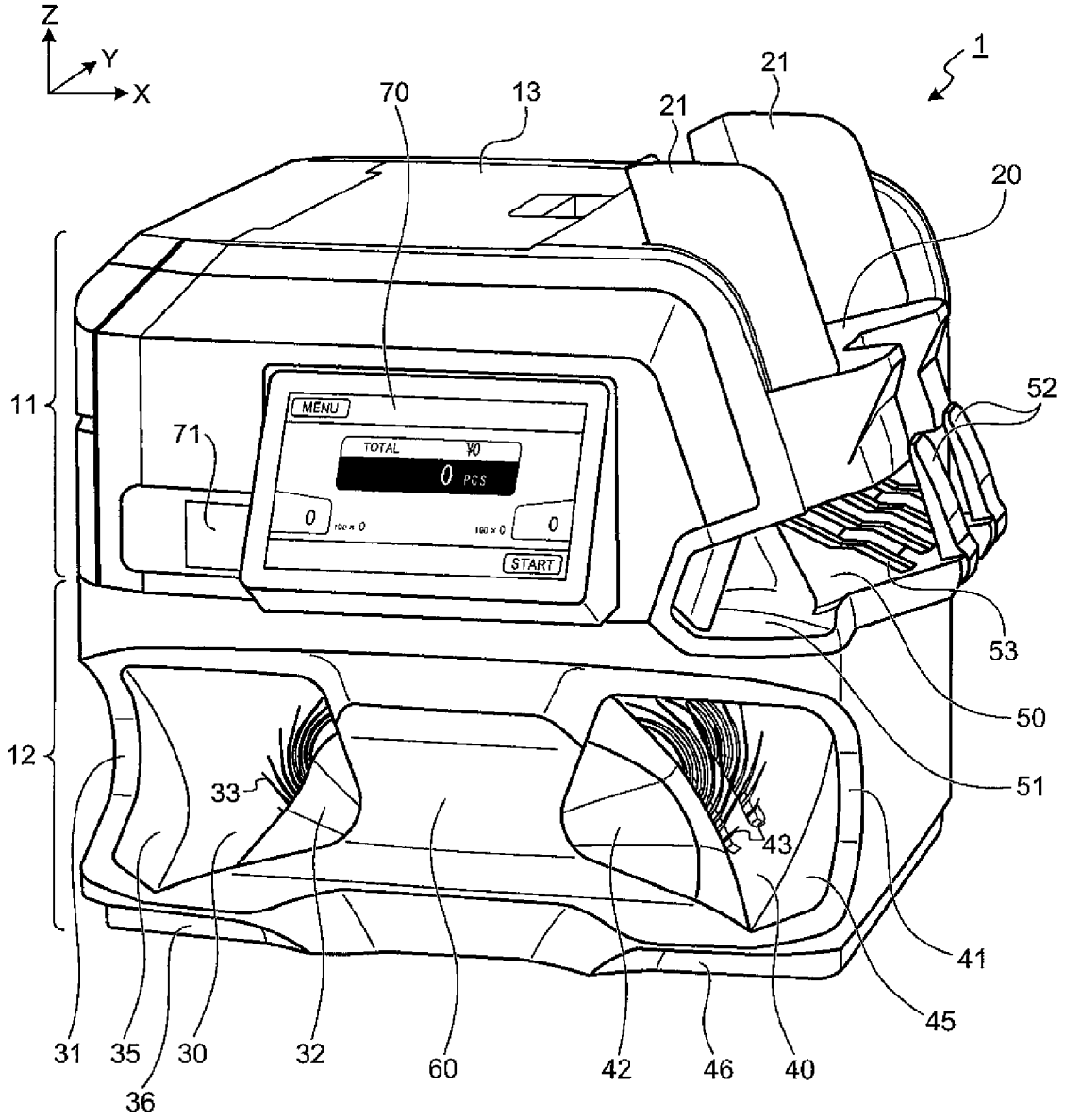
FIG. 1 is a perspective view that illustrates an external appearance of a banknote handling apparatus according to an embodiment of the present invention.

FIG. 1 is a perspective view that illustrates an external appearance of a banknote handling apparatus 1. The banknote handling apparatus 1 is provided with a receiving unit 20 and a reject unit 50 on its side surface and two banknote stacking units 30, 40 on its front surface. Each of the banknote stacking units 30, 40 has an opening for taking out the stacked banknotes. One of the characteristics of the banknote handling apparatus 1 is that the apparatus has been made compact by reducing the breadth (width) of the apparatus by stacking banknotes in an inclined standing position in an inside of each of the banknote stacking units 30, 40 and suppressing protrusion of the reject unit 50 from the side surface of the apparatus.

In the present embodiment, among four side surfaces of the apparatus, the near side, on which an operation display unit 70 is provided, of an operator who operates the banknote handling apparatus 1 is referred to as the front side. The side surface of the apparatus on the right side when viewed from the operator is referred to as the right side surface, and the side surface of the apparatus on the left side when viewed from the operator is referred to as the left side surface. The side surface of the apparatus on the back (rear)

side when viewed from the operator is referred to as the back side surface. Moreover, as illustrated in FIG. 1, in the present embodiment, a direction from the left side of the apparatus to the right side is referred to as an X-axis direction, a direction from the front surface side of the apparatus to the backside is referred to as a Y-axis direction, and a direction from the bottom surface of the apparatus to the top surface is referred to as a Z-axis direction.

An upper unit 11 and a lower unit 12 are arranged on the front surface side of the banknote handling apparatus 1. The banknote handling apparatus 1 is a small-size apparatus that can be installed in a space of a width (the dimension in the X-axis direction) of 450 mm, a depth (the dimension in the Y-axis direction) of 450 mm, and a height (the dimension in the Z-axis direction) of 400 mm. Because a part of the reject unit 50 protrudes from the right side surface, the width of the installation surface is far smaller, as small as 400 mm or less.

On the left and the right lower edges on the front surface side of the banknote handling apparatus 1, concave portions 36, 46 are formed so as to forma space for accessing between a desk top and a housing of the apparatus when the banknote handling apparatus 1 is placed on a desk. Similar concave portions 36, 46 are arranged also on the backside of the apparatus, and thus the banknote handling apparatus 1 can be carried by holding the apparatus in the concave portions 36, 40 arranged on the four corners on the bottom surface of the apparatus.

The large-size operation display unit 70 is arranged in the substantially center of the upper unit 11 on the front surface side of the apparatus. The operator can perform operations for inputting various kinds of information via the operation display unit 70. Moreover, the operation display unit 70 displays various kinds of information. The upper edge side of the operation display unit 70 is located at substantially the same level as the front surface of the apparatus, while the lower edge side thereof protrudes frontward from the front surface of the apparatus. That is, the operation display unit 70 is fixed in a state in which the unit is inclined upward so that the operator can easily verify the display content. A push-open type dust tray 71 is arranged on the left side of the operation display unit 70. The dust tray 71 pops up toward the front side when pressed toward the back surface side. Dust such as paper dust is generated in the apparatus when the banknotes are transported inside the apparatus. The generated dust is collected into the dust tray 71 for disposal to an outside of the apparatus.

The receiving unit 20 is arranged on the right side surface of the upper unit 11. Banknotes that the objects of a recognition process and a counting process are placed on the receiving unit 20. The reject unit 50 is arranged below the receiving unit 20. Banknotes to be rejected are discharged into the reject unit 50. An upper side of a stacking space in which rejected banknotes are stacked is on the side of the upper unit 11 and the bottom surface of the reject unit 50 is on the side of the lower unit 12. A top cover 13, which can be opened and closed, is arranged on the upper surface of the upper unit 11. An engagement member is arranged between the top cover 13 and the upper unit 11. The top cover 13 is fixed to the upper unit 11 by using the engagement member in an ordinary state. Referring to FIG. 1, a lever for releasing the engagement by the engagement member is arranged in the substantially center location in the front-back direction on the right side of the top cover 13. By performing an operation for opening the top cover 13 upward in a state in which the operator operates the lever with a finger, a series of operations including an operation for releasing the engagement by the engagement member and an operation for opening the top cover 13 of which the engagement has been released can be performed. By opening the top cover 13, the recognition unit and the transport path provided inside the upper unit 11 are exposed, and it is possible to carry out inspection and maintenance operations of exposed units.

Banknotes with the short edge thereof oriented toward the front side (toward the negative side of the Y-axis) and the long edge oriented toward the front of the transport direction (toward the negative side of the X-axis) can be placed in a stacked state onto the receiving unit 20. The banknotes stacked on a stage of the receiving unit 20 are fed into the transport path in the apparatus sheet by sheet starting from the bottom banknote of the stack. The respective banknotes fed into the transport path are transported with the long edge thereof being the front side in the transport direction. The receiving unit 20 is provided with guide members 21 that support the banknotes placed in the stacked state from the short edge side of the banknotes (i.e., from the Y-axis direction). The guide members 21 are made of a transparent resin, and therefore, an operator can visually verify the banknotes placed on the receiving unit 20 from outside the apparatus. The two guide members 21 have a shape symmetrical in relation to the XZ plane and can be moved by sliding them in the Y-axis direction in interlocked manner with each other. By adjusting the position of the two guide members 21 in accordance with the length of the banknote on its long edge, banknotes can be placed in substantially the center in the front-back direction of the receiving unit 20 (in the Y-axis direction) so as to feed the banknotes in substantially the center in the direction of width of the transport path (i.e., in the Y-axis direction). The stage of the receiving unit 20 onto which the banknotes can be placed is shaped such that substantially the center thereof in the front-back direction (in the Y-axis direction) is recessed toward the left (i.e., in the negative side on the X-axis direction). Through the recess, the inside of the stacking space of the reject unit 50 provided below the receiving unit 20 can be visually checked (see FIG. 2B). Therefore, whether the rejected banknotes have been discharged into the reject unit 50 can be easily verified after all the banknotes having been placed on the stage of the receiving unit 20 are fed into the apparatus.

Referring to FIG. 1, the reject unit 50 is provided with two stopper members 52, which stop the rejected banknotes discharged into the stacking space of the reject unit 50 from the transport path in the apparatus so that the rejected banknotes would not jump out of the apparatus, and a holding member 53, which holds the rejected banknotes, which stopped in the stacking space, from above. The stopper member 52 is maintained in its ordinary position illustrated in FIG. 1 by a spring member, and is supported so as to be turnable around the Y-axis toward the outside of the apparatus. When taking out the rejected banknote stacked in the reject unit 50 from the right side of the apparatus, the stopper member 52 are turned clockwise so that the rejected banknotes can be easily taken out. In the right lower portion of the front surface of the upper unit 11, a recessed portion 51 is provided, which is recessed from the front side of the housing toward the rear surface side. Moreover, a side wall that supports the rejected banknotes inside the stacking space in the reject unit 50 from the short edge side is shaped so as to the right side of the side wall on the front side is cut out toward the left. The cut-out portion of the side wall connects the stacking space of the reject unit 50 and the space inside the recessed portion 51 at a location inwardly from the outer side surface of the housing. Because the space inside the recessed portion 51 on the front side of the housing is connected to the stacking space in the reject unit 50 on the right surface side, the operator of the banknote handling apparatus 1 can easily verify whether the rejected banknotes are present in the reject unit 50 even from the front surface side of the apparatus, and if present, the operator can easily take out the rejected banknotes from the reject unit 50.

In the recessed portion 51, a lever for releasing the engagement by the engagement member that engages the upper unit 11 and the lower unit 12 together is provided at an obliquely upper left location. This lever is provided at a location at which when the operator inserts his/her right hand into the recessed portion 51 so as to lift the right surface side of the upper unit 11, the operator can hold the lever with his/her finger. With this configuration, by performing an operation for opening the upper unit 11 upward in a state in which the operator has accessed the recessed portion 51 and holding the lever with his/her finger, a series of operations including an operation for releasing the engagement by the engagement member and an operation for opening the upper unit 11 of which the engagement has been released can be performed.

On both the right and the left outside portions of the lower unit 12, two banknote stacking units 30, 40 are provided. Each of the banknote stacking units 30, 40 has an opening on the front surface side of the apparatus. The banknotes which have been fed from the receiving unit 20 into the apparatus are recognized and counted by the recognition unit arranged inside the apparatus. The banknotes that have been recognized as the objects to be stacked in the banknote stacking units 30, 40 are stacked in the first banknote stacking unit 30 or the second banknote stacking unit 40 in accordance with the recognition result. The banknotes that have been discharged from the right upper portion into the first banknote stacking unit 30 are transported by a blade wheel 33, which rotates counterclockwise around the Y-axis, toward the left side wall inside the banknote stacking unit 30. The left side wall is inclined with the upper portion thereof being the left side and the lower portion thereof being the right side. The banknotes that have been transported by the blade wheel 33 toward the left side wall are stacked in an inclined standing position so that the wall surface of the inclined left side wall and the surfaces of the banknotes are in parallel to one another. Similarly, the banknotes that have been discharged from the left upper portion into the second banknote stacking unit 40 are transported by the blade wheel 43, which turns clockwise around the Y-axis, toward the right side wall in the banknote stacking unit 40. The right side wall is inclined with the upper portion thereof being the right side and the lower portion thereof being the left side. The banknotes that have been transported by the blade wheel 43 to the right side wall are stacked in an inclined standing position so that the wall surface of the inclined right side wall and the surfaces of the banknotes are parallel to one another. In other words, in the stacking space of the banknote stacking unit, the banknotes are stacked in a state in which the short edges of the banknotes are oriented frontward and the long edges of the banknotes are in contact with the bottom surface of the stacking unit, and the banknotes are stacked in the inclined standing position in which the upper side of the short edges of the stacked banknotes are located closer to the outside of the apparatus than the lower side of the short edges of the stacked banknotes. The blade wheels 33, 43 are stacking wheels that are rotates in order to stack the banknotes in an aligned state in the stacking space of the first banknote stacking unit 30 and the second banknote stacking unit 40.

In the banknote handling apparatus 1, which includes the two banknote stacking units 30, 40 provided in the right and the left portions, the banknotes are stacked in the inclined standing position in the respective banknote stacking units. Accordingly, the width of the stacking space necessary for stacking the banknotes is smaller than that in a case of stacking the banknotes with the surfaces thereof arranged on the horizontal plane.

A cut-out portion 31 is arranged on the front side of the left side surface of the lower unit 12. This cut-out portion 31 is formed by cutting out the left side surface with a curved line from the front surface side to the back surface side. Similarly, a cut-out portion 41 is arranged also on the front side of the right side surface of the lower unit 12. This cut-out portion 41 is formed by cutting out the right side surface with a curved line from the front surface side to the back surface side. Moreover, on the front surface of the lower unit 12, a recess 60 that is recessed toward the back surface side, is arranged between the banknote stacking units 30, 40 provided in the right and the left portions.

The front end of the left side wall, which forms the stacking space of the first banknote stacking unit 30, is located closer to the back surface side than the cut-out portion 31 provided on the left side surface of the housing. A left-side surface 35 of the opening is formed to connect the cut-out portion 31 and the front end of the left side wall of the stacking space. The front end of the side wall on the right side, which forms the stacking space of the first banknote stacking unit 30, is located closer to the back surface side than the recess 60, which is formed between the first banknote stacking unit 30 and the second banknote stacking unit 40, and located closer to the front side than the blade wheel 33. A right-side surface 32 of the opening is formed to connect the recess 60 and the front end of the wall of the stacking space on the right side. Similarly, the front end of the side wall on the right side, which forms the stacking space of the second banknote stacking unit 40, is connected to the cut-out portion 41 via a right-side surface 45 of the opening. Moreover, the front end of the side wall on the left side, which forms the stacking space of the second banknote stacking unit 40, is connected to the recess 60 via a left-side surface 42 of the opening.

With the recess 60 on the front surface of the lower unit 12 and the left and the right side surfaces 32, 42, the operator present on the front surface side of the apparatus can easily visually verify whether banknotes have been stacked inside the first banknote stacking unit 30 and the second banknote stacking unit 40. Moreover, because the first banknote stacking unit 30 is provided with the cut-out portion 31 provided on the left side surface of the housing, the left-side surface 35 that extends from the cut-out portion 31 to the left side wall of the stacking space, and the right-side surface 32 that extends from the right side wall of the stacking space to the recess 60, the operator can easily carry out an operation for taking out the banknotes that have been stacked in the standing state inclined along the left side wall of the stacking space by holding the banknotes from the left and the right. Similarly, in the second banknote stacking unit 40, the cut-out portion 41 provided on the right side surface of the housing, the right-side surface 45 that extends from the cut-out portion 41 to the right side wall of the stacking space, and the left-side surface 42 that extends from the left side wall of the stacking space to the recess 60 are provided, and thereby the operator can easily take out the banknotes that have been stacked in the standing state inclined along the right side wall of the stacking space.

In the first banknote stacking unit 30 and the second banknote stacking unit 40, the bottom surface is extended to the front surface of the housing of the apparatus, while the cut-out portions 31, 41 are formed on the side surface. Accordingly, the banknotes can be stably stacked in the inclined standing position with their long edge being in contact with and along the bottom surface.

The right-side surface 32 and the left-side surface 35 formed in the opening portion of the first banknote stacking unit 30 are formed by curved surfaces inclined so that the opening area becomes smaller toward the stacking space; however, alternatively, the inclined curved surfaces may be omitted and the front ends of the left and the right side walls of the stacking space may remain exposed. Similarly, the left-side surface 42 and the right-side surface 45 formed in the opening of the second banknote stacking unit 40 are formed by curved surfaces inclined so that the area of the opening may become smaller toward the stacking space; however, alternatively, the front ends of the left and the right side walls of the stacking space may remain exposed.

As described above, in the banknote handling apparatus 1, the cut-out portions 31, 41 provided on the left and the right side surfaces of the housing of the lower unit 12; the recess 60 formed between the first banknote stacking unit 30 and the second banknote stacking unit 40; the inclined side surfaces 32, 35 of the opening of the first banknote stacking unit 30; and the inclined side surfaces 42, 45 of the opening of the second banknote stacking unit 40 are formed. With this configuration, the operator can easily verify the presence or absence of the banknotes stacked in the stacking spaces of the first banknote stacking unit 30 and the second banknote stacking unit 40 from the right side of the apparatus. Moreover, similarly, from the left side of the apparatus, the operator can easily verify the presence or absence of the banknotes stacked inside the first banknote stacking unit 30 and the second banknote stacking unit 40.

For example, the banknote handling apparatus 1 is installed to a teller counter of a teller window of a bank with the right side surface of the apparatus, on which the receiving unit 20 and the reject unit 50 are provided, being oriented toward the side of a customer who is present at a location outside the teller counter. The teller operates the banknote handling apparatus 1 from the front surface side of the apparatus. In this case, the customer can watch the banknotes that have been handed to the teller being placed onto the receiving unit 20 and fed into the apparatus sheet by sheet and also watch the rejected banknotes being discharged to the reject unit 50. In addition, because the lower unit 12 is provided with the cut-out portions 31, 41, the recess 60, and the side surfaces 32, 35, 42, and 45 of the openings, a customer, who is present at a location on the right side of the apparatus and is facing the teller, can watch the banknotes being stacked in the first banknote stacking unit 30 and the second banknote stacking unit 40. As described above, the receiving unit 20, the first banknote stacking unit 30, the second banknote stacking unit 40, and the reject unit 50 are arranged on the banknote handling apparatus 1 at locations at which the customer can easily see them, and the teller handles the banknotes having been received from the customer in front of the customer, and thereby it can be prevented that any doubt may arise in relation to operations of the teller and banknote processes by the banknote handling apparatus 1.

[Positional Arrangement of Ports and the Like]

Figure 2C:
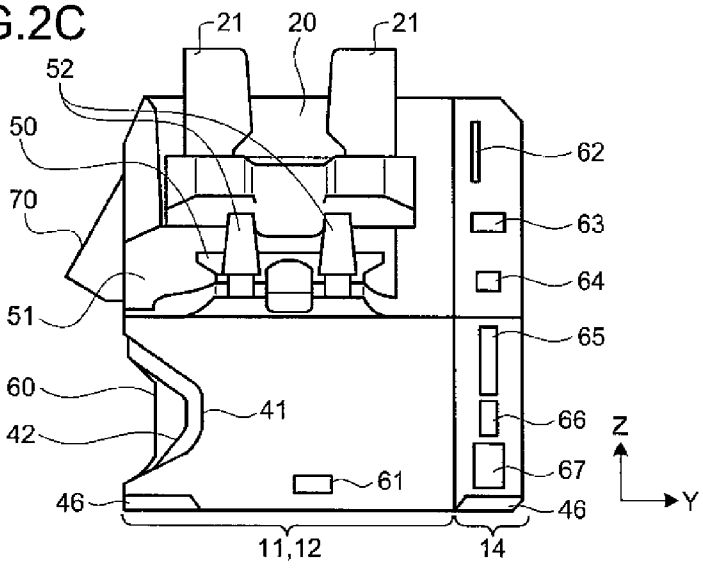
FIGS. 2A, 2B, 2C and 2D are plan views that illustrate an external appearance of the banknote handling apparatus.
Figure 2D:
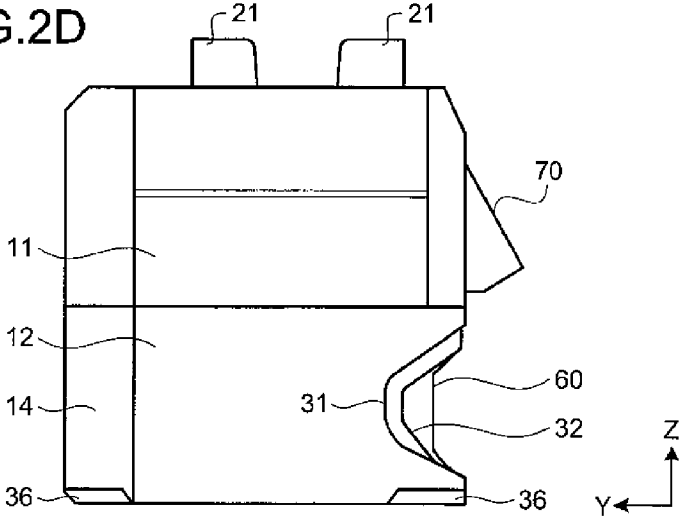
Figure 2A:
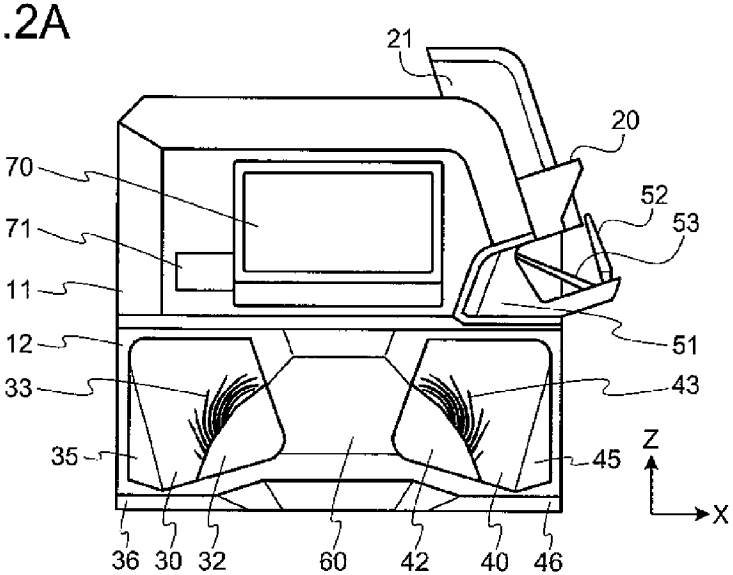
Figure 2B:
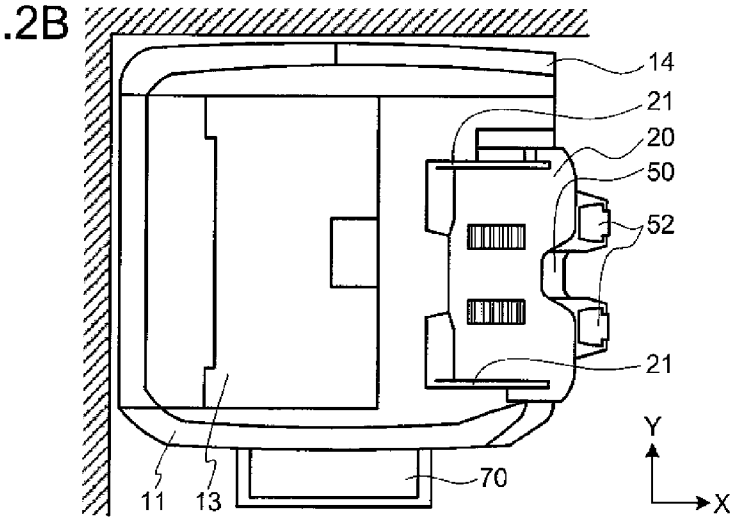

FIGS. 2A to 2D are plan views that illustrate an external appearance of the banknote handling apparatus 1. FIG. 2A illustrates the front surface, FIG. 2B illustrates the upper surface, FIG. 2C illustrates the right side surface, and FIG. 2D illustrates the left side surface of the banknote handling apparatus 1. FIG. 2B illustrates an example in which the banknote handling apparatus 1 is installed in a location with two of its surfaces are wall, i.e., with the back surface and the left side surface respectively facing the wall surfaces. The cross sections of the wall viewed from above are hatched in the drawing.

The banknote handling apparatus 1 has one characteristic in such a point that in the banknote handling apparatus 1, a slot for inserting a memory card that is a portable storage medium, ports for connecting universal serial bus (USB) cables and local area network (LAN) cables, an inlet for connecting power cables, and the like are arranged in a concentrated manner on the back surface side of the right side surface on which the receiving unit 20 and the reject unit 50 are provided, and thereby the banknote handling apparatus 1 can be installed without forming clearances between the left side surface and the back surface and the wall surfaces as illustrated in FIG. 2B.

Referring to FIG. 2C, the upper unit 11 and the lower unit 12 are arranged on the front surface side of the apparatus, and a rear unit 14 is arranged on the back surface side. The rear unit 14 is constituted by integrally formed upper and lower portions. More specifically, the housing of the banknote handling apparatus 1 is constituted by three units including the upper unit 11 arranged on the front surface side, the lower unit 12 arranged on the front surface side, and the rear unit 14 arranged on the back surface side.

In the banknote handling apparatus 1, as illustrated in FIG. 2C, a memory card slot 62, a USB port 63, a LAN port 64, a dedicated port 65 for connecting dedicated external apparatuses such as a printer, a main power switch 66, and a power inlet 67 are arranged on the right side surface of the rear unit 14 in a line in a vertical direction. Specifically, the ports and the like are centrally arranged in a partial region with a vertically long shape provided on the back surface side of the right side surface of the housing.

When using the banknote handling apparatus 1, the power inlet 67 for connecting the power cable is arranged in the lowermost portion. Moreover, above the power inlet 67, the LAN port 64, to which a LAN cable may be connected, and the dedicated port 65, to which a cable of an external apparatus may be connected, are arranged, and the USB port 63, to which a USB cable may be connected, is arranged above the ports 64, 65. The memory card slot 62, to which no cable is to be connected, is arranged in the uppermost portion. In this manner, by arranging the ports for which the possibility of connecting a cable is high in the lower portion, operations for connecting the cables to the respective ports and inserting a portable storage medium such as a memory card and a USB memory can be easily carry out.

The memory card slot 62 is used for updating template data for recognition of banknotes and function updating firmware by inserting a memory card onto which new template data for recognition of banknotes, new firmware for updating functions of the banknote handling apparatus 1, and the like have been recorded. Moreover, on the memory card that has been inserted into the memory card slot 62, data related to the banknotes processing and log data such as records of operations of the respective units of the banknote handling apparatus 1 can be recorded. The USB port 63 can be used for updating the template data for recognition, updating the firmware, recording log data, and the like by using a USB memory. The USB port 63 is also used for connecting a USB cable when a device that complies with data communication using a USB cable is connected to the apparatus.

The LAN port 64 is used for connecting the banknote handling apparatus 1 to a network by using a LAN cable. By connecting the banknote handling apparatus 1 to a network, it is enabled to perform data communication with external apparatuses such as a host terminal and a management server and control the banknote handling apparatus 1 from the external apparatus. Moreover, updating of the template data for recognition, updating of the firmware, accumulation of log data, and the like of the banknote handling apparatus 1 can be performed from other apparatuses such as host terminals via the network.

The dedicated port 65 is an interface for connection of dedicated apparatuses such as a printer and a display device. The power inlet 67 is a port for connection of a power cable for supplying electric power to the banknote handling apparatus 1. The main power switch 66 is a switch for switching ON or OFF the power supplied via the power cable. Referring to FIG. 2C, a sub power switch 61 is arranged on the right side surface of the lower unit 12 of the banknote handling apparatus 1. The banknote handling apparatus 1 is started by turning ON both the main power switch 66 and the sub power switch 61. In a state in which the main power switch 66 has been turned OFF, processing of banknotes by the banknote handling apparatus 1 cannot be started even if the sub power switch 61 is turned ON, and the apparatus is in a standby state if the main power switch 66 is turned ON and the sub power switch 61 is turned OFF.

From the right side surface of the banknote handling apparatus 1 on which the receiving unit 20 and the reject unit 50 are arranged, it is necessary to perform placing of banknotes onto the receiving unit 20 and taking out of the banknotes from the reject unit 50. Accordingly, usually, the banknote handling apparatus 1 cannot be installed in such a manner that the right side surface thereof closely contacts a wall surface. Similarly, from the front surface on which the openings of the first banknote stacking unit 30 and the second banknote stacking unit 40 are arranged, it is necessary to take out the banknotes that have been stacked inside the stacking units. Accordingly, usually, the banknote handling apparatus 1 cannot be installed in such a manner that the front side surface thereof closely contacts a wall surface. In the banknote handling apparatus 1, as described above, the ports and the like are provided on the surface of the housing that cannot usually face a wall surface.

More specifically, in order to allow the customer to see how the banknotes are being handled during processing of banknotes, all of the memory card slot 62, the USB port 63, the LAN port 64, the dedicated port 65 for connecting external apparatuses, the main power switch 66, and the power inlet 67 are arranged in a concentrated manner on the right side surface that cannot face a wall surface. With this configuration, the left side surface and the back side surface, on which no ports or the like is arranged, can be oriented so as to closely contact the wall surfaces when installing the banknote handling apparatus 1 as illustrated in FIG. 2B, and thus no wasteful space may be left between the apparatus and the wall surfaces when installing the banknote handling apparatus 1. Moreover, when the banknote handling apparatus 1 is installed in the manner illustrated in FIG. 2B, because the right side surface on which the ports and the like are provided is open, the ports and the like can be used without moving the banknote handling apparatus 1.

Figure 3A:
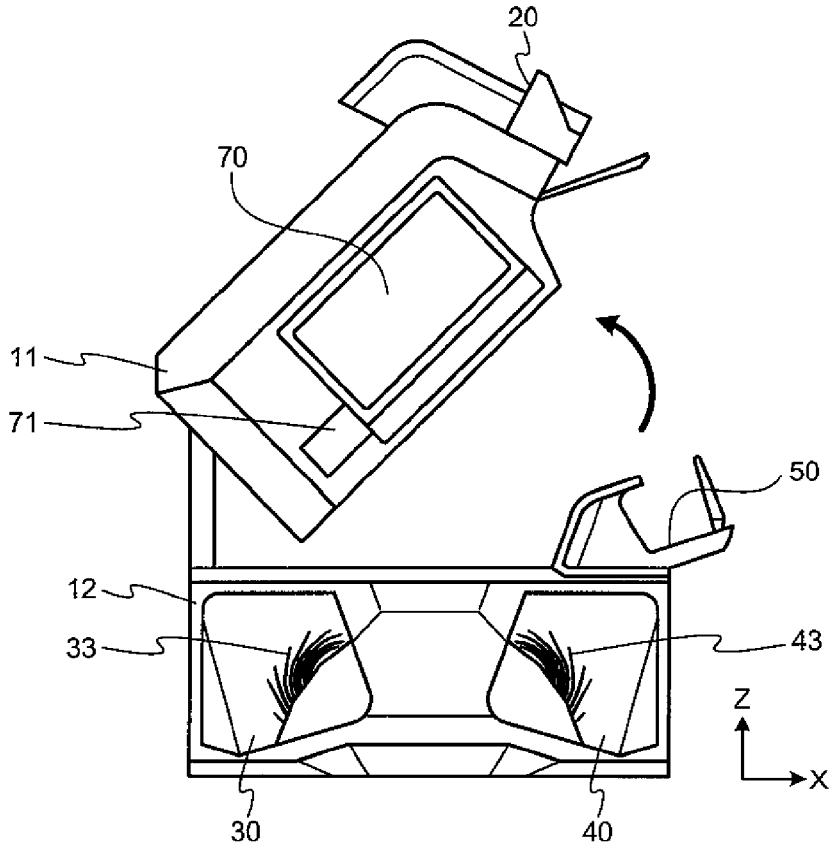
FIGS. 3A and 3B are views that illustrate an operation for opening and closing an upper unit and a rear unit.
Figure 3B:
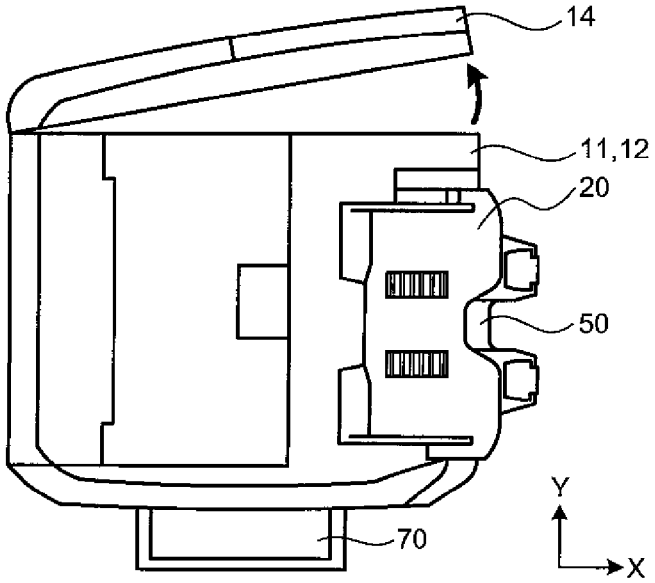

FIGS. 3A and 3B are views that illustrate opening and closing of the upper unit 11, the lower unit 12, and the rear unit 14. An engagement member is provided between the upper unit 11 and the lower unit 12. The upper unit 11 is fixed to the lower unit 12 by using the engagement member in an ordinary state. By releasing the engagement by the engagement member, the upper unit 11 can be opened upward in its right portion in relation to the lower unit 12 as illustrated in FIG. 3A. Moreover, the rear unit 14 can be opened in its right portion, in which the ports and the like are arranged in a concentrated manner as illustrated in FIG. 2C, toward the back side in relation to the upper unit 11 and the lower unit 12.

If any error such as paper jam has occurred during processing of the banknotes and a banknote has jammed in the transport path inside the apparatus, the upper unit 11 can be opened upward to remove the jammed banknote from the transport path or perform inspection, maintenance, and the like of the units and the portions provided inside the apparatus.

In the inside of the rear unit 14, a substrate, power supply unit, and the like are installed, to which the memory card slot 62, the USB port 63, the LAN port 64, the dedicated port 65 for connecting external apparatuses, the main power switch 66, and the power inlet 67 are connected. In addition, a substrate that performs control of the recognition unit for recognizing the denomination and the like of the banknotes and control of transport of the banknotes via the transport path, and the like in the banknote handling apparatus 1 is also installed inside the rear unit 14. For example, if any failure has occurred in the banknote handling apparatus 1 that has been installed in the manner illustrated in FIG. 2B, by displacing the banknote handling apparatus 1 frontward and opening the rear unit 14 toward the back side, motors and the like that drive rollers of the transport path in the upper unit 11 and the lower unit 12 can be inspected.

[Structure of the Reject Unit]

Figure 4A:
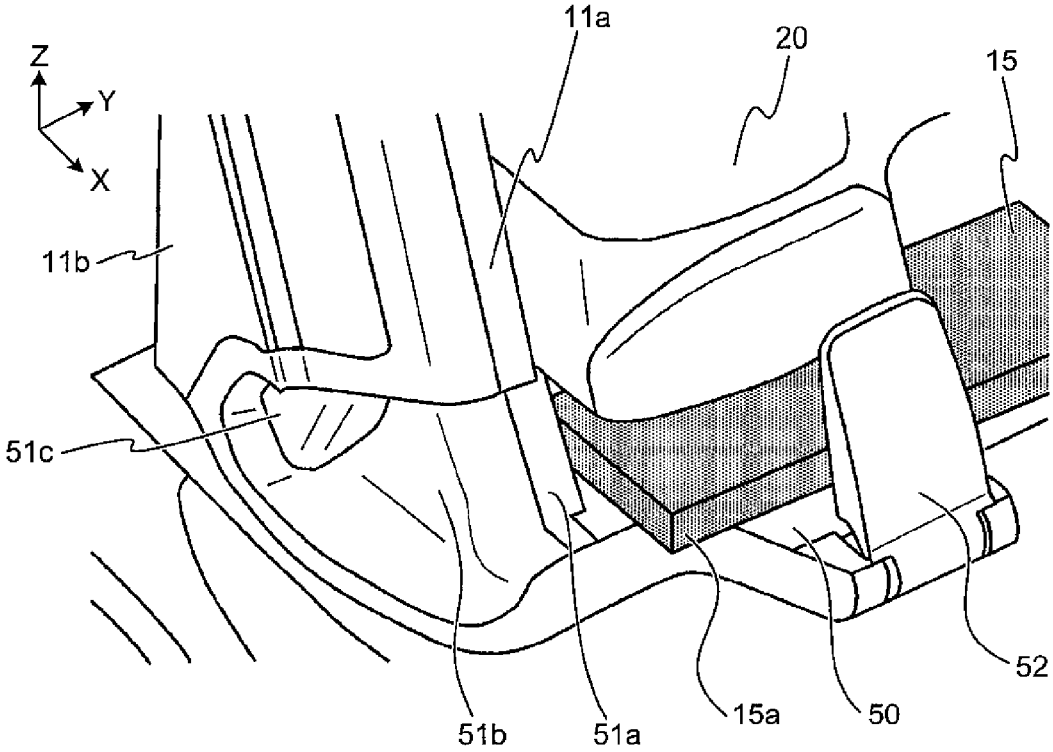
FIGS. 4A and 4B are views that illustrate a structure of a reject unit.
Figure 4B:
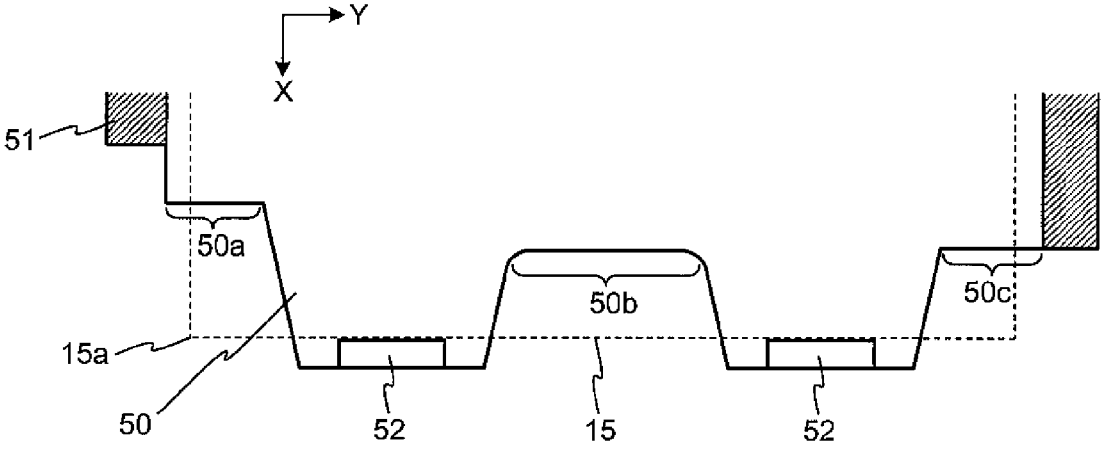

FIGS. 4A and 4B are views that illustrate the structure of the reject unit 50 and the recessed portion 51 of the housing on the front surface side of the reject unit 50. FIG. 4A is a perspective view that illustrates an external appearance of the reject unit 50, and FIG. 4B is a plan view that illustrates the reject unit 50 viewed from above. One of the characteristics of the banknote handling apparatus 1 is such that in the banknote handling apparatus 1, the right portion of a front surface side-side wall 11*a* of the reject unit 50 is cut out, and that the recessed portion 51, which is connected to the stacking space of the reject unit 50, is formed by the cut-out portion 51*a*. The recessed portion 51 is shaped so as to be recessed from a front surface 11*b* of the upper unit 11 toward the back surface side. The recessed portion 51 and the stacking space in the reject unit 50 are connected to each other by the cut-out portion 51*a* of the side wall 11*a*, which is formed continuously from a front surface 51*b* in the recessed portion 51.

In the above-described structure, rejected banknotes can be easily taken out even from the front surface side of the apparatus. Referring to FIG. 4A, a corner portion 15*a* of the right side of the short edge of rejected banknotes 15 stacked in the reject unit 50 protrudes from the stacking surface of the reject unit 50 frontward to the right side. Therefore, the rejected banknotes 15 can be taken out by holding the corner portion 15*a* from above and below.

A lever 51*c* for opening the upper unit 11 is arranged in the recessed portion 51. By griping and lifting the lever 51*c*, the engagement by the engagement member is released between the upper unit 11 and the lower unit 12. By lifting the lever 51*c* further upward, the upper unit 11, of which the engagement has now been released, can be lifted upward to open the upper unit 11 in the manner illustrated in FIG. 3A.

Referring to FIG. 4B, the rejected banknotes 15 are stacked in the stacking space of the reject unit 50 as indicated by the broken line. On the stacking surface on which the rejected banknotes 15 are stacked, a stacking surface 50*b* present between two stopper members 52 has a depth equivalent to a portion cut out toward the left side of the apparatus (i.e., toward the negative side of the X-axis). Therefore, the rejected banknotes 15 can be held and taken out by holding them in the opening portion from above and below.

A back side stacking surface 50*c* of the reject unit 50 has a depth equivalent to a portion cut out down to the same depth as the depth of the stacking surface 50*b* present between the stopper members 52 toward the left side of the apparatus (i.e., toward the negative side of the X-axis). In contrast, a front side stacking surface 50*a* of the reject unit 50 has a depth equivalent to a portion cut out deeper than the stacking surface 50*b* present between the stopper members 52 and the back side stacking surface 50*c*. The cut-out portion 51*a* of the side wall of the reject unit 50 arranged on the front surface side of the apparatus is located at a location more deeper than the front side stacking surface 50*a* toward the left side of the apparatus. The front side stacking surface 50*a* is formed on the front surface side of the apparatus at a location equivalent to a portion cut off deeper than the other stacking surfaces 50*b* and 50*c* by one stage. The cut-out portion 51*a* on the side wall is located at a location equivalent to a portion cut off far deeper than the location of the front side stacking surface 50*a* by one more stage. In other words, two stages of openings including the front side stacking surface 50*a* and the cut-out portion 51*a* on the side wall are formed on the front surface side of the apparatus.

[Operation Display Unit]

Figure 5:
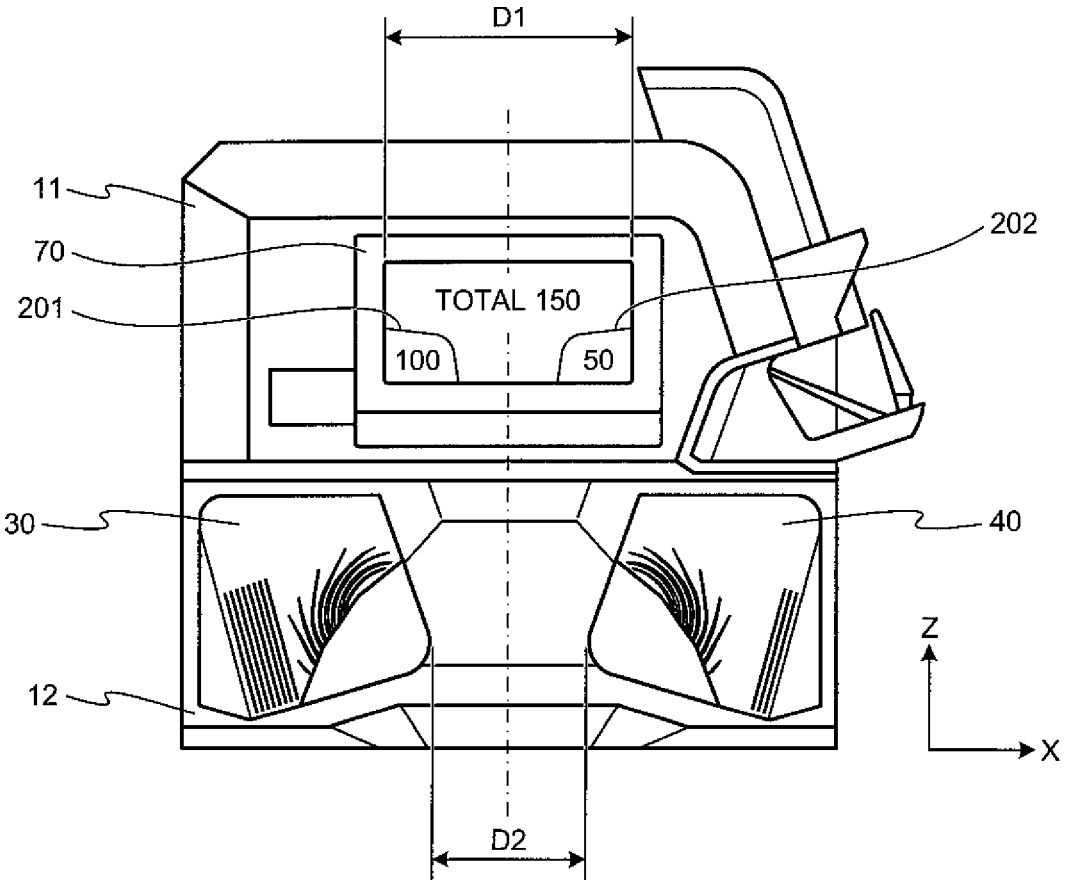
FIG. 5 is a view that illustrates a positional relationship between an operation display unit and two banknote stacking units arranged on a front surface side of the apparatus.

FIG. 5 is a view that illustrates a positional relationship between the two banknote stacking units 30, 40 and the operation display unit 70. One of the characteristics of the banknote handling apparatus 1 is that the banknote handling apparatus 1, although it is a small-size apparatus, has the large-size operation display unit 70 capable of displaying a large number of types of information, and that information about the banknote stacking unit is displayed on the operation display unit 70 so that the relationship between the displayed information and the banknote stacking units can be easily recognized.

The operation display unit 70 is a touch panel type liquid crystal display device constituted by a 107 mm (height) by 142 mm (width) liquid crystal screen. The operation display unit 70 is capable of displaying information by characters, static images, moving images, and the like in colors and also capable of receiving information inputted via the touch panel. The dimension of the front surface of the banknote handling apparatus 1 constituted by the upper unit 11 and the lower unit 12 is approximately 390 mm long and approximately 350 mm wide. Thus, the dimension of the display screen of the operation display unit 70 is approximately 11% of the front surface of the apparatus by the area ratio.

Referring to FIG. 5, the first banknote stacking unit 30 and the second banknote stacking unit 40 are arranged in the outer left portion and outer right portion of the lower unit 12. The operation display unit 70 is arranged in substantially the center in the left-right direction viewed from the front surface side. The operation display unit 70 is at a location including the center line of the banknote stacking unit. By arranging the banknote stacking units 30, 40 in the lower unit 12 and the operation display unit 70 in the upper unit 11, it is possible to use the operation display unit 70 with a width (D1) of the display screen constituted by a liquid crystal display wider than the distance (D2) between the first banknote stacking unit 30 and the second banknote stacking unit 40 provided in the left and the right portions.

The left end of the display screen of the operation display unit 70 is located at a location closer to the outer end (left outer end) of the apparatus than the location of the right end of the first banknote stacking unit 30, and the right end of the display screen is located at a location closer to the outer end (right outer end) of the apparatus than the location of the left end of the second banknote stacking unit 40. Accordingly, in a lower left portion of the display screen of the operation display unit 70, a first dedicated display region 201 is provided, which displays information about the first banknote stacking unit 30, and in a lower right portion of the display screen, a second dedicated display region 202 that displays information about the second banknote stacking unit 40 is provided, and thus information corresponding to the respective banknote stacking unit can be easily recognized. For example, as illustrated in FIG. 5, the number of the banknotes stacked in the first banknote stacking unit 30 is displayed in the first display region 201 and the number of the banknotes stacked in the second banknote stacking unit 40 is displayed in the second display region 202, and the total of these numbers is displayed in substantially the center of the operation display unit 70. With this configuration, the operator of the banknote handling apparatus 1 can easily recognize the relationship between the displayed information and the banknote stacking units 30, 40 although text information indicating which of the pieces of information displayed in the first display region 201 and the second display region 202 corresponds to which of the first banknote stacking unit 30 and the second banknote stacking unit 40 is not displayed.

As described above, if the display screen is divided into plural partial regions in such a manner that the upper side of the display screen of the operation display unit 70 corresponds to the upper surface of the banknote handling apparatus 1, that the left side and the right side of the display screen correspond to the left side surface and the right side surface of the banknote handling apparatus 1, that the lower side of the display screen corresponds to the bottom surface of the banknote handling apparatus 1, and that the display screen of the operation display unit 70 is assumed to be the front side surface of the apparatus, then information about the banknotes stacked in the first banknote stacking unit 30 is displayed in the first display region 201 provided in the lower left portion of the screen corresponding to the location of arrangement of the first banknote stacking unit 30, and information about the banknotes stacked in the second banknote stacking unit 40 is displayed in the second display region 202 provided in the lower right portion of the screen corresponding to the second banknote stacking unit 40. Accordingly, the information about the banknotes stacked in the first banknote stacking unit 30 is displayed in the first display region 201, which is near the first banknote stacking unit 30 on the display screen of the operation display unit 70, and the information about the banknotes stacked in the second banknote stacking unit 40 is displayed in the second display region 202, which is near the second banknote stacking unit 40 on the display screen.

When displaying the information about the banknote handling apparatus 1 on the display screen of the operation display unit 70, a location of the displayed information corresponds to a location of a component of the banknote handling apparatus 1 related to the displayed information. Therefore, the operator can easily recognize the relationship between the respective pieces of displayed information and the corresponding component of the banknote handling apparatus 1.

In the example illustrated in FIG. 5, the number of banknotes stacked in the respective banknote stacking unit is only displayed on the display screen of the operation display unit 70. However, by changing the setting for the information to be displayed, information that indicates the kinds of banknotes such as the denomination and the fitness, the total amount of the banknotes stacked in the respective banknote stacking units, the number of remaining banknotes to stack a predetermined number of banknotes in the respective banknote stacking unit, and the like can be displayed on the operation display unit 70. Moreover, for example, information related to operations performed for the respective banknote stacking units, such as information for instructing taking out of the banknotes from the banknote stacking units, and the like can be displayed on the operation display unit 70. Moreover, for example, plural pieces of information, such as both the denomination and the number of the banknotes, and the like can be displayed in the respective display regions 201 and 202. Moreover, the number of banknotes of a batch process and the number of successfully-processed batch processes may be displayed on the screen, which will be described in detail below.

[Internal Structure of the Apparatus]

Figure 6:
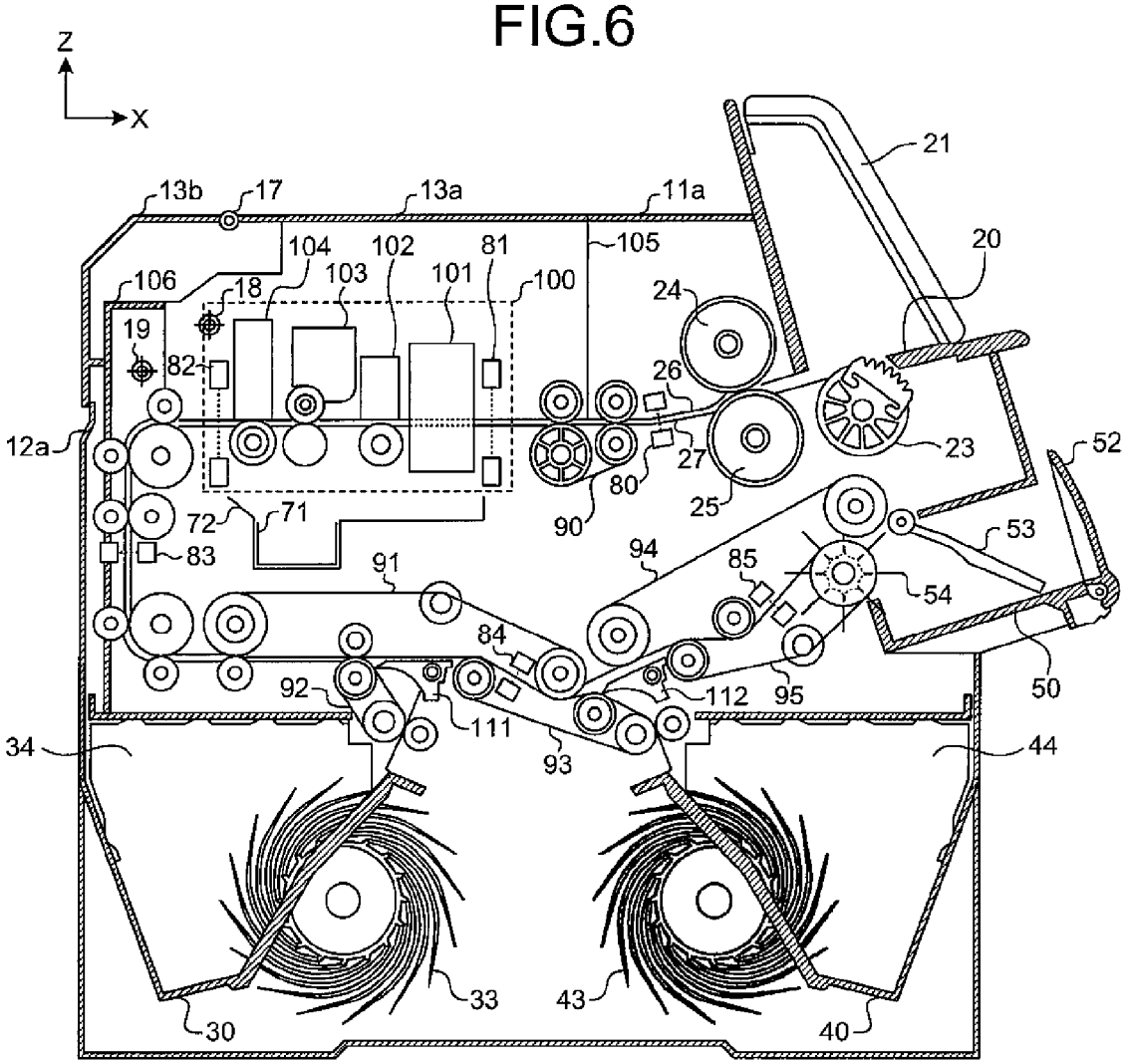
FIG. 6 is a schematic cross-sectional diagram that illustrates an outline of an internal configuration of the banknote handling apparatus.

Next, an internal structure of the banknote handling apparatus 1 will be described. FIG. 6 is a schematic cross-sectional diagram that illustrates an outline internal configuration of the banknote handling apparatus 1 viewed from the front. The bottom banknote of plural banknotes having been placed in a stacked state onto the receiving unit 20 provided in the upper right portion of the apparatus is fed by a kicker roller 23 into the inside of the apparatus. More specifically, the banknotes are separated sheet by sheet by a feed roller 25 and a reverse roller 24, which are arranged so as to face each other, and only the banknote stacked at the bottom is fed into the transport path. The banknote fed into the apparatus is transported leftward through the transport path formed by an upper transport guide 26 and a lower transport guide 27. Multiple rollers and transport belts 90 to 95 that are wound around plural rollers are exposed into the transport path from the transport guides 26, 27, and the banknote is transported by the rollers or the transport belts 90 to 95.

With respect to the transport belts 91 to 95, the transport belt wound around the rollers at both ends is not in an entirely parallel state between the portion of the belt travelling in the upper track and the portion of the belt travelling in the lower track, but the portion of transport belt that forms the transport path is pushed up and down by the rollers. With the above-described configuration, the gripping force applied between the banknote to be transported and the transport belt can be secured and the banknote can be stably transported without providing rollers facing each other vertically across the transport path.

The transport path in the banknote handling apparatus 1 is constituted by an upper transport path for transporting the banknote leftward (i.e., toward the negative side of the X-axis) in the upper unit 11, a lower transport path for transporting the banknote rightward (i.e., toward the positive side of the X-axis) in the lower unit 12, and an intermediate transport path that connects the upper transport path to the lower transport path enabling transporting the banknote downward (i.e., toward the negative side of the Z-axis). Having been fed from the receiving unit 20 and transported leftward through the upper transport path, the banknote passes through a recognition unit 100, and the transport direction is changed so that it is transported downward through the intermediate transport path, then the transport direction is further changed so that it is transported rightward through the lower transport path.

The recognition unit 100 arranged in the upper transport path includes a line sensor 101 for obtaining a transmission image, a reflection image of the upper surface of the banknote, and a reflection image of the lower surface of the banknote; a ultraviolet (UV) sensor 102 for detecting emission of light excited by irradiation with UV light; a thickness detection sensor 103 for detecting the thickness of the banknote; and the magnetic detection sensor 104 for detecting magnetic characteristics of the banknote. On the basis of the optical characteristics, magnetic characteristics, and the thickness of the banknote obtained by these sensors, the denomination, authenticity, fitness, the face/back state, orientation, and the like of the banknote can be recognized.

Plural transported banknote detection sensors 80 to 85 that detect the banknote passing through the transport path are arranged in the transport path. The transported banknote detection sensors 80 to 85 include a light irradiation unit and a photodetecting unit, and detect the banknote on the basis of changes in the light transmitted and shielded by the passage of the banknote. In the upper transport path, the recognition unit 100 carries out a banknote recognition process for recognizing the passing banknote after having recognized the timing of passage of the banknote on the basis of the results of the detection by the transported banknote detection sensor 81.

In the lower transport path, a first diverting member 111 is provided at a first branch point, and a second diverting member 112 is provided at a second branch point, which is located on the downstream side of the first branch point. At the first branch point, the banknote is distributed by the first diverting member 111 into the downstream of the lower transport path or the first banknote stacking unit 30. Similarly, at the second branch point, the banknote is distributed by the second diverting member 112 into the reject unit 50 or the second banknote stacking unit 40.

Specifically, the first diverting member 111 is controlled on the basis of the recognition results by the recognition unit 100 and the timing of passage of the banknote detected by the transported banknote detection sensor 83. If the banknote detected by the transported banknote detection sensor 83 is not the object of stacking in the first banknote stacking unit 30, the first diverting member 111 shifts to the state illustrated in FIG. 6, and the banknote passes through the first branch point and is transported rightward without being diverted to the first banknote stacking unit 30. On the contrary, if the banknote is the object of stacking in the first banknote stacking unit 30, the first diverting member 111 is turned clockwise and the banknote is diverted from the transport path toward the first banknote stacking unit 30. Similarly, the second diverting member 112 is controlled on the basis of the recognition results and the timing of passage of the banknote detected by the transported banknote detection sensor 84 in the lower transport path. The banknote to be stacked in the second banknote stacking unit 40 is diverted from the transport path toward the second banknote stacking unit 40. On the other hand, if the banknote is a rejected banknote, the rejected banknote passes the second branch point and is transported rightward into the reject unit 50 without being diverted into the second banknote stacking unit 40. Although the rejected banknote that has been transported at a high speed is discharged forcefully in the reject unit 50, the leading edge of the rejected banknote is stopped by the stopper member 52 and the rejected banknote is slapped downward by a rotating elastic fin wheel 54 at the trailing edge thereof. Moreover, the holding member 53 holds the rejected banknote downward, and thereby the rejected banknote is stacked in the reject unit 50. The rotating elastic fin wheel 54 is stacking wheels that are rotates in order to stack the banknotes in an aligned state in the stacking space of the reject unit 50.

The downstream side of the second diverting member 112 is an inclined transport path that is inclined upward so as to become higher toward the downstream side. Below the inclined transport path, the reject unit 50 is arranged so as to come under the transport path leftward, and with this structure, the rejected banknote having been transported obliquely upward in the inclined transport path is discharged into the stacking space in the reject unit 50 from the upper left of the reject unit 50. Because the transport path is formed in an inclined state and a part of the reject unit 50 is accommodated inside the apparatus, the rotational axis of the elastic fin wheel 54 is located more to the inside of the apparatus (i.e., toward the negative side of the X-axis) in the horizontal direction (X-axis direction) than the location of the rotational axis of the kicker roller 23 of the receiving unit 20. In the banknote handling apparatus 1, the banknotes are stacked in the banknote stacking units 30, 40 in the inclined standing position, and in addition, a part of the reject unit 50 is embedded inside the apparatus. With this structure, downsizing of the banknote handling apparatus 1 is implemented.

The transported banknote detection sensor 85 is provided on the downstream side of the second diverting member 112, and transported banknote detection sensors 86, 87 are provided in a branched transport path branched from the first diverting member 111 toward the first banknote stacking unit 30 and a branched transport path branched from the second diverting member 112 toward the second banknote stacking unit 40, respectively (see FIGS. 11A and 11B), and thereby the banknote present in these transport paths can be detected. The transported banknote detection sensors 80 to 87 are used for detecting the presence or absence of any transported banknote, and also for detecting the presence or absence of residual banknotes remaining in the transport path if any error has occurred and the transport of the banknotes has been stopped.

Pushing members 34, 44 are arranged on the back surface side of the first banknote stacking unit 30 and the second banknote stacking unit 40. After the processing of the banknotes placed on the receiving unit 20 is completed and all the banknotes have been stacked in the first banknote stacking unit 30, the second banknote stacking unit 40, or the reject unit 50, the pushing members 34, 44 move frontward, and thereby all the banknotes having been stacked in the stacking spaces are pushed out toward the opening provided on the front surface side, as will be described below.

[Opening and Closing of the Upper Portion of the Apparatus]

Next, opening and closing of the upper unit 11 of the banknote handling apparatus 1 and the recognition unit 100 of the upper unit 11 will be described. A supporting shaft 19, which is the center of the turning of the upper unit 11 in opening the upper unit 11 upward as illustrated in FIG. 3A, is provided to a frame 106 fixed to the lower unit 12 as illustrated in FIG. 6. A supporting shaft 18, which is the center of turning of the recognition unit 100 provided in the upper unit 11 in opening it upward in a state in which the upper unit 11 is still closed, is provided to a frame fixed to the upper unit 11.

Moreover, the top cover 13 of the housing is divided into a front cover 13*a* and a rear cover 13*b*. The rear cover 13*b* is supported by a supporting shaft 17 arranged at the rear end of the front cover 13*a* so as to be turnable upward and clockwise around the supporting shaft 17.

Figure 7:
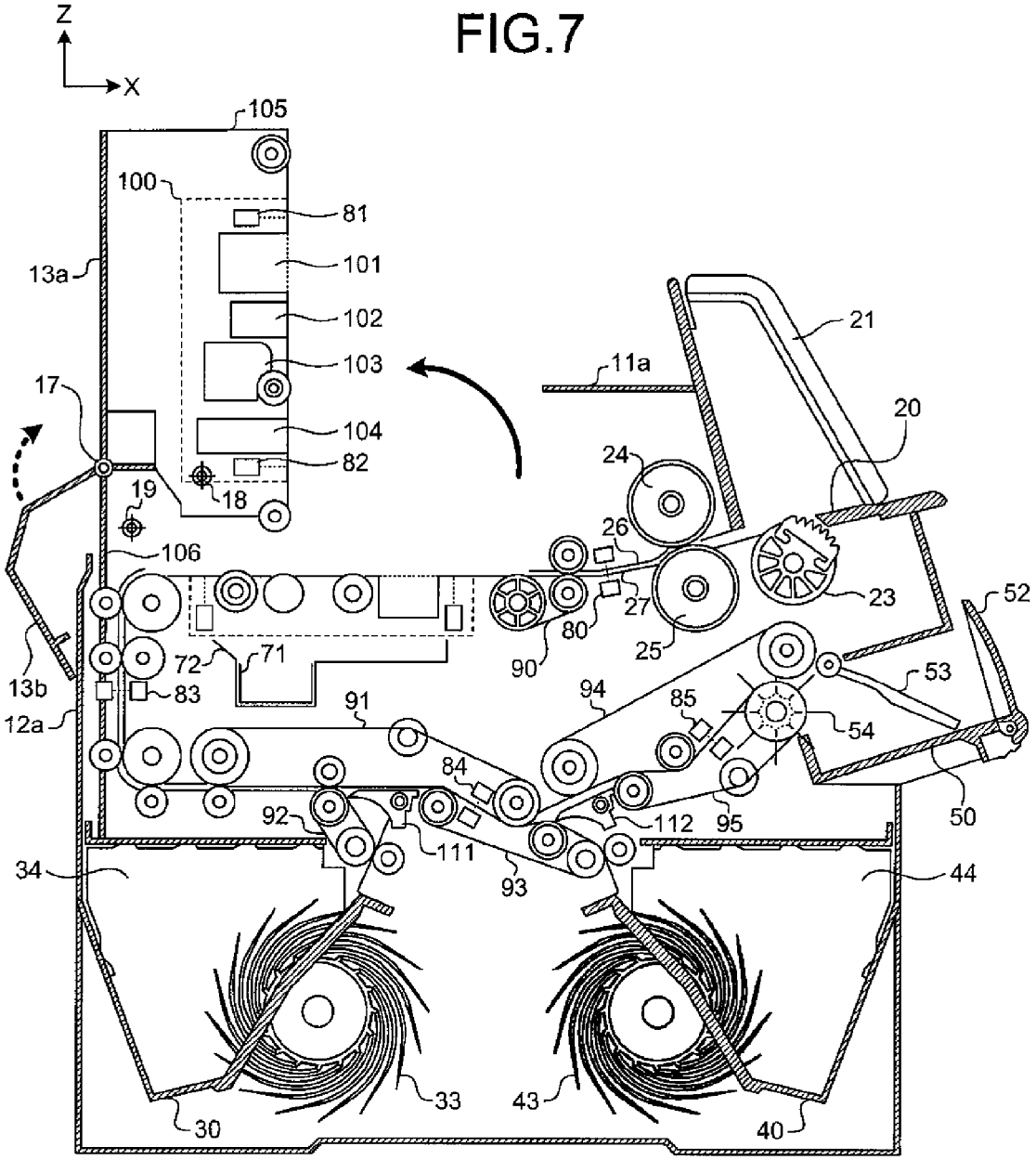
FIG. 7 is a schematic cross-sectional diagram that illustrates an operation for opening and closing a recognition unit.

FIG. 7 is a schematic cross-sectional diagram that illustrates a state in which the recognition unit 100 is opened upward. The recognition unit 100 is divided into two portions across the transport path in the vertical direction. The upper portion of the recognition unit 100 above the transport path and some rollers provided above the transport path on the upstream side and the downstream side of the recognition unit 100 constitute a recognition unit upper section 105. The recognition unit upper section 105 is turnable around the supporting shaft 18 to be opened upward. With this structure, various operations, such as inspection and maintenance of the respective sensors 101 to 104 provided to the recognition unit 100, removal of the banknotes and the dusts clogged and accumulated in the upper transport path, can be performed.

When the recognition unit upper section 105 is opened upward together with the front cover 13*a* as illustrated in FIG. 7 by a solid arrow, the rear cover 13*b* turns around the supporting shaft 17 as indicated by a dash line arrow. The rear cover 13*b* is turned with its lower rear end being moved downward along a left side surface 12*a* of the housing, and thereby the turning of the recognition unit upper section 105 is not restricted by an interference, which may occur in a case where the front cover 13*a* and the rear cover 13*b* are integrally formed, between the rear cover 13*b* and other members. With the above-described structure, the recognition unit upper section 105 can be widely opened upward.

Figure 8:
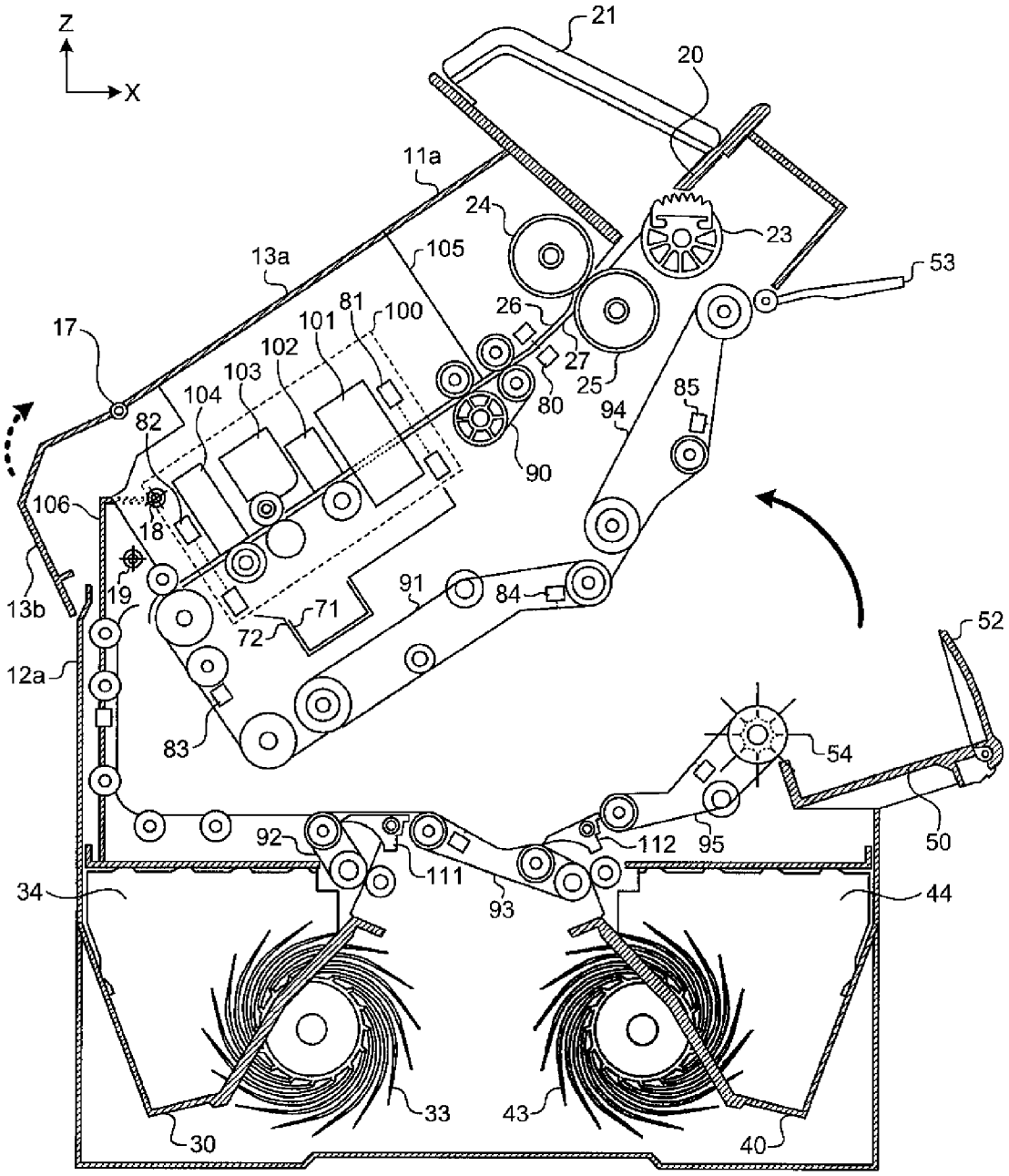
FIG. 8 is a schematic cross-sectional diagram that illustrates an operation for opening and closing the upper unit.

FIG. 8 is a schematic cross-sectional diagram that illustrates a state in which the upper unit 11 is opened upward. When the upper unit 11 is turned around the supporting shaft 19 and opened upward as illustrated in FIG. 8 by a solid arrow, the rear cover 13*b* turns around the supporting shaft 17 as indicated by a dash line arrow. The rear cover 13*b* turns with its lower rear end being moved downward along the left side surface 12*a* of the housing, and thereby the turning of the upper unit 11 is not restricted by an interference between the top cover 13 and other members, and thus it is enabled to widely open the upper unit 11 upward.

The upper transport path and the recognition unit 100 is included in the upper unit 11, which is moved upward when it is opened upward as illustrated in FIG. 8. The intermediate transport path is divided across the transport path into the right side portion and the left side portion, and the right side portion is included in the upper unit 11 while the left side portion is included in the lower unit 12. The lower transport path is divided across the transport path in the vertical direction into the upper and the lower portions, and the upper side portion is included in the upper unit 11 while the lower side portion is included in the lower unit 12. As described above, the intermediate transport path and the lower transport path are separated to be included in the upper unit 11 and the lower unit 12, and thereby the banknotes, dusts, and the like clogged and accumulated in the transport path can be removed by opening the upper unit 11 to open and expose the intermediate transport path and the lower transport path.

The receiving unit 20 and the holding member 53 that holds the banknotes in the reject unit 50 is included in the upper unit 11, and the main body of the reject unit 50 is included in the lower unit 12. In order to downsize the apparatus, in the banknote handling apparatus 1, the arrangement locations of the components are set so as to embed the largest possible part of the main body of the reject unit 50 inside the apparatus so that the reject unit 50 will not greatly protrude from the right side surface of the apparatus toward the outside of the apparatus. By opening the upper unit 11 as illustrated in FIG. 8, the banknotes, dusts, and the like clogged in the lower transport path leading to the reject unit 50 and the reject unit 50 itself can be easily removed.

In the lower unit 12, the length of the branched transport path that leads from the first branch point, where the banknote is diverted from the lower transport path toward the first banknote stacking unit 30, to the first banknote stacking unit 30 is shorter than the length of the banknote in the transport direction, i.e., shorter than the length of the short edge of the banknote. Accordingly, even if the banknote transported into the branched transport path at the first branch point gets jammed in the course of transport to the first banknote stacking unit 30, either the leading edge of the banknote is exposed in the stacking space of the first banknote stacking unit 30 or the trailing edge of the banknote is exposed on the lower transport path. Similarly, the length of the branched transport path that leads from the second branch point, where the banknote is diverted from the lower transport path toward the second banknote stacking unit 40, to the second banknote stacking unit 40 is shorter than the length of the banknote on its short edge. Accordingly, even if the transport of the banknote is stopped at this location, the operator can verify the banknote by the leading edge of the banknote exposed in the stacking space of the second banknote stacking unit 40 or by the trailing edge of the banknote exposed on the lower transport path.

As described above, in the banknote handling apparatus 1, if the transport is stopped by jamming of the banknote or the like, the recognition unit upper section 105 and the upper unit 11 can be opened upward. Accordingly, the banknote clogged in any of the upper transport path, the intermediate transport path, and the lower transport path, the banknote stopped after passing any of the first branch point and the second branch point, and the like can be securely removed.

[Dust Receiving Unit]

As illustrated in FIG. 1, the push-open type dust tray 71 is provided on the front side surface of the upper unit 11. The dust tray 71 pops up toward the front side when pressed toward the back surface side. The dust tray 71 is slid in the front-back direction along a groove formed on a dust receiving plate 72, which is fixed below the recognition unit 100 as illustrated in FIG. 6. A push-open mechanism is arranged on the back surface side of the dust tray 71. The dust receiving unit is constituted by the dust tray 71 and the dust receiving plate 72.

The thickness detection sensor 103 of the recognition unit 100 includes a reference roller, which is provided below the transport path and supported rotatably around a fixed shaft, and a detection roller, which is provided above the transport path and vertically displaceably and rotatably supported. The reference roller and the detection roller are brought into close contact with each other to form a roller pair. The thickness of the banknote is detected on the basis of the motion of the detection roller that is displaced in the vertical direction when the banknote passes through the nip between the roller pair. A large number of roller pairs constituted by the reference roller and the detection roller are arranged in the direction perpendicular to the transport direction (i.e., arrangement in the Y-axis direction). Dusts adhered to the banknote are easily scraped and removed when the banknote passes through the nips between the plural roller pairs in which the rollers are in close contact with each other. Paper dusts may also be detached from the banknote itself. In the magnetic detection sensor 104, the banknote is brought into close contact with a magnetic detection sensor, which is arranged above the transport path by using a hair-planted roller provided below the transport path, and dusts and paper dusts may be easily removed. Accordingly, the dust tray 71 is arranged below the thickness detection sensor 103 and the magnetic detection sensor 104 to receive paper dusts and other dusts in the dust tray 71.

Figure 9A:
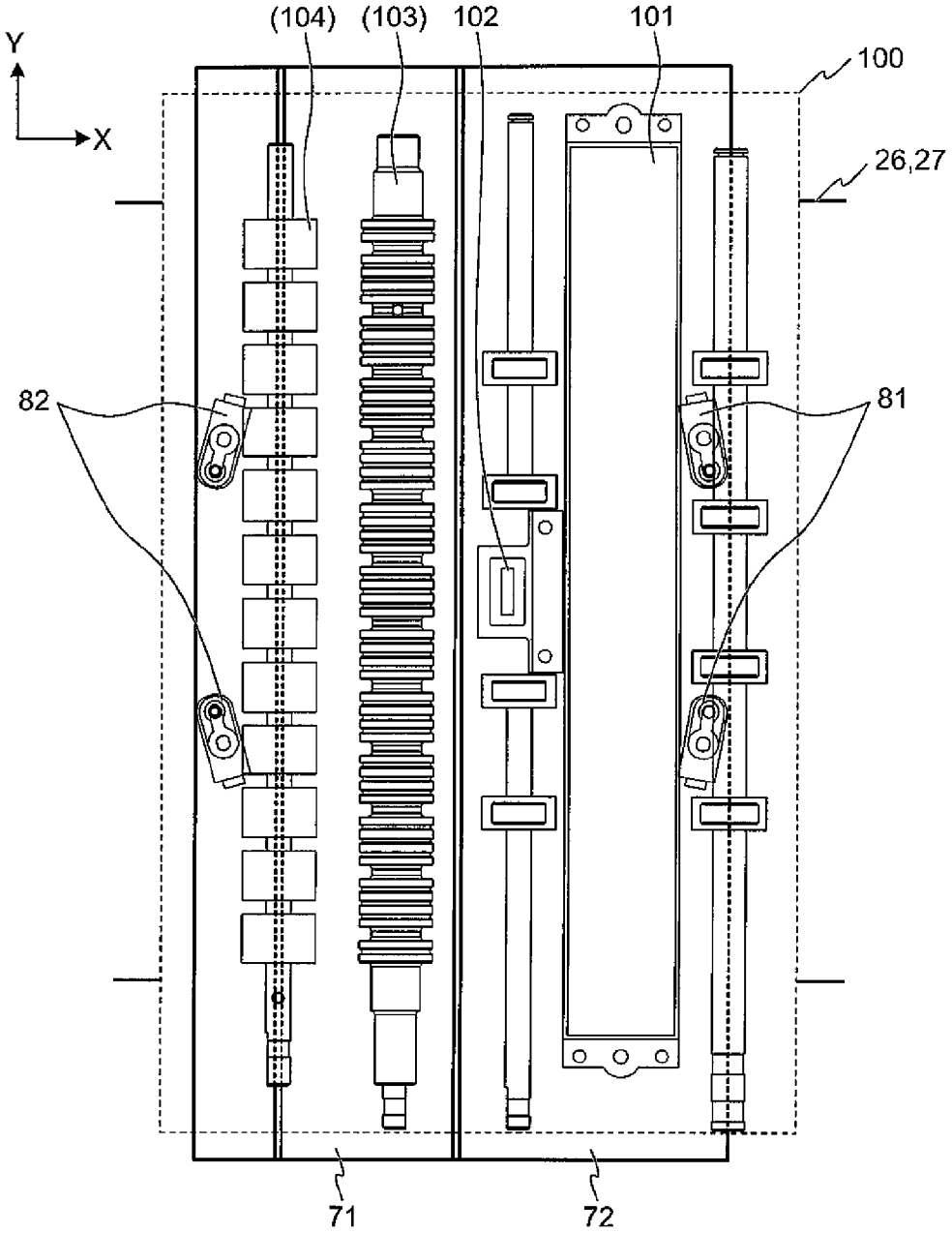
FIGS. 9A, 9B and 9C are views that illustrate a structure of a dust receiving unit.
Figure 9B:
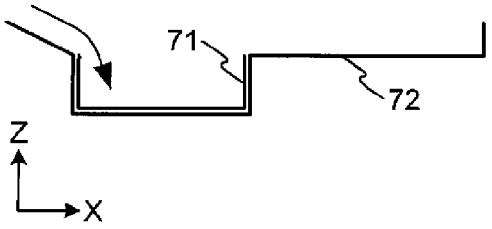
Figure 9C:
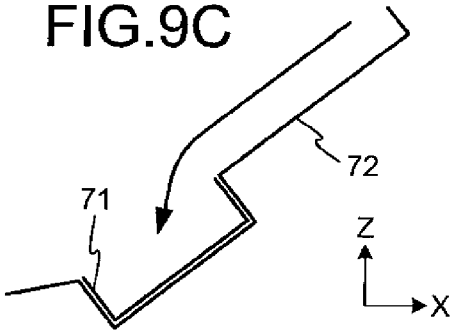

FIGS. 9A to 9C are schematic diagrams that illustrate the shape of the dust tray 71 and the dust receiving plate 72. FIG. 9A is a view that illustrates the dust tray 71 and the dust receiving plate 72 viewed from above, and FIG. 9B is a view that illustrates them viewed from the front. FIG. 9C is a view that illustrates the dust tray 71 and the dust receiving plate 72 viewed from the front when the upper unit 11 is opened as illustrated in FIG. 8. Because the portion provided below the transport path of the recognition unit 100 is illustrated in FIG. 9A, the reference roller is illustrated in the location corresponding to the thickness detection sensor 103 and the hair-planted roller is illustrated in the location corresponding to the magnetic detection sensor 104.

Referring to FIG. 9A, the length of the dust tray 71 and the dust receiving plate 72 in the front-back direction (Y-axis direction) of the apparatus is longer than the width of the transport path (the length in the Y-axis direction) formed by the transport guides 26, 27 and also longer than the recognition unit 100.

Referring to FIG. 9B, the dust receiving plate 72, when viewed from the front, slants downward from the left end located below the magnetic detection sensor 104 toward the dust tray 71, at a location to the left of the dust tray 71. Accordingly, as illustrated in FIG. 9B by an arrow, paper dusts and other dusts accumulated on the slanting portion slide down into the dust tray 71.

Moreover, the dust receiving plate 72 has a horizontal shape in the portion to the right of the dust tray 71, and when the right side of the upper unit 11 is opened as illustrated in FIG. 8, the dust receiving unit constituted by the dust tray 71 and the dust receiving plate 72 slants, together with the upper unit 11, in a state in which the right side of the dust receiving unit is lifted upward as illustrated in FIG. 9C. With this structure, as illustrated in FIG. 9C by the arrow, paper dusts and other dusts that have been accumulated on the horizontal portion in the right portion of the dust receiving plate 72 slide down to be collected into the dust tray 71.

By pressing the dust tray 71 containing the paper dusts and other dusts collected in its inside toward the back surface side, a part of the dust tray 71 pops up to the front surface side by an action of the push-open mechanism provided on the back surface side. By pulling out the dust tray 71 of which a part has popped up from the front surface of the housing, the paper dusts and other dusts collected in the dust tray 71 can be disposed.

The structure of the dust receiving unit is not limited to the shape in which the dust receiving plate 72 is shaped so that the groove portion for sliding the dust tray 71 thereon and the plate portion for collecting dusts thereon are integrally formed. In an alternative configuration, the sliding dust tray 71 and the plate for collecting dusts may be separately arranged, and the plate for collecting dusts may constitute the dust receiving plate 72. Moreover, the dust receiving plate 72 may be constituted by a single plate or alternatively may be constituted by plural plates. In still another alternative configuration, slanting plates on which dust slides down to be collected into the dust tray 71 can be arranged on the right side, the back surface side, and the like in addition to the plate provided on the left side of the dust tray 71, and the plates may constitute the dust receiving plate 72. Regardless of the configuration of the dust receiving unit, at least either one of the dust tray 71 and the dust receiving plate 72 is arranged below the thickness detection sensor 103 and the magnetic detection sensor 104 of the recognition unit 100.

[Structure of the Banknote Stacking Units]

Figure 10:
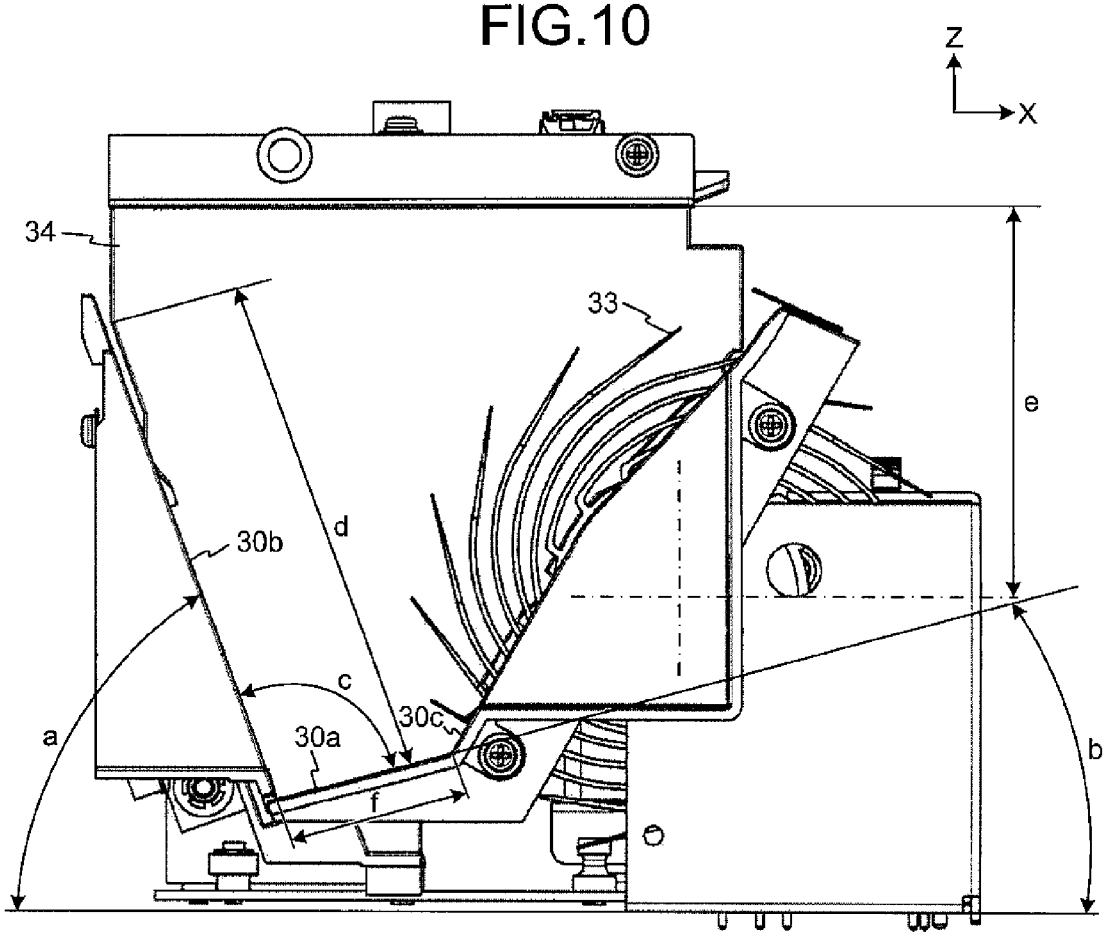
FIG. 10 is a view that illustrates a structure of the banknote stacking unit.

FIG. 10 is a view that illustrates a structure of the first banknote stacking unit 30. Because the second banknote stacking unit 40 has a structure similar to that of the first banknote stacking unit 30 and the structure of the second banknote stacking unit 40 is obtained if the first banknote stacking unit 30 is reversed in the left-right direction, description of the structure of the second banknote stacking unit 40 will be omitted and the structure of the first banknote stacking unit 30 only will be explained below.

The stacking space of the first banknote stacking unit 30 is formed by plural members such as side wall members; however, in FIG. 10, the bottom surface and the left and the right side walls are illustrated as a part of the first banknote stacking unit 30 with reference numerals 30*a*, 30*b*, and 30*c*. On the front end of the left side-side wall 30*b*, a triangular plane parallel to the XZ plane is formed, and also on the front end of the right side-side wall 30*c*, a substantially triangular shaped plane parallel to the XZ plane is formed. The base of the front end plane portion of the left side wall 30*b* and the base of the front end plane portion of the right side wall 30*c* are located at mutually different heights. The left side wall 30*b* and the right side wall 30*c* are located at locations retracted in the direction of the back surface side from the location of the bottom surface 30*a*. The left-side surface 35 of the opening illustrated in FIG. 1 is formed on a plane protruded frontward from the base of the triangular plane of the left side wall 30*b* in a plane parallel to the XY plane (see a portion 130*a* illustrated in FIGS. 15A and 15B), and the right-side surface 32 of the opening illustrated in FIG. 1 is formed on a plane protruded frontward from the base of the substantially triangular plane of the left side wall 30*b* in a plane parallel to the XY plane (see a portion 131*a* illustrated in FIGS. 15A and 15B). Specifically, the left-side surface 35 of the opening illustrated in FIG. 1 is formed by connecting the left side wall 30*b* and the cut-out portion 31 on the left side surface of the housing to cover the triangular plane portion on the front end of the left side wall 30*b*, and the right-side surface 32 of the opening illustrated in FIG. 1 is formed by connecting the right side wall 30*c* and the recess 60 to cover the substantially triangular plane portion on the front end of the right side wall 30*c*.

In the first banknote stacking unit 30, the banknote that has been diverted by the first diverting member 111 from the lower transport path into the branched transport path is discharged from the upper right portion into the stacking space via the branched transport path. The banknote that has been discharged into the banknote stacking unit is then transported leftward by the blade wheel 33 that rotates counterclockwise to be stacked so that the surface of the banknote comes along the inclined side wall 30*b* and stacked with the long edge of the banknote contacting the bottom surface 30*a*.

An angle a between the horizontal surface and the left side wall 30*b* illustrated in FIG. 10 is 70 degrees, an angle b between the horizontal surface and the bottom surface 30*a* is 15 degrees, and an angle c between the bottom surface 30*a* and the left side wall 30*b* is 95 degrees. If the angle a is made small, the size of the banknote stacking unit in the lateral direction (X-axis direction) becomes large, and the banknote handling apparatus 1 may be upsized. On the contrary, if the angle a is made large, the banknote stacked in the inclined standing position may be instable, the stacked banknotes may fall toward the blade wheel 33, and as a result, the fallen banknote may interfere with banknotes that have been newly transported into the banknote stacking unit to cause stacking failure. To prevent this, it is preferable that the angle a is 60 degrees or larger and 80 degrees or smaller.

For example, in most cases, when the first banknote is stacked in the stacking unit in which no banknote has been stacked yet, the upper long edge of the first banknote contacts the left side wall 30*b* while the lower long edge contacts the bottom surface 30*a* at a location distant from the left side wall 30*b*. Then, as subsequent banknotes are serially stacked, the lower long edge of the banknotes contacting the bottom surface 30*a* is pushed and moved toward the side wall 30*b*, and then the surface of the first banknote is aligned with the side wall 30*b*. Subsequent banknotes are moved in the similar manner to be stacked onto the first banknote. It is preferable that the angle b formed by the bottom surface 30*a* is larger than 0 degree so that the previously stacked banknote may be easily moved along the bottom surface 30*a* toward the left side wall 30*b* when the previously stacked banknote is pushed by the subsequent banknote at the lower long edge thereof. However, if the angle b is too large, it thus becomes necessary to reduce the angle a, the size of the banknote stacking unit therefore becomes large, and as a result, the apparatus may be upsized. Accordingly, it is preferable that the angle b is larger than 0 degree and 30 degrees or smaller.

When the angles a and b are set in the above-described range, it is preferable that the angle c between the bottom surface 30*a* and the side wall 30*b* is 70 degrees or larger and 120 degrees or smaller. A length d of the side wall 30*b* is set in accordance with the length of a widest banknote, of which the short edge is the longest among those of the banknotes to be handled. For example, if the length of the short edge of the widest banknote is 85 mm, the length d of the side wall 30*b* is set at 93 mm.

A height e from the center of the rotation axis of the blade wheel 33 to the upper surface of the stacking space is set in accordance with the dimension of the widest banknote, of which the short edge is the longest among those of the banknotes to be handled. When the banknote having entered the stacking space from the upper right collides with the upper surface of the stacking space during transport of the banknote leftward by the blade wheel 33 rotating counter-clockwise, the banknotes cannot be stacked in an aligned state, which may cause stacking failure. In order to prevent this, the height e is set so that while the widest banknote has entered between the blades of the blade wheel 33 and is transported by the rotating blade wheel 33 in a state in which one long edge of the widest banknote contacts with the root of the blade, the trace being formed by another long edge of the widest banknote is located lower than the upper surface of the stacking space.

In the banknote handling apparatus 1, 16 blades are provided on the outer periphery surface of the base portion with the outer diameter of 50 mm. The blades are provided around the rotation axis, at the interval of 30 degrees. The tip of the blades is extended in the reverse direction of the rotation direction of the blade wheel 33, so as to form the blade wheel 33 with the outer diameter of 100 mm. Viewed from the center of the blade wheel 33, the central angle formed between the root of each blade and the tip thereof is 60 degrees. In the banknote handling apparatus 1, by the blade wheel 33 of this structure, the height e is set to 71.5 mm so that the widest banknotes with the short edge of 85 mm can be stacked by the blade wheel 33 without causing stacking failure.

A length f of the bottom surface 30*a* is set in accordance with the number of banknotes to be stacked in the banknote stacking unit. Because banknotes to be handled by the apparatus include folded banknotes and wrinkled banknotes, and accordingly, the length f is set considering the presence of such folded or wrinkled banknotes. In the banknote handling apparatus 1, the length f is set to 33 mm in order to stack 200 sheets of banknotes.

[Structure of the Banknote Transport Path]

Figure 11A:
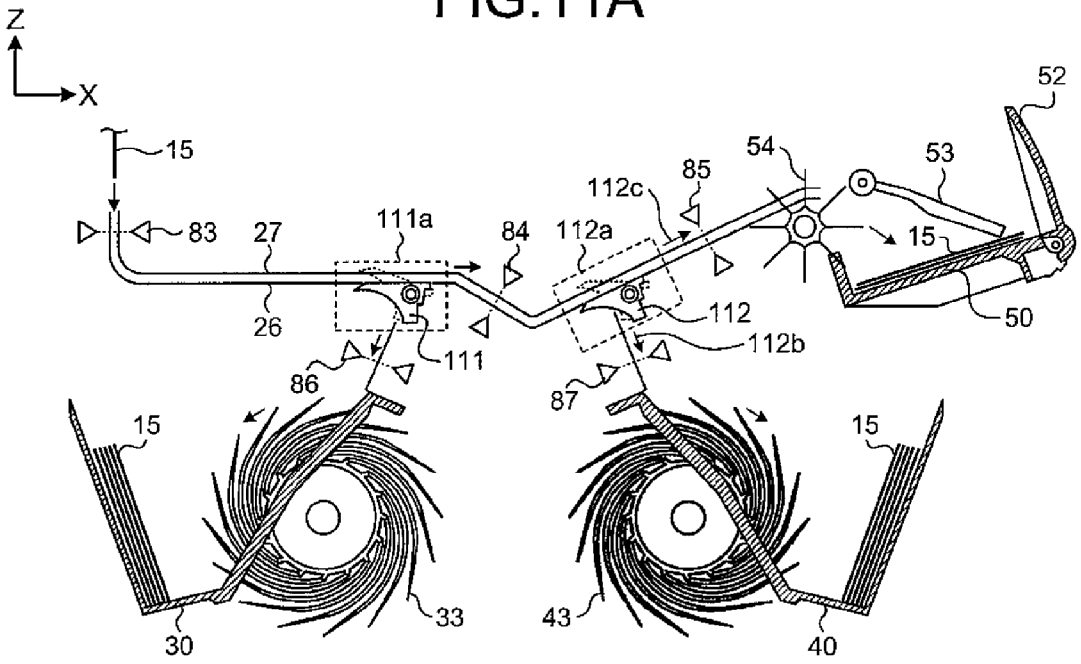
FIGS. 11A and 11B are schematic diagrams that illustrate a structure of a transport path.
Figure 11B:
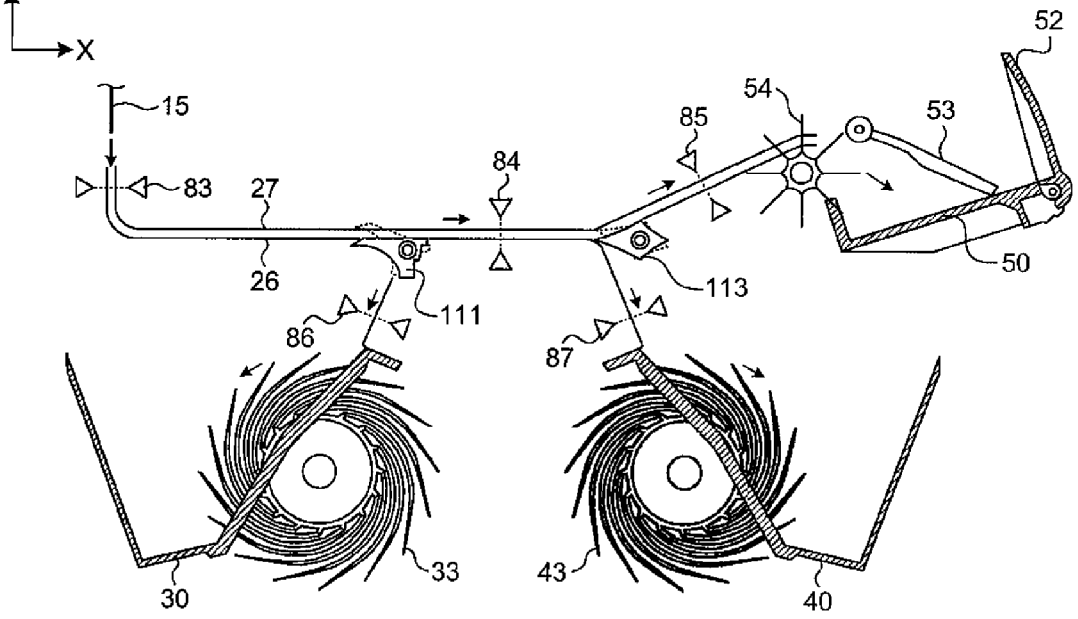

FIGS. 11A and 11B are schematic diagrams that illustrate a shape of the lower transport path in the lower unit 12 viewed from the front. FIG. 11A illustrates a shape of the lower transport path of the banknote handling apparatus 1 illustrated in FIG. 6, and FIG. 11B illustrates an example in which the lower transport path has a different shape. In FIG. 11, for easier understanding of the shape of the lower transport path, the transport belts and the rollers are omitted and the transport guides 26, 27 are illustrated to show the shape of the transport path. The banknote is transported through the nip between the transport guides 26, 27. Moreover, although they are omitted in FIG. 6, as illustrated in FIG. 11, a transported banknote detection sensor 86 is arranged in the portion of the branched transport path branched from the lower transport path to the first banknote stacking unit 30, and also the transported banknote detection sensor 87 is provided to the branched transport path branched from the lower transport path to the second banknote stacking unit 40.

Referring to FIG. 11A, after a banknote 15 has been transported downward through the intermediate transport path, a transport direction is changed and the banknote 15 is transported rightward in the lower transport path. The lower transport path is horizontally formed up to a location at which the banknote passes a first branching point 111*a* where the first diverting member 111 is installed. In the banknote handling apparatus 1, a diverting member with the same shape as that of the first diverting member 111 is used as the second diverting member 112 for a second branching point 112*a* where the banknote is diverted to the second banknote stacking unit 40.

To transport the banknote to the second banknote stacking unit 40 or the reject unit 50 by swinging the second diverting member 112, it is necessary to secure a predetermined angle or larger for the angle formed between a transport direction 112*b* for transport to the second banknote stacking unit 40 and a transport direction 112*c* for transport to the reject unit 50. In other words, if the transport path passing the second branching point 112*a* is arranged in the horizontal direction, the angle between the horizontal transport path and the transport path that branches into the transport direction 112*b* becomes so small that the second diverting member 112 cannot be used. Accordingly, in the banknote handling apparatus 1, the transport path passing the second branching point 112*a* is inclined upward so that the height thereof on the downstream side becomes high to increase the angle between the transport direction 112*b* for branching to the second banknote stacking unit 40 and the transport direction 112*c* for branching to the reject unit 50, and thereby the second diverting member 112 consisting of the same parts as those of the first diverting member 111 can be used. As a result, the transport direction of the banknote passing the first branch point 111*a* toward the second banknote stacking unit 40 and the transport direction of the banknote passing the second branching point 112*a* toward the reject unit 50 are different from each other.

Moreover, the transport direction in which the banknote is transported toward the first banknote stacking unit 30 after the banknote is diverted into the branched transport path at the first branching point 111*a* and the transport direction in which the banknote is transported toward the second banknote stacking unit 40 after the banknote is diverted into the branched transport path at the second branching point 112*a* are different from each other. Specifically, a straight line connecting between the first branching point 111*a* and the rotation axis of the blade wheel 33 of the first banknote stacking unit 30 and a straight line connecting between the second branching point 112*a* and the rotation axis of the blade wheel 43 of the second banknote stacking unit 40 are oriented in different directions from each other.

Moreover, as described above, it is necessary to set the distance from the lower transport path to the stacking space shorter than the length of the banknote on the short edge so that when the transport of the banknote is stopped, the leading edge of the banknote in its transport direction is exposed in the stacking space in the banknote stacking unit or the trailing edge of the banknote in its transport direction is exposed in the lower transport path. If this characteristic is to be implemented by setting the same height for the first diverting member 111 and the second diverting member 112 and by providing the first banknote stacking unit 30 and the second banknote stacking unit 40 with the same shape, the second banknote stacking unit 40 needs to be installed at a location that is higher than the installation location of the first banknote stacking unit 30. Accordingly, in the banknote handling apparatus 1, by setting the installation height of the second diverting member 112 lower than the installation height of the first diverting member 111, the conditions for the transport distance are satisfied and the positional relationship between the first banknote stacking unit 30 and the second banknote stacking unit 40 of the same shape installed at the same installation height is implemented.

To connect between the horizontal transport path for branching at the first branching point 111*a* and the upward-inclined transport path for branching at the second branching point 112*a*, the lower transport path is formed so that the transport path is inclined downward to lower the height of the transport path on the downstream side of the first branching point 111*a* and that the transport direction is changed to connect the transport path to the transport path that is inclined upward.

As described above, in the lower transport path of the banknote handling apparatus 1, after the banknote having passed the first branch point 111*a* in the horizontal direction, the banknote is transported through the transport path that inclined downward from its portion provided in the horizontal direction. The transport direction is then changed, and the banknote is further transported through the upward-inclined transport path to reach the second branching point 112*a*. Then, the banknote is further transported through the upward-inclined transport path toward the reject unit 50. To securely transport the banknote through the curved transport path as described above, in the banknote handling apparatus 1, the lower transport path is constituted by the banknote transport belts 91 to 95 as illustrated in FIG. 6.

The lower transport path of the banknote handling apparatus 1 has the shape illustrated in FIG. 11A to provide commonality of parts of the first diverting member 111 and the second diverting member 112; however, the shape of the lower transport path is not limited to this. For example, the lower transport path may be provided with a shape illustrated in FIG. 11B. Specifically, a configuration may be employed in which the banknote is transported through the horizontally extended transport path and diverted to the second banknote stacking unit 40 or the reject unit 50 on the downstream side of the first diverting member 111 by using a second diverting member 113 with a shape different from the shape of the first diverting member 111.

A control unit is arranged in the inside of the banknote handling apparatus 1. The control unit performs control of the above-described operations such as feeding of the banknote from the receiving unit 20, the transport of the banknote through the transport path, the recognition of the banknote by the recognition unit 100, and determination of the transport destination on the basis of the recognition results, and the control of the first diverting member 111 and the second diverting member 112 on the basis of the result of determination of the transport destination and the like. Moreover, moving of a pushing member 34, detection of taking out of the banknote from the banknote stacking units 30, 40, display of a various information on the operation display unit 70, notification of various information to the operator, selection of the banknote stacking unit based on preference setting by which the preference among plural banknote stacking units is previously set, assignment of respective kinds of banknotes to the banknote stacking unit based on the preference setting for the banknote stacking units and the number of processed banknotes by banknote kind, and the like are also implemented by the control unit by controlling the respective units as will be described below. These controls are performed by the control unit by executing programs stored in the memory unit and by referring to the setting content stored in the memory unit. Because the methods for implementing the controls are the same as those of prior art, the functions and operations on the respective units implemented by the control unit will be mainly described below.

[Banknote Pushing Mechanism]

Next, pushing members 34, 44 provided on the back surface side in the stacking space of the banknote stacking units 30, 40 of the banknote handling apparatus 1 will be described. After the handling of the banknote placed on the receiving unit 20 is completed and all the banknotes are stacked in either the first banknote stacking unit 30, the second banknote stacking unit 40, or the reject unit 50, the pushing members 34, 44 are moved forward in the first banknote stacking unit 30 and the second banknote stacking unit 40, and thereby all the banknotes stacked in the banknote stacking units are pushed forward toward the opening on the front side. Because the structure of the pushing member 34, 44 and the drive mechanism for moving the pushing members 34, 44 are the same those for both the first banknote stacking unit 30 and the second banknote stacking unit 40, the first banknote stacking unit 30 only will be described below.

Figure 12A:
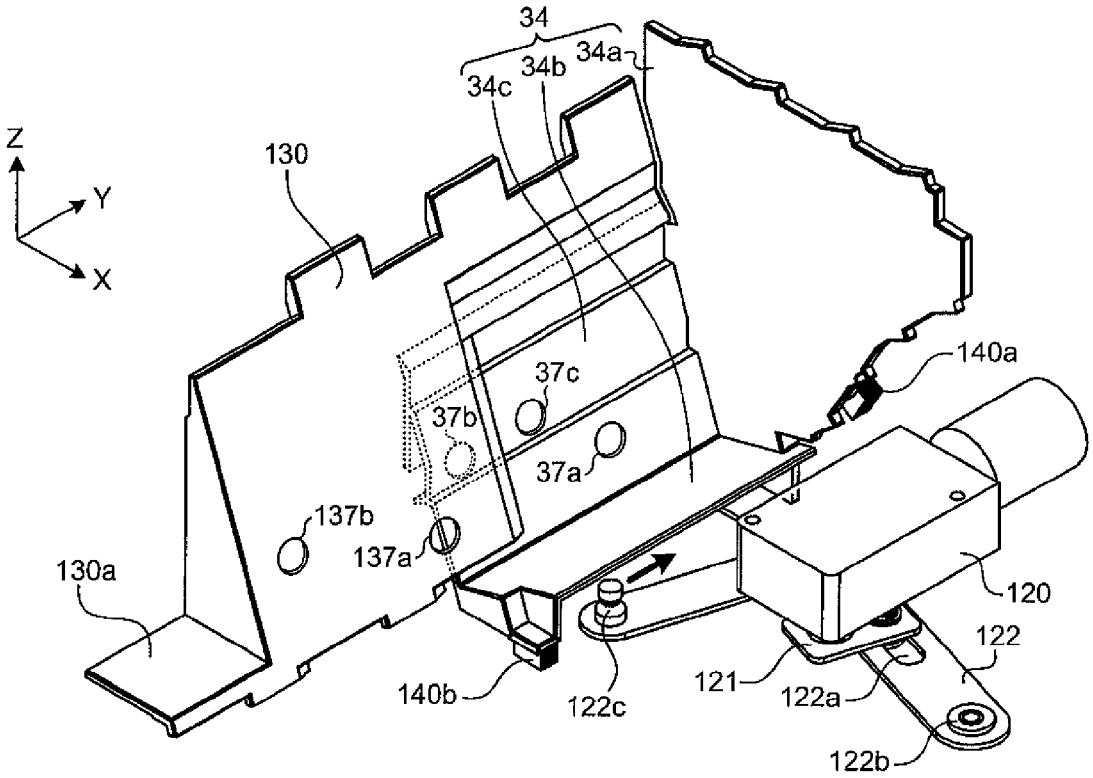
FIGS. 12A and 12B are perspective views that illustrate a structure of a pushing member provided inside the banknote stacking unit and a drive mechanism that moves the pushing member.
Figure 12B:
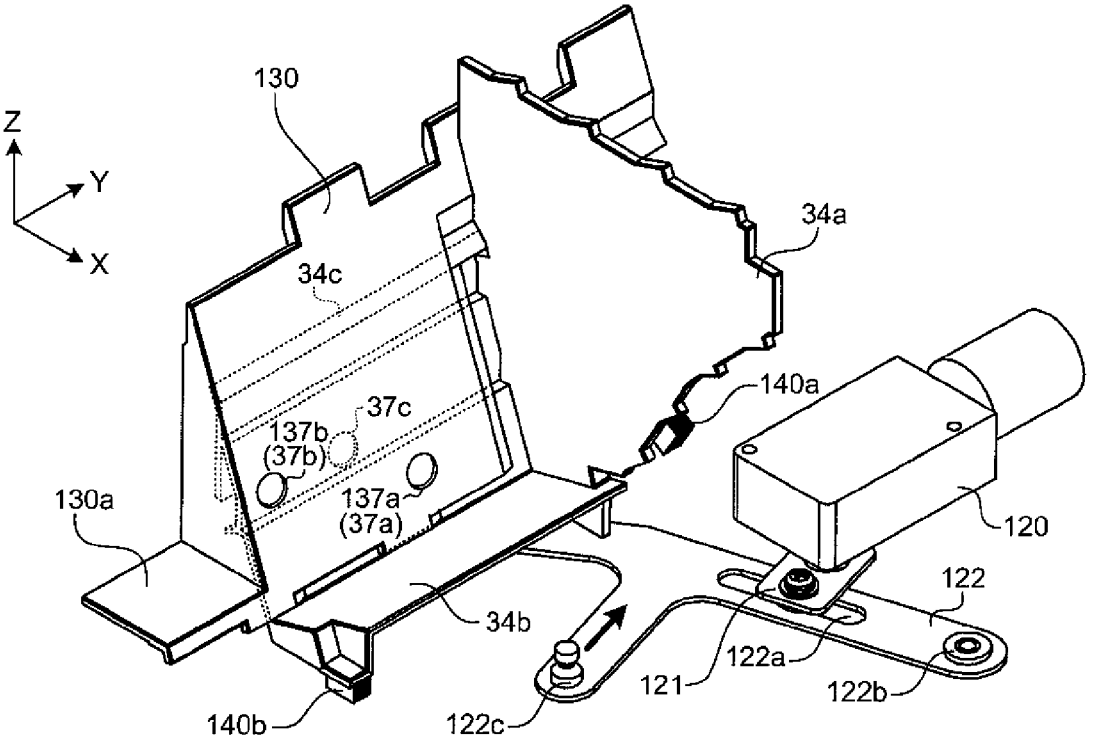

FIGS. 12A and 12B are perspective views that illustrate the structure of the pushing member 34 provided in the inside of the first banknote stacking unit 30 and the drive mechanism for moving the pushing member 34. An outer-side side wall member 130, the pushing member 34 and the drive mechanism are shown in FIGS. 12A and 12B. The outer-side side wall member 130 is provided in an outer-side portion of the apparatus (i.e., on the negative side of the X-axis). The banknote transported by the blade wheel 33 in the stacking space of the first banknote stacking unit 30 is stacked so that the banknote surface contacts the outer-side side wall member 130. The pushing member 34 is provided so as to be slidable and movable in the front-back direction (Y-axis direction) along the outer-side side wall member 130 fixed to the apparatus. The drive mechanism drives the pushing member 34. FIG. 12A illustrates a retracted position to which the pushing member 34 is retracted during stacking of the banknote, and FIG. 12B illustrates a pushing position to which the pushing member 34 is moved to push the banknote stacked in the stacking space forward.

The pushing member 34 has a structure including a back surface plate 34*a*, a bottom surface plate 34*b*, and a side surface plate 34*c*, which are integrally formed. The back surface plate 34*a*, the bottom surface plate 34*b*, and the side surface plate 34*c* are formed in a shape of a thin plate. Ribs for maintaining the strength of these plates are provided on the back side of the respective plates when the inside of the stacking space of the storage unit is regarded as the front side. The pushing member 34, which includes the back surface plate 34*a*, the bottom surface plate 34*b*, and the pushing member 34 that are integrally formed by resin molding, is used in the banknote handling apparatus 1.

On the outer peripheral edge of the back surface plate 34*a*, plural sawtooth protrusions are provided. On the wall surface that forms the stacking space, grooves are provided in the front-back direction at locations corresponding to each of the protrusions. When the pushing member 34 is moved, the protrusions of the back surface plate 34*a* move inside the grooves on the wall surface, and thereby the banknote would not slip into the gap between the pushing member 34 and the wall surface. Moreover, the surface of the side surface plate 34*c* is formed in a shape including steps corresponding to each of the protrusions of the back surface plate 34*a*. The outer-side side wall member 130 is formed in a shape corresponding to the shape of the surface of side surface plate 34. With this configuration, the banknote would not slip into the gap between the side surface plate 34*c* and the outer-side side wall member 130 when the pushing member 34 is moved.

Plural stacked banknote detection sensors for detecting the presence or absence of banknotes in the stacking space are arranged in the first banknote stacking unit 30. The stacked banknote detection sensor includes two units that irradiate and receive light irradiated so as to cross the inside of the stacking space. Specifically, the light irradiated from a light irradiation unit installed on one outer side of the stacking space passes through the inside of the stacking space and received by a light receiving unit installed on the other outer side of the stacking space, for example. If the light irradiated by the light irradiation unit is shielded by the banknote stacked in the banknote stacking unit, the light receiving unit does not receive the light, and thus the presence or absence of banknotes is detected. The stacked banknote detection sensors are arranged while adjusting the locations of the light irradiation unit and the light receiving unit so that the banknotes in the banknote stacking unit are securely detected. On the pushing member 34, sensor brushes 140*a*, 140*b* are provided for cleaning the stacked banknote detection sensors when the pushing member 34 is moved. Details of the sensor brushes 140*a*, 140*b* will be described later below.

Referring to FIG. 12A, three through holes 37*a* to 37*c* for the stacked banknote detection sensors are formed on the side surface plate 34*c* of the pushing member 34, and two through holes 137*a*, 137*b* for the stacked banknote detection sensors are formed on the outer-side side wall member 130. The stacked banknote detection sensor is arranged on the back side of the side surface plate 34*c*, i.e., on the outer side of the banknote stacking unit, in correspondence with the through hole 37*c* of the pushing member 34 in the retracted position. Moreover, the other stacked banknote detection sensor is arranged on the back side of the outer-side side wall member 130 in correspondence with the through holes 137*a*, 137*b* of the fixed outer-side side wall member 130.

When the pushing member 34 is positioned in the retracted position illustrated in FIG. 12A, the stacked banknote detection sensor is not arranged in the location corresponding to the through holes 37*a*, 37*b* of the side surface plate 34*c*; however, the through holes 37*a*, 37*b* are arranged so as to overlap with the through holes 137*a*, 137*b* of the outer-side side wall member 130 when the pushing member 34 is moved to the pushing position. With this configuration, the light from the stacked banknote detection sensor provided on the back side of the outer-side side wall member 130 would not be shielded by the side surface plate 34*c* even when the pushing member 34 has been moved to the pushing position, and thus the stacked banknote detection sensors can be used when the pushing member 34 is at the pushing position.

The drive mechanism that moves the pushing member 34 by sliding in the front-back direction is constituted by a motor 120, a cam plate 121 rotated by the motor 120, and a link plate 122 driven by the cam plate 121. The rotation of the cam plate 121 is converted by the link plate 122 into back-and-forth motion of the pushing member 34.

The pushing member 34 is supported to be movable by sliding in only the front-back direction, and the movement in the lateral direction (X-axis direction) and the vertical (Z-axis direction) is restricted. One end of the link plate 122 is attached to be rotatable around a shaft protruded from the back side of the bottom surface plate 34*b* of the pushing member 34. Moreover, the other end of the link plate 122 is rotatably attached to a rotation axis 122*b* that is fixed to the apparatus. An elongated through hole 122*a* is formed in the link plate 122. In this through hole 122*a*, a shaft on one end of the cam plate 121 of which the other end is connected to the rotation shaft of the motor 120 is inserted. When the cam plate 121 is rotated by the motor 120, the shaft of the cam plate 121 moves reciprocatingly in the through hole 122*a* of the link plate 122. By this reciprocating movement, because one end of the link plate 122 is supported by the rotation axis 122*b*, the other end of the link plate 122 moves back and forth, and the pushing member 34 connected to the other end moves back and forth.

Moreover, a not-shown spring member that exerts tensile force in a direction illustrated in FIGS. 12A and 12B by an arrow is attached to a shaft 122*c* of the link plate 122. When the motor 120 is stopped, the link plate 122 is moved by the tensile force from the spring member and thus the pushing member 34 returns to the retracted position.

The front end of the outer-side side wall member 130 is located closer to the back surface side than the cut-out portion 31 provided on the left side surface of the first banknote stacking unit 30. The triangular plane parallel to the XZ plane is formed by the front end of the outer-side side wall member 130 (see FIG. 10). The left-side surface 35 of the opening illustrated in FIG. 1 is formed in a portion 130*a* on the front surface side of the front end plane of the outer-side side wall member 130.

Figure 13A:
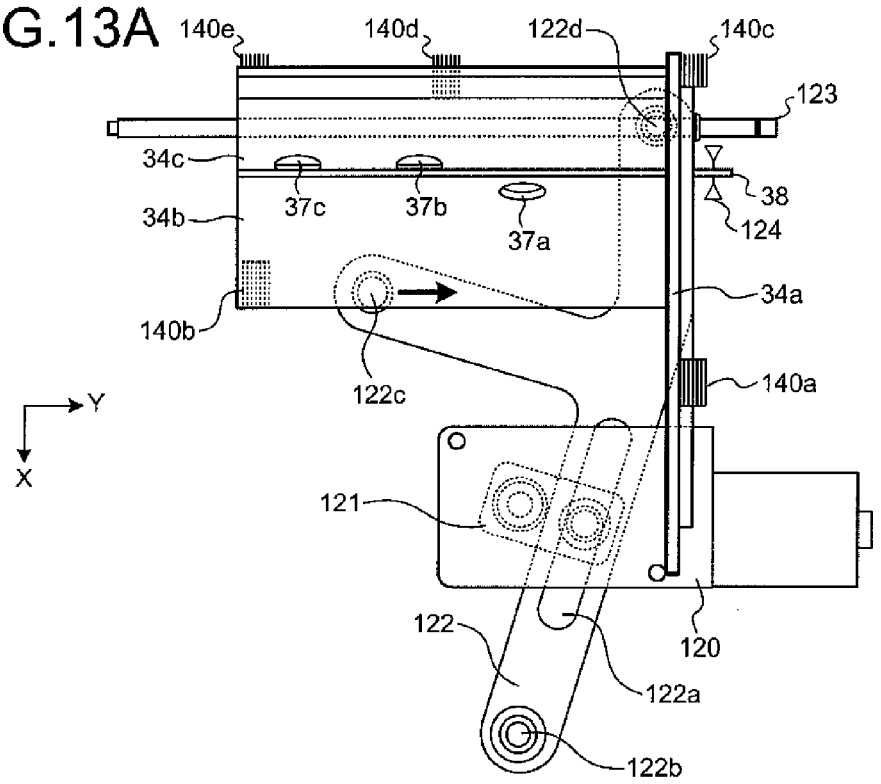
FIGS. 13A and 13B are views that illustrate a method of moving the pushing member by using a pushing mechanism.
Figure 13B:
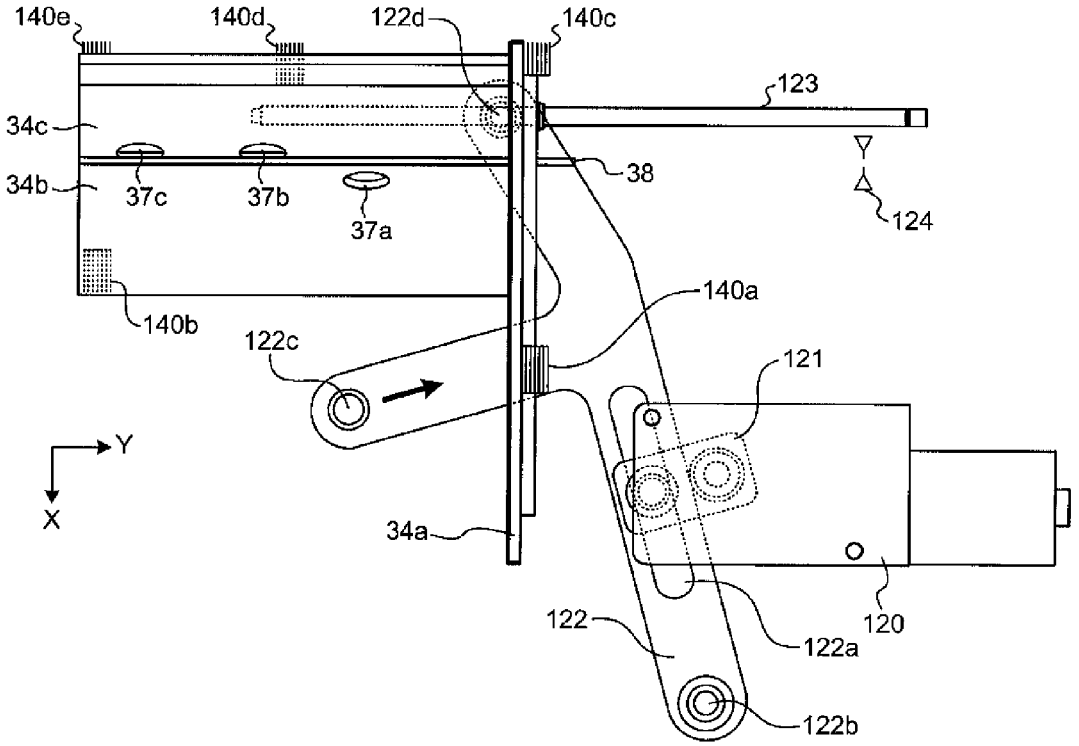

FIGS. 13A and 13B are schematic diagrams that illustrate a method for moving the pushing member 34 by the drive mechanism. FIGS. 13A and 13B are views that illustrate a state of the pushing member 34 and the drive mechanism viewed from above, and FIG. 13A illustrates the retracted position corresponding in FIG. 12A and FIG. 13B illustrates the pushing position corresponding in FIG. 12B. In addition to the sensor brushes 140*a*, 140*b* shown in FIGS. 12A and 12B, three sensor brushes 140*c* to 140*e* are provided on the pushing member 34 as illustrated in FIGS. 13A and 13B. The sensor brushes 140*a* to 140*e* will be described in detail later below.

The bottom surface plate 34*b* of the pushing member 34 includes a rib on the back side. The rib has a through hole. A rod-like slide guide 123 is fixed to the apparatus in a state in which the slide guide 123 comes through the through hole of the rib of the pushing member 34. The slide guide 123 guides the movement of the pushing member 34 by sliding in the front-back direction and restricts its movement toward the other directions.

The bottom surface plate 34*b* of the pushing member 34 is provided with a shaft 122*d* that protrudes from the back side thereof. One end side of the link plate 122 is turnably attached to the shaft 122*d*. The motor 120 that is fixed to the apparatus rotates the cam plate 121, thereby the link plate 122 swings around the rotation axis 122*b* on the other end. The pushing member 34 is moved in the front-back direction (the Y-axis direction) of the apparatus in accordance with the swinging motion of the link plate 122.

The banknote handling apparatus 1 is provided with a retracted position detection sensor 124 for detecting the presence of the pushing member 34 in the retracted position. On the back side of the back surface plate 34*a* of the pushing member 34, a shield plate 38 used by the retracted position detection sensor 124 is provided. Referring to FIG. 13A, when the pushing member 34 is in the retracted position, the light irradiated and received between the light irradiation unit and the light receiving unit of the retracted position detection sensor 124 is shielded by the shield plate 38. When the pushing member 34 is in the retracted position, the motor 120 starts rotating to move the pushing member 34 forward, and thus the space between the light irradiation unit and the light receiving unit of the retracted position detection sensor 124 becomes in a translucent state. While the motor 120 continues to rotate, the pushing member 34 moving forward reaches the pushing position. After that, the motor 120 continues to rotate without stopping, and the pushing member 34 starts moving backward from the pushing position toward the retracted position in accordance with the rotation of the motor 120. When the shield plate 38 on the back surface side of the retreating pushing member 34 has reached the location of the retracted position detection sensor 124, the retracted position detection sensor 124 detects that the pushing member 34 has returned to the retracted position because the translucent state becomes the shielded state again. The rotation of the motor 120 stops as the retracted position detection sensor 124 has detected returning of the pushing member 34 to the retracted position.

As described above, in the banknote handling apparatus 1, even when a low-cost motor 120 is used and it is not possible to detect the angle of rotation or the like of the motor, the pushing member 34 can be moved forth and back reciprocatingly by the link mechanism while rotating the rotation axis of the motor 120 in the same direction. Moreover, by detecting the retracted position of the pushing member 34 by using the retracted position detection sensor 124 with the shield plate 38 provided to the pushing member 34, the motor 120 can be stopped at an appropriate timing. In addition, by pulling the shaft 122*c* of the link plate 122 by using the not-shown spring member in a direction illustrated in FIGS. 13A and 13B by an arrow, the pushing member 34 can be securely returned to the retracted position after the motor 120 has stopped.

Figure 14A:
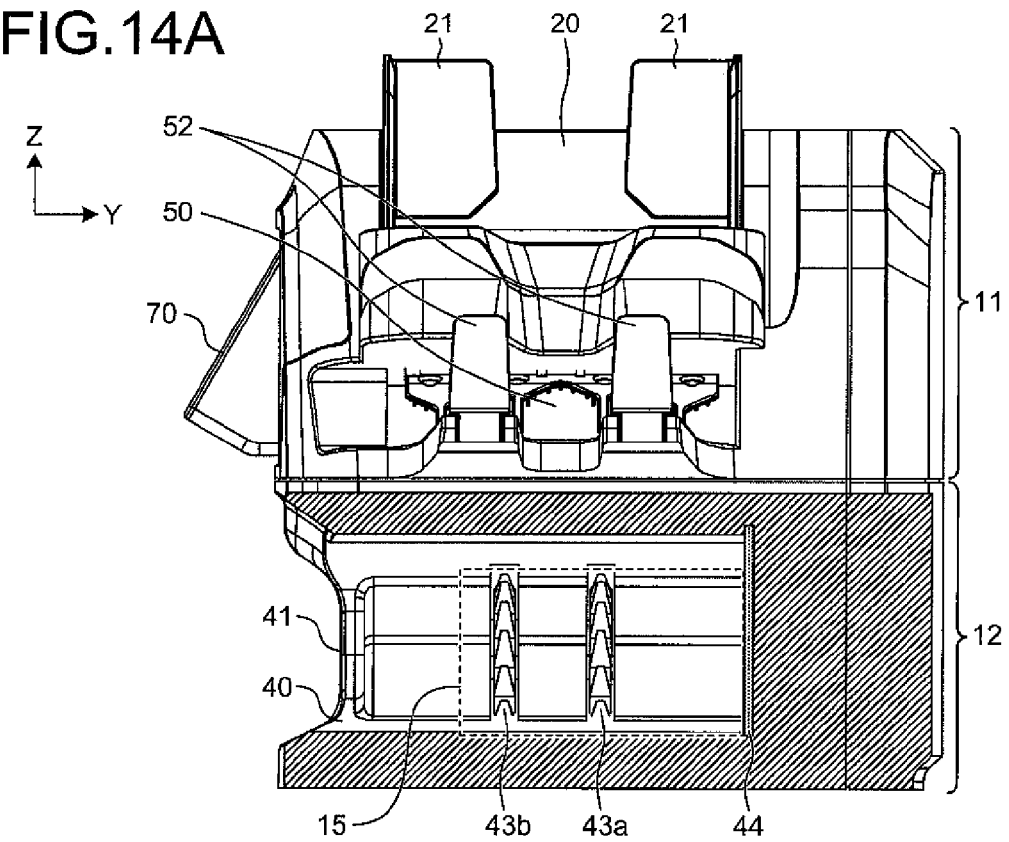
FIGS. 14A and 14B are schematic diagrams that illustrate a retracted position and a pushing position of the pushing member inside the banknote stacking unit.
Figure 14B:
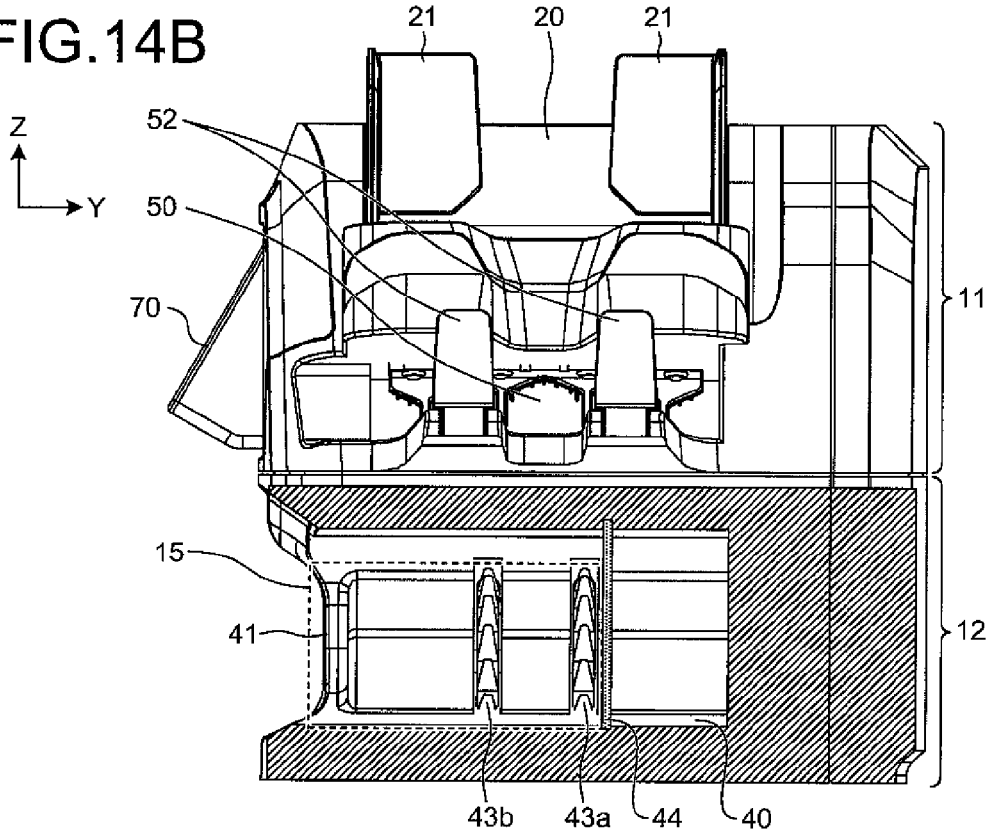

FIGS. 14A and 14B are schematic diagrams that illustrate the retracted position and the pushing position for the pushing members 34, 44 in the banknote stacking unit. FIGS. 14A and 14B are views that illustrate the banknote handling apparatus 1 viewed from the right. In this figure, while an external appearance is illustrated for the upper unit 11, a schematic cross-section is illustrated for the lower unit 12. FIG. 14A illustrates a state in which the pushing member 44 of the second banknote stacking unit 40 is in the retracted position, and FIG. 14B illustrates a state in which the pushing member 44 is in the pushing position. The pushing member 44 of the second banknote stacking unit 40 will be described as an example with reference to FIGS. 14A and 14B; however, the pushing member 34 of the first banknote stacking unit 30 operates in the similar manner.

Referring to FIG. 14A, two blade wheels 43*a*, 43*b* are provided in the second banknote stacking unit 40. After the banknote 15 has been fed from the receiving unit 20, transported inside the apparatus, and stacked in the stacking space, the banknote 15 is transported by the blade wheels 43*a*, 43*b* toward the outer right side of the apparatus and stacked in the inclined standing position as illustrated in the drawing with a dashed line.

After the banknotes placed on the receiving unit 20 are recognized by the recognition unit 100 and all the banknotes have been stacked in either of the first banknote stacking unit 30, the second banknote stacking unit 40, or the reject unit 50, the control unit performs control to automatically start the pushing operation by the pushing member 44. As illustrated in FIG. 14B, the pushing member 44 is moved up to the pushing position on the back surface side of the blade wheel 43*a*. The pushing position is located at a location closer to the blade wheel 43*a* provided on the back surface side. As a result, the shorter edge of the stacked banknote 15 on the front side is protruded frontward from the cut-out portion 41 on the side surface of the second banknote stacking unit 40, and the operator can easily take out the banknotes in the inclined standing position by holding them on the front end from the left and the right sides of the banknotes.

The pushing member 44 returns to the retracted position illustrated in FIG. 14A after reaching the pushing position and automatically stops there. Moreover, as illustrated in FIG. 14A, in the second banknote stacking unit 40, the bottom surface is continued to the front surface of the apparatus while the cut-out portion 41 is formed on the side surface. Accordingly, when the banknotes are pushed by the pushing member 44, a part of the short edge of the banknote 15 on the front side is exposed from the cut-out portion 41 while the entire long edge of the banknote 15 on the bottom surface side remains to be contacting the bottom surface. Because the cut-out portion 41 has a shape with which only a part of the pushed banknote 15 on the short edge is exposed, the pushed banknote 15 is supported by the right-side surface 45 of the opening illustrated in FIG. 1 on the lower of the exposed short edges, and in the back side thereof, the paper sheet surface is supported by the side wall that forms the stacking space. With this configuration, the banknotes 15 that have been pushed by the pushing members 34, 44 would not fall forward from the opening and the stable stacking state of the banknotes 15 can be maintained even after the banknotes 15 have been pushed.

[Sensor Brush]

Figure 15A:
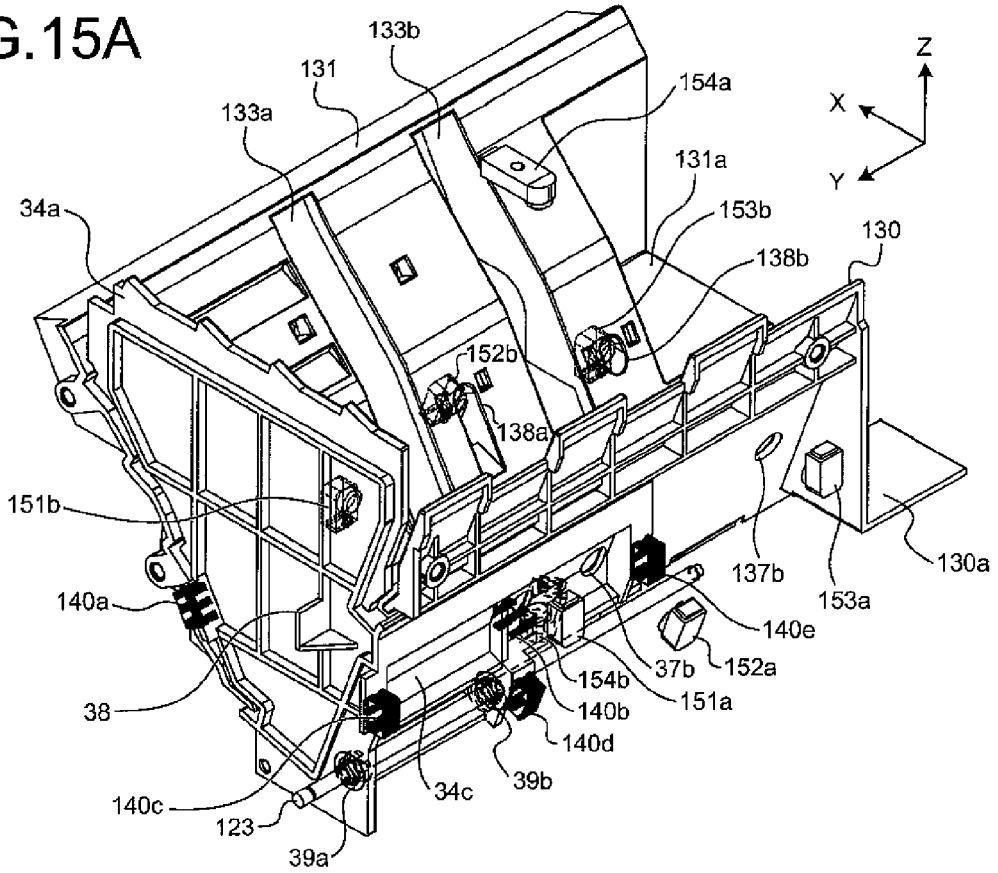
FIGS. 15A and 15B are perspective views that illustrate stacked banknote detection sensors that detect the presence or absence of banknotes stacked in the banknote stacking unit and sensor brushes that clean the sensors.
Figure 15B:
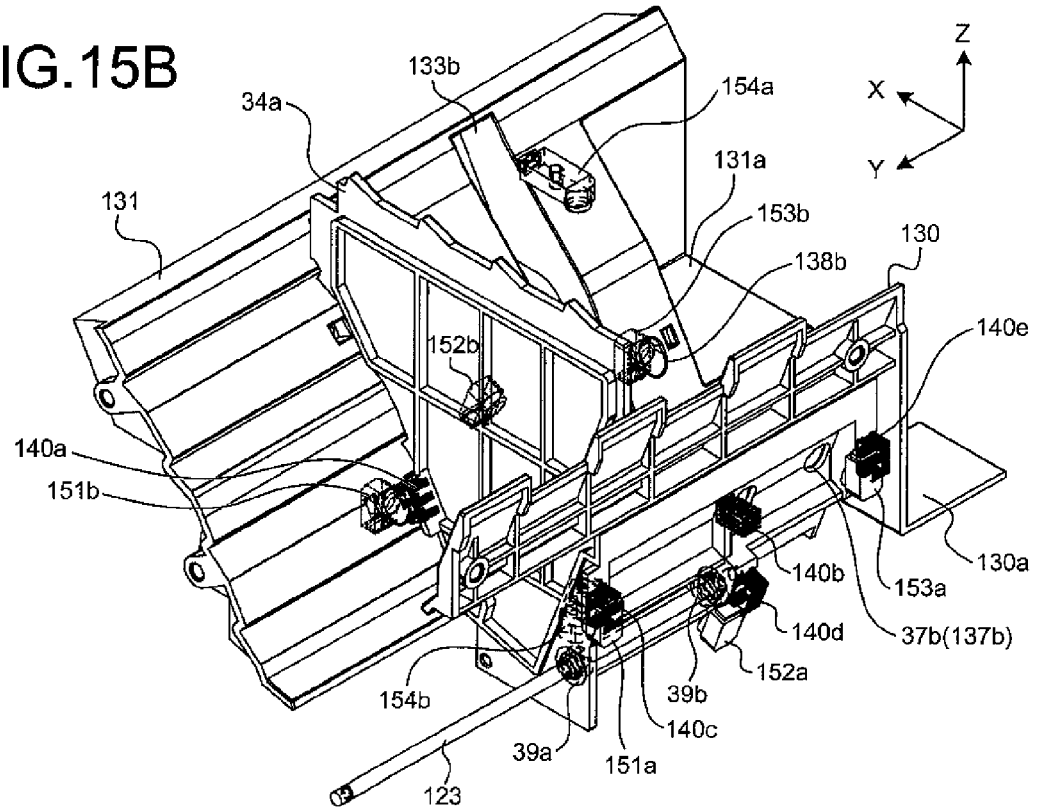

FIGS. 15A and 15B are perspective views that illustrate the pushing member 34 of the first banknote stacking unit 30 viewed from the back surface side. FIG. 15A illustrates a state in which the pushing member 34 is in the retracted position between the outer-side side wall member 130 forming the side wall on the outer side of the apparatus (on the negative side of the X-axis) and the inner-side side wall member 131 forming the side wall on the inner side of the apparatus (on the positive side of the X-axis) in the banknote stacking unit of the first banknote stacking unit 30. FIG. 15B illustrates a state in which the pushing member 34 is in the pushing position.

Two through holes 39*a*, 39*b* are provided to the rib on the back side of the pushing member 34, and the slide guide 123 is extended through the through holes 39*a*, 39*b*. The slide guide 123 guides the pushing member 34 for its motion by sliding in the front-back direction. Two grooves 133*a*, 133*b* formed on an inner-side side wall member 131 are grooves in which the two blade wheels 33 are provided, and although not illustrated in FIG. 15A, the rotating blade wheels 33 lead the banknote entering from the upper portion of the inner-side side wall member 131 toward the outer-side side wall member 130.

The first banknote stacking unit 30 includes four stacked banknote detection sensors 151 to 154 that detect the presence or absence of stacked banknotes in accordance with shielding of light passing through the inside of the stacking space. The stacked banknote detection sensor 151 is constituted by a unit 151*a* arranged on the back side of the side surface plate 34*c* of the pushing member 34 and a unit 151*b* arranged on the back side of the inner-side side wall member 131. The stacked banknote detection sensor 152 is constituted by a unit 152*a* arranged on the back side of the outer-side side wall member 130 and a unit 152*b* arranged on the back side of the inner-side side wall member 131. The stacked banknote detection sensor 153 is constituted by a unit 153*a* arranged on the back side of the outer-side side wall member 130 and a unit 153*b* arranged on the back side of the inner-side side wall member 131. The stacked banknote detection sensor 154 is constituted by a unit 154*a* arranged on the back side of the upper surface of the banknote stacking unit and a unit 154*b* arranged on the backside of the bottom surface of the banknote stacking unit.

The outer-side side wall member 130, the inner-side side wall member 131, the upper surface and the bottom surface, and the side surface plate 34*c* of the pushing member 34, which form the stacking space of the first banknote stacking unit 30, are provided with through holes provided at locations corresponding to the stacked banknote detection sensors 151 to 154. For example, as illustrated in FIG. 15A, the through hole 137*b* is provided to the outer-side side wall member 130 corresponding to the unit 153*a* constituting the stacked banknote detection sensor 153, and a through hole 138*b* is provided to the inner-side side wall member 131 in correspondence with the unit 153*b*.

Moreover, the pushing member 34 is provided with the sensor brushes 140*a* to 140*e* that clean the light irradiation surfaces and the light receiving surfaces of some of the units of the stacked banknote detection sensors 151 to 154. Specifically, as illustrated in FIG. 15A, the sensor brush 140*a* is provided on the side of the inner-side side wall member 131 on the back side of the back surface plate 34*a* of the pushing member 34, and as illustrated in FIG. 15B, the sensor brush 140*a* cleans the unit 151*b* of the stacked banknote detection sensor 151 when the pushing member 34 is moved to the pushing position to push the banknote. In addition, the sensor brush 140*a* cleans the unit 151*b* of the stacked banknote detection sensor 151 again when the pushing member 34 returns from the pushing position to the retracted position.

Figure 16A:
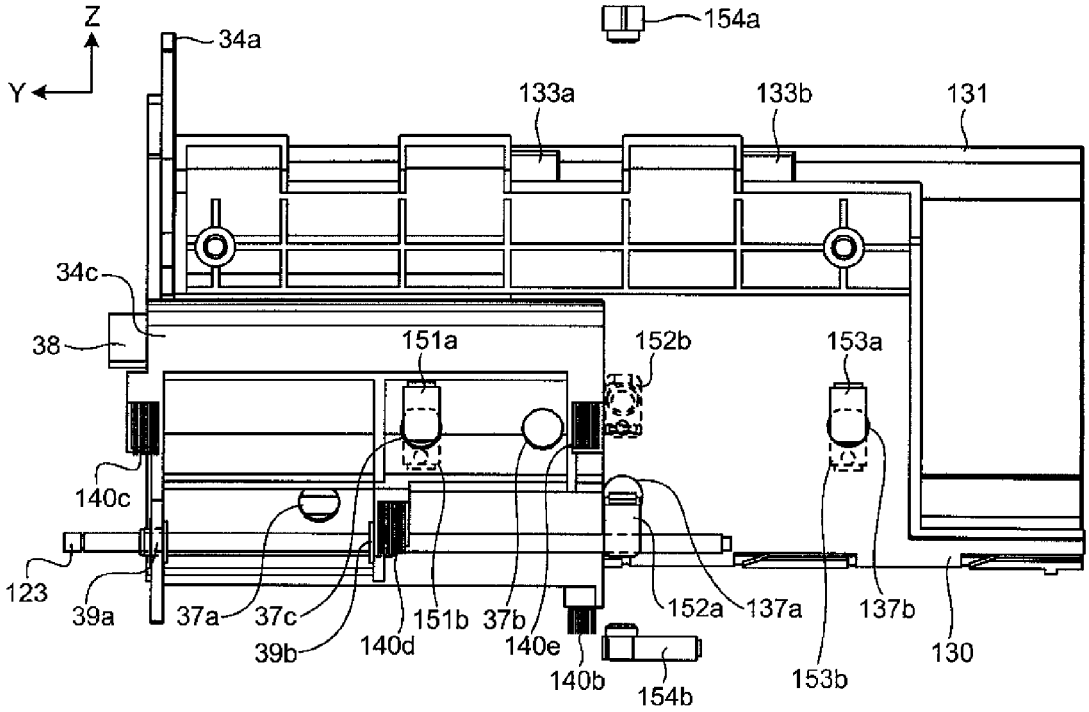
FIGS. 16A and 16B are views that illustrate a method of cleaning performed by the sensor brushes.
Figure 16B:
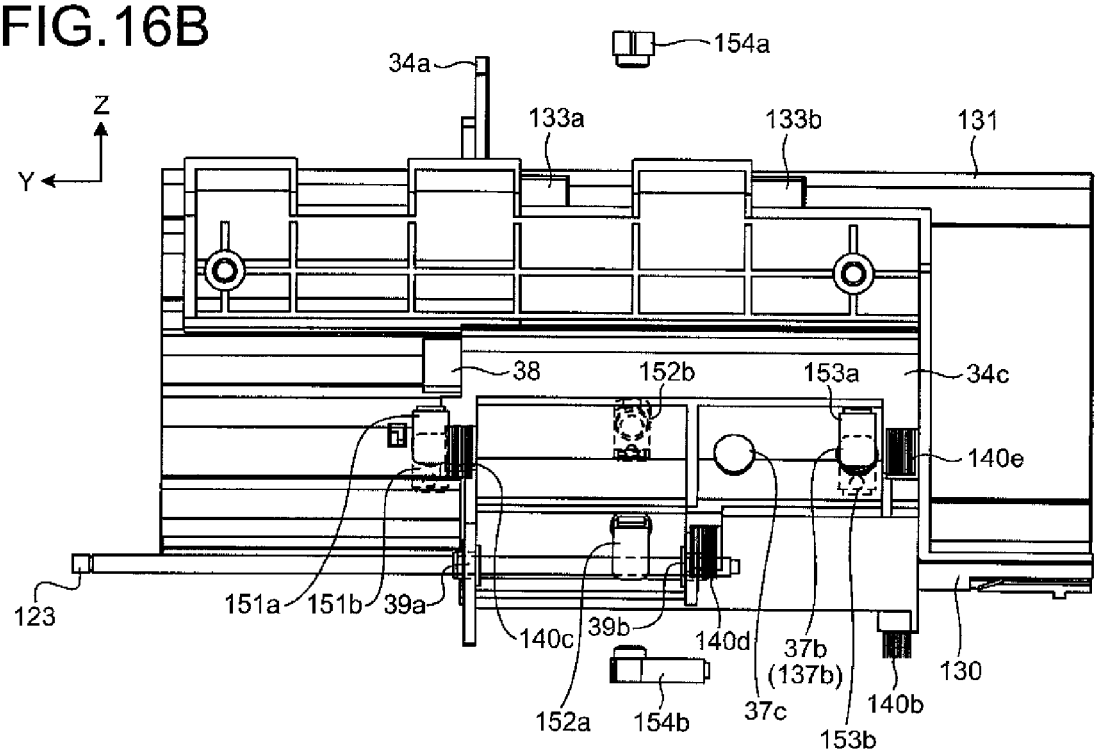

FIGS. 16A and 16B are views that illustrate cleaning of the sensors performed by the sensor brushes 140*b* to 140*e* provided to the pushing member 34. The sensor brush 140*b* is provided on the back side of the bottom surface plate 34*b* of the pushing member 34. The sensor brush 140*b* cleans the unit 154*b* of the stacked banknote detection sensor 154 while the pushing member 34 moves reciprocatingly between the retracted position illustrated in FIG. 16A and the pushing position illustrated in FIG. 16B.

The sensor brushes 140*c* to 140*e* are provided on the back side of the side surface plate 34*c* of the pushing member 34. The sensor brush 140*c* cleans the unit 151*a* of the stacked banknote detection sensor 151, the sensor brush 140*d* cleans the unit 152*a* of the stacked banknote detection sensor 152, and the sensor brush 140*e* cleans the unit 153*a* of the stacked banknote detection sensor 153 while the pushing member 34 moves reciprocatingly between the retracted position illustrated in FIG. 16A and the pushing positions illustrated in FIG. 16B. These sensor brushes 140*c* to 140*e* clean the units 151*a* to 153*a* of the stacked banknote detection sensors 151 to 153, respectively, while the pushing member 34 moves forward and while the pushing member 34 moves backward, between the retracted position illustrated in FIG. 16A and the pushing positions illustrated in FIG. 16B.

No sensor brush is provided for cleaning the unit 152*b* of the stacked banknote detection sensor 152, the unit 153*b* of the stacked banknote detection sensor 153, and the unit 154*a* of the stacked banknote detection sensor 154. Because the unit 153*b* is located at a location close to the opening of the first banknote stacking unit 30, the unit 153*b* can be cleaned by inserting the hand through the opening and via the through hole 138*b* of the inner-side side wall member 131. Because the unit 154*a* is installed so that the light irradiation and receiving surfaces face down, dusts and contaminants may not easily adhere to the unit 154*a*, and thus the necessary times of cleaning is less than that for the other units. The unit 152*b* is provided between the two blade wheels 33, and it is more difficult to perform operations of cleaning the unit 152*b* than for the other units. Accordingly, the through hole 138*a* that laterally penetrates through the inner-side side wall member 131 in lateral direction (X-axis direction) in correspondence with the unit 152*b* is provided with a shape with which it penetrates through the inner-side side wall member 131 in the vertical direction (Z-axis direction) so that dusts or contaminants may not easily accumulate.

In the inner-side side wall member 131, the front end of the side wall portion forming the stacking space is located at a location closer to the back surface side than the groove 60 provided on the front side of the apparatus. The substantially triangular plane parallel to the XZ plane is formed by the front end of the inner-side side wall member 131 (see FIG. 10). The right-side surface 32 of the opening illustrated in FIG. 1 is formed in a portion 131*a* on the front surface side of the front end plane of the inner-side side wall member 131.

Figure 17:
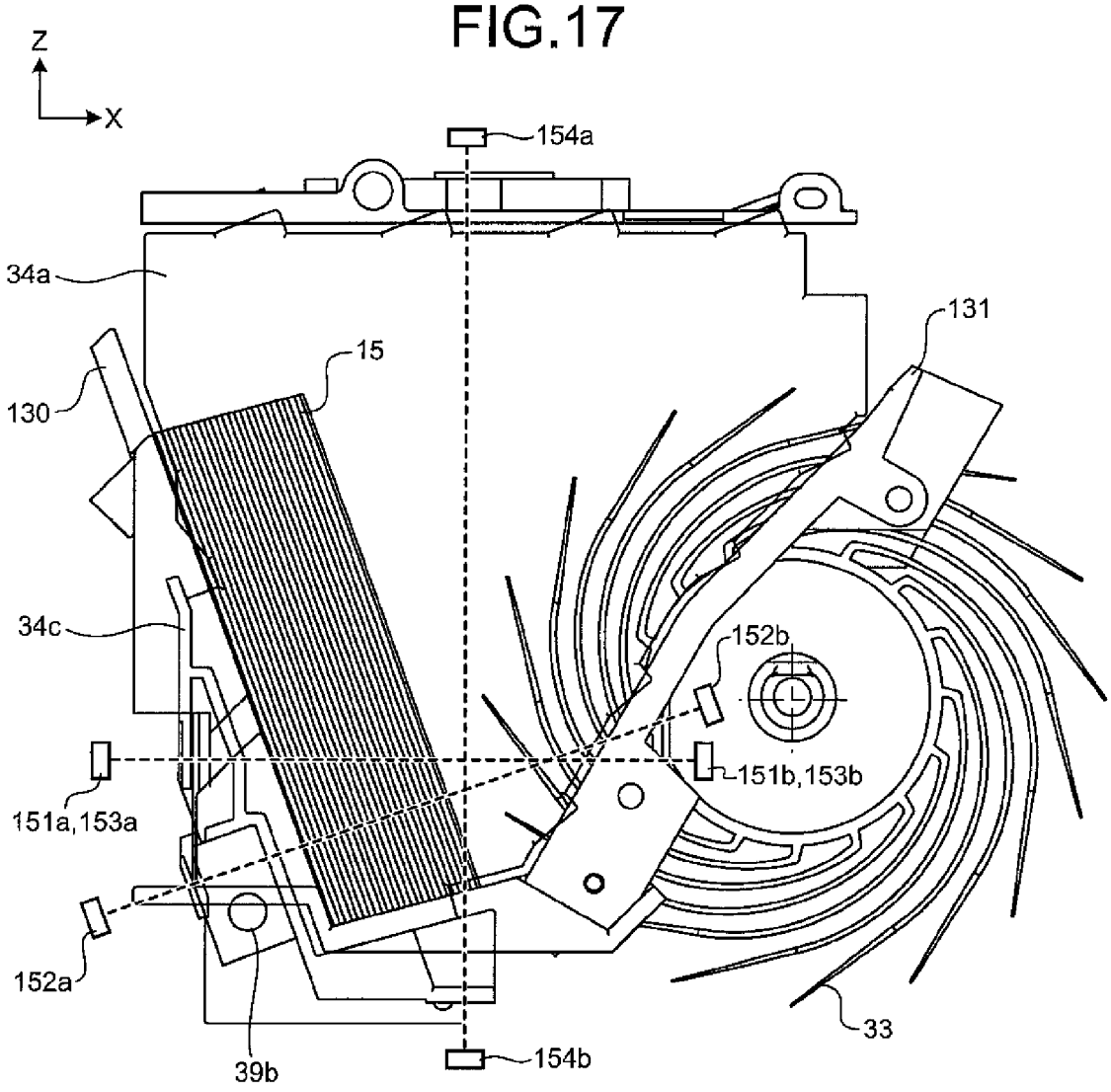
FIG. 17 is a view that illustrates positions of arrangement of the stacked banknote detection sensors in relation to the banknote stacking unit.

FIG. 17 is a schematic diagram that illustrates the angle of arrangement of the stacked banknote detection sensors 151 to 154 illustrated in FIGS. 15 and 16. Referring to FIG. 17, in the first banknote stacking unit 30, the banknote 15 is stacked in the inclined standing position so that the long edge of the banknote 15 contacts the bottom surface and the surface of the banknote comes along the outer-side side wall member 130.

The stacked banknote detection sensor 154 is provided so that the units 154*a*, 154*b* face each other in the vertical direction at locations corresponding to the through holes on the upper surface and the bottom surface that form the stacking space. In the two stacked banknote detection sensors 151 and 153, which are arranged at the same height but at locations set off from each other in the front-back direction of the apparatus, the units 151*a* and 151*b* and the units 153*a* and 153*b* are provided so as to face each other in the horizontal direction. Moreover, the units 152*a*, 152*b*, which constitute the stacked banknote detection sensor 152 arranged between the stacked banknote detection sensors 151 and 153, are provided so as to face each other in the direction perpendicular to the wall surface of the outer-side side wall member 130.

[Installation Location of the Blade Wheel]

Figure 18:
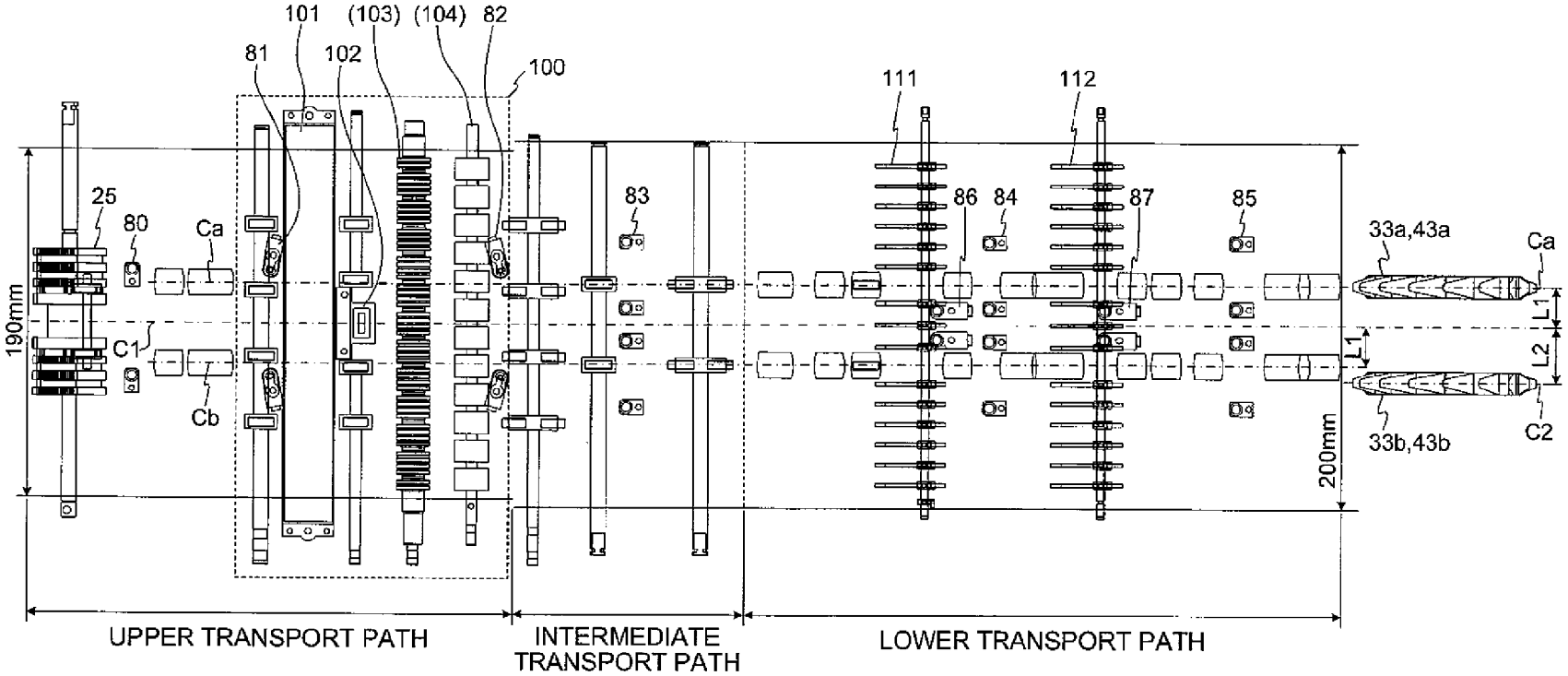
FIG. 18 is a development view that illustrates a structure of a banknote transport path arranged inside the banknote handling apparatus.

FIG. 18 is a schematic diagram that is a plan view illustrating a development view of the transport path in the banknote handling apparatus 1 and illustrates a relationship of arrangements of the rollers constituting the transport path and the blade wheels 33, 43. As illustrated in FIG. 6, the transport path in the banknote handling apparatus 1 includes the upper transport path in which the banknote fed from the receiving unit 20 into the apparatus is transported leftward, the intermediate transport path in which the banknote is transported downward after the banknote has passed through the recognition unit 100 and the transport direction is changed, and the lower transport path in which the banknote is, after the transport direction is changed again, transported rightward toward either of the first banknote stacking unit 30, the second banknote stacking unit 40, and the reject unit 50 on the basis of the recognition results by the recognition unit 100. In FIG. 18, the upper transport path, the intermediate transport path, and the lower transport path are illustrated in this order from the left, and the blade wheel 33 of the first banknote stacking unit 30 and the blade wheel 43 of the second banknote stacking unit 40 are illustrated in the right side portion of the drawing.

When the upper unit 11 is opened upward as illustrated in FIG. 8, while the portion of the transport path included on the side of the upper unit 11 has a width of 190 mm as illustrated in FIG. 18, the portion of the transport path remaining on the side of the lower unit 12 has a width of 200 mm. When the upper unit 11 is opened upward, the upper transport path is included in the upper unit 11. The intermediate transport path that transports the banknote in the vertical direction is divided into the left side and the right side, and when the upper unit 11 is opened, the right-side portion is included in the upper unit 11 and the left-side portion remains on the side of the lower unit 12. Moreover, the lower transport path is also divided into the upper side portion and the lower side portion, and when the upper unit 11 is opened, the upper-side portion is included in the upper unit 11 while the lower-side portion remains on the side of the lower unit 12.

In the range illustrated in FIG. 18 as the intermediate transport path, the left-side portion of the intermediate transport path remaining on the side of the lower unit when the upper unit 11 is opened is illustrated. In contrast, in the range illustrated as the lower transport path, the lower portion of the lower transport path that remains on the side of the lower unit when the upper unit 11 is opened is illustrated. However, because the roller in the right-side portion of the intermediate transport path and the roller in the left-side portion thereof are arranged so as to face each other, and also the roller in the upper-side portion of the lower transport path and the roller on the lower-side portion thereof are arranged so as to face each other, the arrangement positions of all the rollers that form the respective transport paths are as illustrated in FIG. 18.

Referring to FIG. 18, the rollers in the upper transport path arranged in symmetry with respect to a center line C1, which is the center line of the transport path having the width of 190 mm in the width direction. Moreover, also for the intermediate transport path and the lower transport path, the rollers are symmetrically arranged with respect to the center line C1 of the transport path having the width of 200 mm in the width direction. Because the center line C1 is a straight line in common to the upper transport path, the intermediate transport path, and the lower transport path, all the rollers for transporting the banknote illustrated in FIG. 18 are arranged at the location at which the axial center lines of the respective rollers are overlapped on a straight line Ca or Cb symmetrical with respect to the center line C1.

Two blade wheels 33*a*, 33*b* of the first banknote stacking unit 30 are arranged so that the center line, which is the center in the direction of the rotation axis, of the blade wheel 33*a* on the back surface side is on the straight line Ca on which the rollers for transporting the banknote in the transport path are arranged. On the other hand, the blade wheel 33*b* on the side of the opening is arranged so that the center line, which is the center in the direction of the rotation axis, is located at a location more distant from the center line C1 of the transport path than the straight line Cb on which the rollers for transporting the banknote in the transport path is arranged, i.e., the location is close to the opening of the banknote stacking unit. Similarly, with respect to the two blade wheel 43*a*, 43*b* of the second banknote stacking unit 40, the blade wheel 43*a* on the back surface side is arranged so that the center line in the direction of the rotation axis comes on the straight line Ca while the blade wheel 43*b* is arranged so that the center line in the direction of the rotation axis is located at a location closer to the opening than the straight line Cb. Specifically, the blade wheels 33*b*, 43*b* located on the opening side of the banknote stacking unit are arranged so that the center line in the direction of the rotation axis is located on a straight line C2 distant from the center line C1 of the transport path by a distance L2 (L1<L2).

Figure 19:
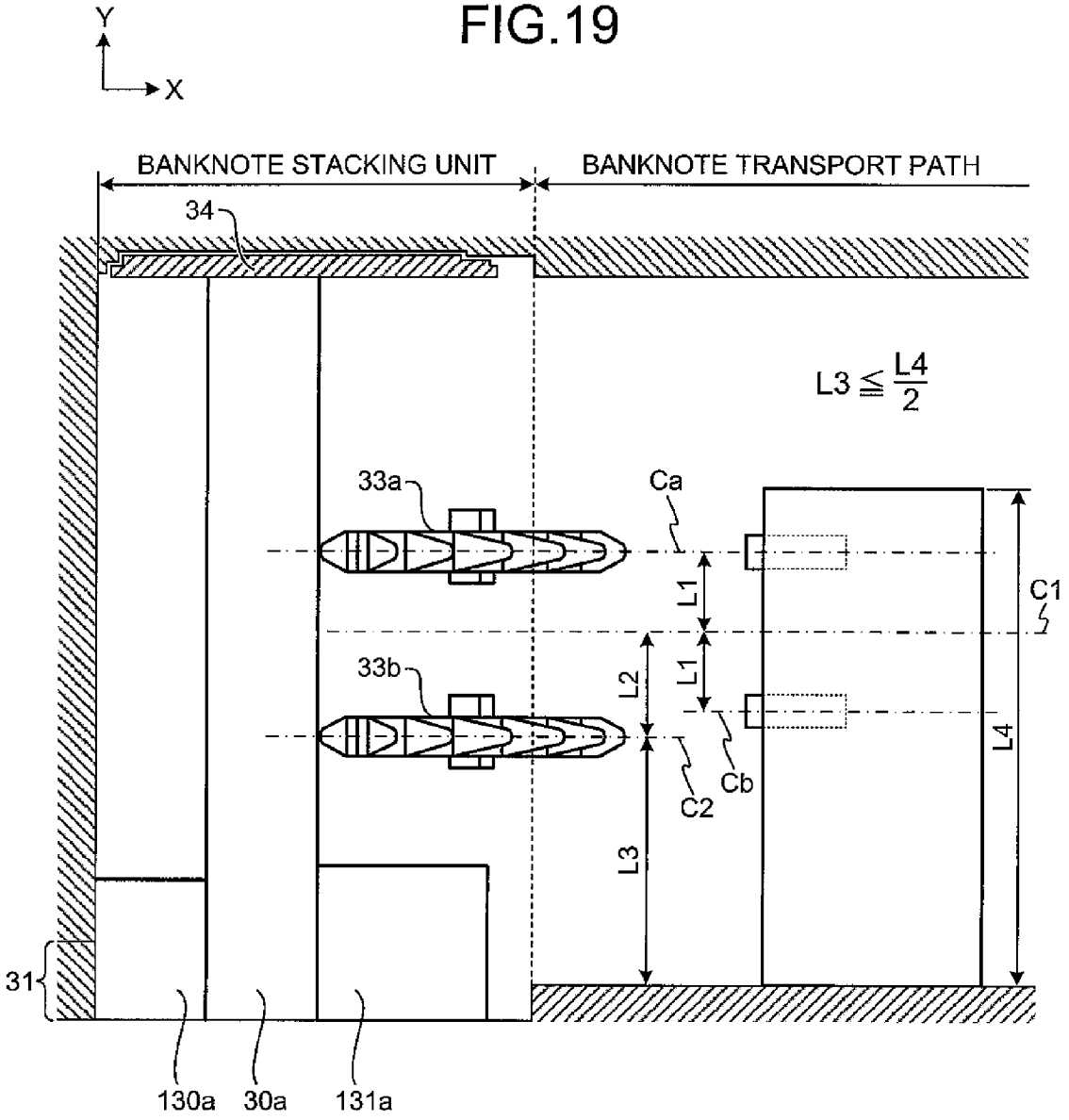
FIG. 19 is a schematic diagram that illustrates positions of arrangement of blade wheels in the inside of the banknote stacking unit.

FIG. 19 is a schematic diagram that illustrates the location of the blade wheel 33*b* on the opening side with respect to the center line C1 of the transport path. FIG. 19 schematically illustrates the positional relationship between the transport paths and the first banknote stacking unit 30 when viewed from above. For the blade wheel 43*b* on the opening side of the second banknote stacking unit 40, the arrangement thereof is the same when reversing the arrangement illustrated in FIG. 19 in the left-right direction, and accordingly, the description of the blade wheel 43*b* of the second banknote stacking unit 40 will be omitted and only the blade wheel 33*b* of the first banknote stacking unit 30 will be explained below.

The distance L2 from the center line C1 of the transport path to the center line C2, which is the center of the rotation axis direction, of the blade wheel 33*a* on the opening side is set on the basis of the smallest banknote of which the length of the long edge is the shortest. Specifically, if the length of the smallest banknote on the long edge is L4 as illustrated in FIG. 19, the distance L2 is set so that a distance L3 from the side wall on the opening side becomes smaller than a half of L4 in a state in which the short edge of the smallest banknote is in contact with the side wall on the opening side of the transport path. In other words, the location of the blade wheel 33*b* on the opening side of the banknote stacking unit is set so that, even when the smallest banknote has been transported in a state in which the smallest banknote is aligned to a location closest to the opening side of the banknote stacking unit, the blade wheel 33*b* is located at a location closer to the opening side than the center, which is the center in the long edge direction, of the smallest banknote.

The banknotes that have been transported through the transport path and discharged into the banknote stacking unit are received by the blade wheels 33*a*, 33*b*. If the banknote is received by the blade wheel 33*b* at a location closer to the back surface side than the center line of the banknote in the direction of the long edge thereof, then the banknote may be inclined toward the opening side and go out of the opening of the banknote stacking unit toward the outside of the apparatus. In order to prevent inclination toward the opening side when the banknote is received by the blade wheels 33*a*, 33*b*, the blade wheel 33*b* is arranged so as to receive most of the banknotes of the processing target at a location closer to the opening than the center of these banknotes in the long edge direction.

To securely receive the banknotes by the blade wheels 33*a*, 33*b*, the two blade wheels 33*a*, 33*b* may be installed at locations distant from the center line C1 of the transport path symmetrically with respect to the center line C1; however, if the blade wheel 33*a* on the back surface side is installed at a location distant from the center line C1, then the amount of movement of the pushing member 34 toward the front surface side may be limited. Considering this, in the banknote handling apparatus 1, the blade wheel 33*b* on the opening side is installed at a location distant from the center line C1 while the blade wheel 33*a* on the back surface side is installed at a location close to the center line C1. As described above, in the banknote handling apparatus 1, because the two blade wheels 33*a*, 33*b* are arranged asymmetrically with respect to the center line C1 of the transport path, a sufficient amount of pushing by the pushing member 34 is secured while preventing going out of the banknote from the first banknote stacking unit 30 at the same time.

Moreover, with respect to FIG. 19, the left-side surface 35 of the opening illustrated in FIG. 1 is formed on the portion 130*a* provided at a location closer to the front surface side than the front end of the outer-side side wall member 130 of the first banknote stacking unit 30, and the right-side surface 32 of the opening illustrated in FIG. 1 is formed on the portion 131*a* provided at a location closer to the front surface side than the front end of the inner-side side wall member 131.

[Display Content Displayed on the Operation Display Unit]

One of the characteristics of the banknote handling apparatus 1 is the use of the large-size operation display unit 70 whereby information about the banknote processing can be easily recognized. In FIGS. 20 to 22, the characters are illustrated as white characters or black characters; however, in an actual operation display unit 70, different information is displayed by characters in different colors.

Figure 20A:
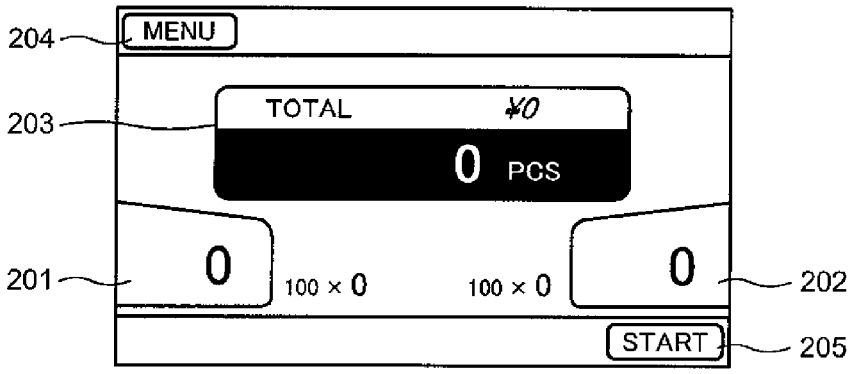
FIGS. 20A, 20B, 20C and 20D are views that illustrate an example of a screen illustrated on the operation display unit during handling of the banknotes.

FIGS. 20A to 20D are views that illustrate an example of a screen displayed on the operation display unit 70 during processing of the banknotes. To begin with, the basic configuration of the screen and the content to be displayed thereon will be described with reference to FIG. 20A. The operation display unit 70 is constituted by a touch panel type LCD device displays various buttons 204, 205 in band-like regions in the upper and the lower portions on the screen as illustrated in FIG. 20A because the operation display unit 70 is also used as an operation unit for inputting a variety of information.

In an information display region excluding the upper and the lower band-line regions in which operation buttons 204, 205 are displayed, the first display region 201 is provided in a lower left portion and a second display region 202 is provided in a lower right portion. The first display region 201 is a region for displaying information about the banknotes stacked in the first banknote stacking unit 30, and the second display region 202 is a region for displaying information about the banknotes stacked in the second banknote stacking unit 40. A total display region 203 for displaying information about the total number of the banknotes stacked in the first banknote stacking unit 30 and the second banknote stacking unit 40 is arranged at a location between the first display region 201 and the second display region 202 and above the first display region 201 and the second display region 202.

For example, the number of the banknotes stacked in the first banknote stacking unit 30 is displayed in the display region 201, and the number of the banknotes stacked in the second banknote stacking unit 40 is displayed in the second display region 202. Moreover, in the lower portion of the total display region 203, the total number of the banknotes stacked in the first banknote stacking unit 30 and the banknotes stacked in the second banknote stacking unit 40 is displayed, and in the upper portion of the total display region 203, the total amount of the banknotes stacked in the first banknote stacking unit 30 and the banknotes stacked in the second banknote stacking unit 40 is displayed.

Batch information is displayed in a portion to the right of the first display region 201. The batch information includes the number of banknotes for one batch for a batch process performed by the first banknote stacking unit 30 and the number of successfully-processed batches. Similarly, another batch information is displayed in a portion to the left of the second display region 202. This batch information indicates the number of banknotes for one batch for a batch process performed by the second banknote stacking unit 40 and the number of successfully-processed batches. Specifically, in the batch information "100×0" illustrated in FIG. 20A, the term "100" indicates the number of banknotes for one batch and the term "0" indicates the number of successfully-processed batches. Details will be explained later.

In FIG. 20A, the boundary between the inside and the outside of the first display region 201, the boundary between the inside and the outside of the second display region 202, and the boundary between the outside and the inside of the region for displaying the total amount in the upper portion of the total display region 203 are illustrated by black solid lines; however, on an actual screen, these boundaries are displayed by difference in colors. Specifically, for example, characters displayed in the first display region 201 and the second display region 202 are displayed as blue characters on a white background. Moreover, in the portion above the total display region 203, characters are displayed as blue characters on a gray background, while in the portion below the total display region 203, the characters are displayed as white characters on a blue background. Portions outside the first display region 201, the second display region 202, and the total display region 203 are displayed in light gray. As a result, a boundary appears due to the difference in the colors between the inside and the outside of the region of the first display region 201. Similarly, a boundary also appears due to the difference in the colors between the inside and the outside of the respective regions of the second display region 202 and the total display region 203.

Moreover, as illustrated in FIG. 20A, the characters in the first display region 201 and the second display region 202 are displayed the largest among the characters displayed on the screen. Accordingly, the operator can easily recognize the information about the banknotes stacked in the first banknote stacking unit 30 and the banknotes stacked in the second banknote stacking unit 40.

An exemplary case will be described below, where a plurality of 1,000-yen banknotes are placed on the receiving unit 20 and a batch process is performed in which every time 100 sheets of fit 1,000-yen banknotes are stacked in the first banknote stacking unit 30, the banknotes are taken out of the apparatus, while for the second banknote stacking unit 40, a batch process is performed in which unfit 1,000-yen banknotes are stacked therein and every time the unfit 1,000-yen banknotes are stacked, they are taken out of the apparatus. First, by operating the operation display unit 70, the operator sets the number-of-banknotes for one batch and a number-of-times of completed-batch-processes for notification. The number-of-times of completed-batch-processes for notification is a setting for notifying that the number of times of batch processes has reached a predetermined number of times.

Various settings of combinations of the banknote-kind of the banknotes to be the objects of the batch process, the number-of-banknotes for one batch, and the number-of-times of completed-batch-processes for notification can be stored in the memory unit as patterns, and in performing the same process the next time, the operator is only required to call the stored setting pattern. The banknote-kind of the banknotes to be the objects of the batch process, the number-of-banknotes for one batch, and the number-of-times of completed-batch-processes for notification can be set the same or differently for the first banknote stacking unit 30 and the second banknote stacking unit 40. For example, the setting can be set so that for the first banknote stacking unit 30, the notification is performed every time five batch processes of 50 sheets of 10,000-yen banknotes have been successfully processed, while for the second banknote stacking unit 40, the notification is performed every time ten batch processes of 100 sheets of 1,000-yen banknotes have been successfully processed.

By operating the operation display unit 70, for the first banknote stacking unit 30, fit 1,000-yen banknotes is set as the banknote-kind of the banknotes to be stacked, 100 (sheets) is set as the number-of-banknotes for one batch, and 5 (times) is set as the number-of-times of completed-batch-processes for notification by the operator. For the second banknote stacking unit 40, unfit 1,000-yen banknotes is set as the banknote-kind of the banknotes to be stacked, 100 (sheets) is set as the number-of-banknotes for one batch, and 5 (times) is set as the number-of-times of completed-batch-processes for notification. When the operations for these settings is completed, on the screen of the operation display unit 70, the number and the amount of the banknotes displayed on the first display region 201, the second display region 202, and the total display region 203 are reset to "0" (zero) and the screen shifts to a screen for a standby state as illustrated in FIG. 20A. Moreover, in the right portion of the first display region 201, the batch information "100×0" is displayed, which indicates that the value "100" has been set as the number-of-banknotes for one batch for the first banknote stacking unit 30 and that the current number of successfully-processed batches for the first banknote stacking unit 30 is "0". Similarly, in the left portion of the second display region 202, the batch information "100×0" is displayed, which indicates that the value "100" has been set as the number-of-banknotes for one batch for the second banknote stacking unit 40 and that the current number of successfully-processed batches for the second banknote stacking unit 40 is "0".

Figure 20B:
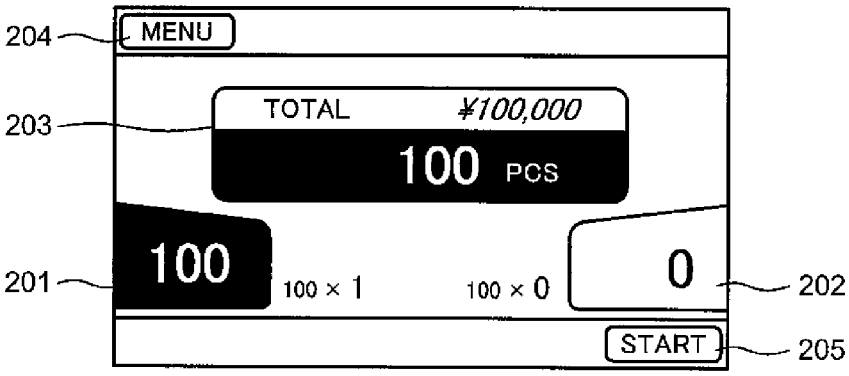

When the batch process is started after placing a large number of 1,000-yen banknotes on the receiving unit 20 and the number of fit 1,000-yen banknotes stacked in the first banknote stacking unit 30 has reached 100, which is equal to the set number-of-banknotes for one batch, the transport of the banknotes in the banknote handling apparatus 1 is stopped. At this timing, the display illustrated in FIG. 20B is displayed on the screen of the operation display unit 70. Specifically, in the total display region 203, the total amount and the total number of the banknotes stacked in the first banknote stacking unit 30 and the banknotes stacked in the second banknote stacking unit 40 are displayed.

Moreover, in the first display region 201 on the screen, the background inside the region is displayed in blue and the digits "100" indicating the number of banknotes stacked in the first banknote stacking unit 30 are displayed in white. Specifically, if the number of stacked banknotes has reached the number-of-banknotes for one batch, the mode of display for displaying the number of the banknotes is changed. Moreover, upon successful completion of the batch process, the batch information displayed in the right portion of the first display region 201 is updated to display "100×1". For the timing of updating the batch information regarding that the batch process has been successfully done, either a timing at which the number of stacked banknotes becomes equivalent to the number-of-banknotes for one batch or a timing at which it is detected that the stacked banknotes equivalent to the number-of-banknotes for one batch are taken out may be set.

In the inside of the first banknote stacking unit 30 and the second banknote stacking unit 40 of the banknote handling apparatus 1, a light emitting device such as an LED, which emits light in correspondence with the display in the first display region 201 and the second display region 202, is provided. When the batch process is performed and the state of progress of the process has become a state for waiting for the 100 sheets of banknotes stacked in the first banknote stacking unit 30 to be taken out, in order to prompt the operator to take out the banknotes and to notify the operator that the banknote stacking unit that is the object of the take-out operation is the first banknote stacking unit 30, the light emitting device in the first banknote stacking unit 30 flashes.

In this process, the background of the first display region 201 of the operation display unit 70 is displayed in blue and the light emitting device in the first banknote stacking unit 30 is flashed in blue, the same color. By verifying the display on the operation display unit 70 and the flashing of the light emitting device in the first banknote stacking unit 30, the operator can recognize that the number of the banknotes stacked in the first banknote stacking unit 30 has reached the number-of-banknotes for one batch. When the operator takes out the 100 sheets of banknotes stacked in the first banknote stacking unit 30, the banknote handling apparatus 1 recognizes, based on the detection result by the stacked banknote detection sensors 151 to 154, that the banknotes in the first banknote stacking unit 30 have been taken out, and the handling of the banknotes is automatically resumed.

Every time the number of the banknotes stacked in the first banknote stacking unit 30 or the second banknote stacking unit 40 reaches 100 sheets, the number of successfully-processed batches included in the corresponding batch information is incremented by 1 on the screen of the operation display unit 70.

Figure 20C:
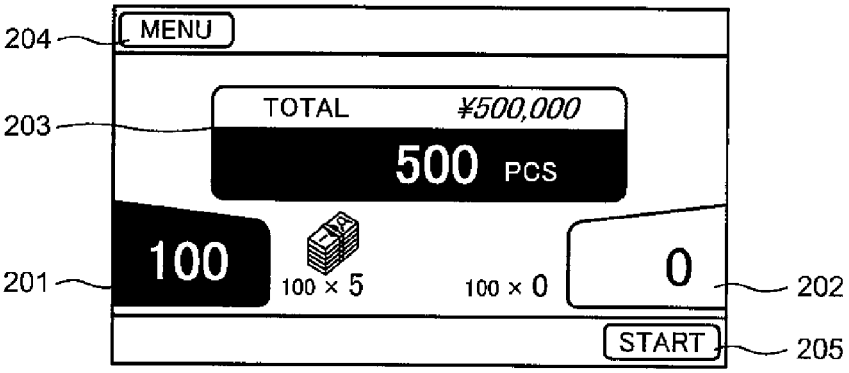

For example, when the number of successfully-processed batches for the first banknote stacking unit 30 has reached 5 times set as the number-of-times of completed-batch-processes for notification, a display illustrated in FIG. 20C is displayed on the screen. The batch information for the first banknote stacking unit 30 is updated to "100×5", and an icon indicating that the number-of-times of completed-batch-processes for notification has reached is displayed above the batch information. Moreover, the light emitting device in the first banknote stacking unit 30 flashes; however, when the number of successfully-processed batches reaches the number-of-times of completed-batch-processes for notification, the light emitting device flashes in a manner different from that in the case of a normal success of a batch process. Specifically, for example, the number of flashing per 1 second is set differently or the color of the light emitted by the light emitting device for the flashing is set differently between the timing for the normal success and the timing for the number-of-times of completed-batch-processes for notification.

In the first display region 201 on the screen, the number of banknotes stacked in the first banknote stacking unit 30 is displayed, and in the total display region 203, the total amount and the total number of all the banknotes that have been stacked in the first banknote stacking unit 30 and the second banknote stacking unit 40 after starting the batch process are displayed. In the example illustrated in FIG. 20C, because no banknote are stacked in the second banknote stacking unit 40, the total amount and the total number of the banknotes for 5 batches that have been successfully completed for the first banknote stacking unit 30 are displayed.

Figure 20D:
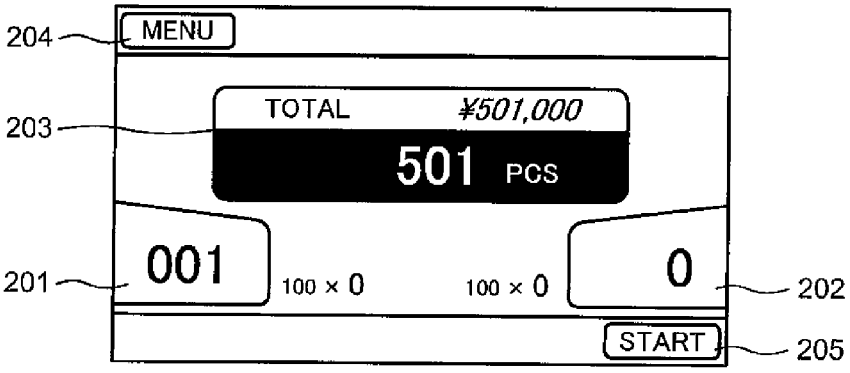

If the number of successfully-processed batches has reached the number-of-times of completed-batch-processes for notification, the number of successfully-processed batches in the batch information displayed in the right portion of the first display region 201 is reset to "0" and "100×0" is displayed as illustrated in FIG. 20D. The process, in which the number of times of the successfully-processed batches is counted and every time the number of times reaches 5, this state is notified, is repeated. In the total display region 203, even after the number of successfully-processed batches has been reset, the information including information about the banknotes processed before the reset is displayed.

If a timing of taking out of the banknotes has been set as the timing for updating the batch information, the number of successfully-processed batches is incremented at the timing at which the banknotes are taken out after the number of stacked banknotes has reached 100. If the number of successfully-processed batches has reached the number-of-times of completed-batch-processes for notification, the number of successfully-processed batches is incremented to display "100×5" at the timing at which the banknotes are taken out. When the banknotes have been taken out, the taking out of the banknotes is detected and the processing of banknotes is automatically started, while on the screen, the display of the batch information "100×5" is maintained for a predetermined time (e.g., 5 seconds), and then the number of successfully-processed batches is reset and "100×0" is displayed.

As described above, in the banknote handling apparatus 1, when the number of batch processes reaches the previously set number of times, it is notified to the operator. For example, in performing an operation for packaging bundles of 100 banknotes by five bundles per package, the operator is only required to continue the operation for taking out 100 sheets of banknotes stacked in the banknote stacking unit. The operator is not required to count the number of successfully-processed batches because if the number of bundles has reached 5, it is notified to the operator. The operator is only required to pack five bundles when the notification is performed. Accordingly, the operator can easily go on with the operations.

Next, the display on the screen of the operation display unit 70 displayed if any rejected banknote is detected in the banknote handling apparatus 1 will be described below. Referring to FIG. 20A, when processing of banknotes is started, the screen displayed on the operation display unit 70 includes no region for displaying information about the reject unit 50. However, if any rejected banknote is detected while the processing of banknotes is performed, a partial region for displaying information about the rejected banknote is set on the screen.

Figure 21A:
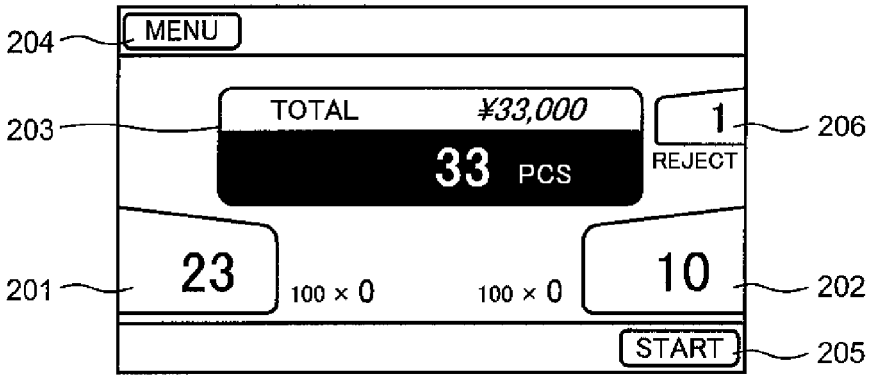
FIGS. 21A, 21B and 21C are views that illustrate an example of a screen displayed on the operation display unit if any banknote has been rejected during processing of the banknotes.
Figure 21B:
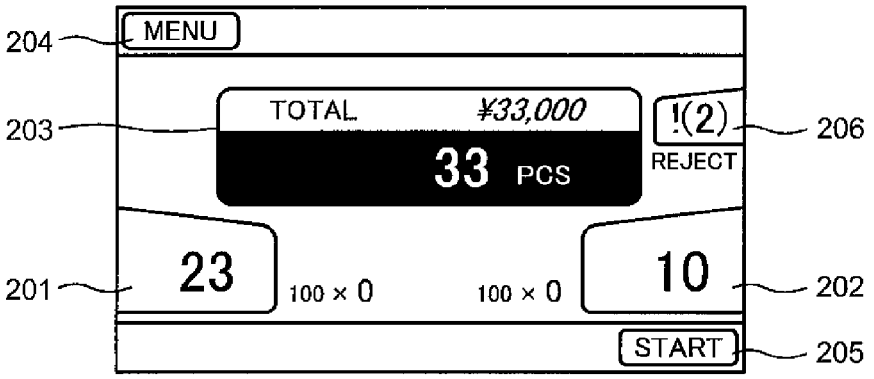
Figure 21C:
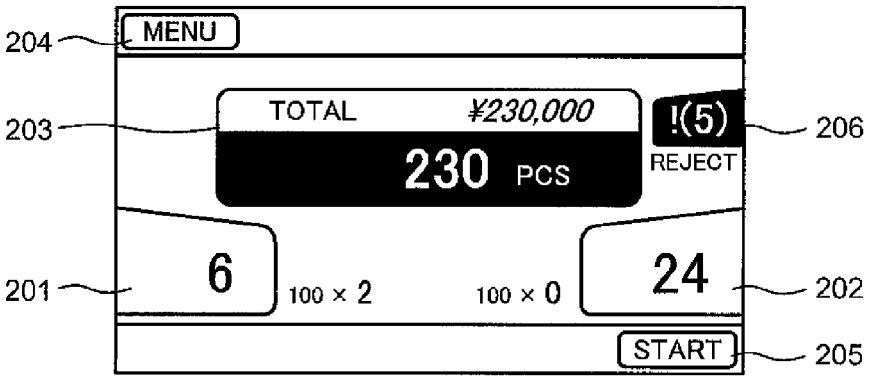
Figure 22:
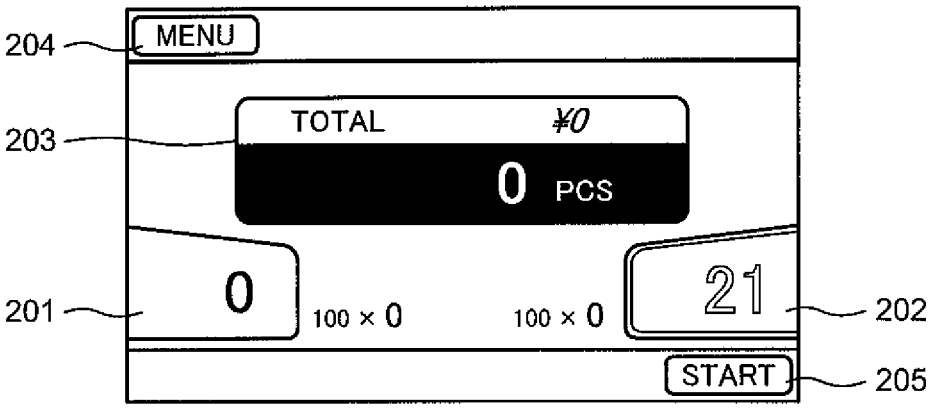
FIG. 22 is a view that illustrates an example of a screen displayed on the operation display unit in a return process, which is carried out when an error occurs during processing of the banknotes.

FIGS. 21A to 21C are views that illustrate an example of a screen displayed on the operation display unit 70 if any rejected banknote has been detected. For example, after twenty-three fit 1,000-yen banknotes is stacked in the first banknote stacking unit 30 and ten unfit 1,000-yen banknotes is stacked in the second banknote stacking unit 40 and thus thirty-three banknotes have been stacked in total, if subsequent one banknote is recognized as being a rejected banknote, a display illustrated in FIG. 21A is displayed on the screen.

On the screen, the first display region 201 for displaying information about the first banknote stacking unit 30, the second display region 202 for displaying information about the second banknote stacking unit 40, and a reject display region 206 for displaying information about the reject unit 50 are displayed with a positional relationship corresponding to the locations of arrangement of the first banknote stacking unit 30, the second banknote stacking unit 40, and the reject unit 50 of the banknote handling apparatus 1 when viewed from the front surface side. Specifically, as illustrated in FIG. 1 and the like, the first banknote stacking unit 30 is provided in the lower left portion on the front surface, the second banknote stacking unit 40 is provided in the lower right portion on the front surface, and the reject unit 50 is provided above the second banknote stacking unit 40 in the banknote handling apparatus 1. In correspondence with this arrangement, in the region for displaying information on the operation display unit 70, the first display region 201 is provided in the lower left portion, the second display region 202 is provided in the lower right portion, and the reject display region 206 is provided in the portion above the second display region 202. In FIGS. 21A to 21C, the boundary between the inside and outside of the region of the reject display region 206 is illustrated by a black solid line; however, similar to the boundary of the first display region 201 and the second display region 202, the boundary is displayed by color difference of surrounding portions.

The reject display region 206 is smaller than the first display region 201 and the second display region 202. Moreover, with respect to the first display region 201 and the second display region 202, there is no information indicating that the displayed information inside the region is about the banknotes stacked in the banknote stacking units 30, 40, while a character string "REJECT" is displayed below the reject display region 206 so as to indicate that the displayed information is about the rejected banknote.

Rejected banknotes include banknotes that have been rejected for various different reasons. For example, as a result of recognition process of a banknote, which has been fed from the receiving unit 20 into the transport path, by the recognition unit 100, when a banknote cannot be recognized, it is determined as a rejected banknote and transported to the reject unit 50. Similarly, a counterfeit banknote which is determined not to be authentic, a banknote which is determined likely to be a counterfeit banknote, a banknote for which it is determined impossible to perform normal diverting transport to and normal stacking in the banknote stacking unit because the banknote has been transported in a skewed state, and the like, are transported to the reject unit 50 as rejected banknotes. Moreover, also in the case where multi feeding by which plural banknotes are transported in an overlapped state is detected by the recognition unit 100 or any of the transported banknote detection sensors 80 to 84 or in the case where chained transport by which banknotes that are serially transported are transported at an interval smaller than a predetermined distance are detected by the recognition unit 100 or any of the transported banknote detection sensors 80 to 84, such banknotes are transported to the reject unit 50 as rejected banknotes. In addition, if the size, thickness, or the like of a banknote does not fall within a predetermined range, it is transported to the reject unit 50 as a rejected banknote.

In the banknote handling apparatus 1, on the basis of results of detection by the recognition unit 100 and the transported banknote detection sensors 80 to 84 for the size and the thickness of banknotes transported through the transport paths, multi feeding by which plural banknotes are transported partially or entirely overlapped with one another can be detected, and in addition, if one banknote has been divided into plural pieces and any piece of the banknote is transported, such a transport state can be detected. In other words, it can be determined whether the transported banknote is one complete sheet of banknote. Accordingly, until the final number of rejected banknotes can be determined, the total number of rejected banknotes stacked in the reject unit 50 is displayed in the reject display region 206.

On the other hand, in the case of multi feeding, chain transport, abnormal thickness, abnormal size, or the like, in which it cannot be determined that the transported banknote is one complete sheet of banknote, i.e., if any rejected banknotes are detected and the final number of the rejected banknotes cannot be determined, the content of display in the reject display region 206 is changed. Specifically, the number of events of rejection is displayed instead of the number of rejected banknotes. For example, if multi feeding has been detected, the number of events of rejection is counted as 1, but the final number of the concerned banknotes cannot be determined because it cannot be determined how many banknotes have been transported in the overlapped state in the multi feeding. Accordingly, in the banknote handling apparatus 1, the number of events of rejection is displayed instead of the number of rejected banknotes.

Moreover, in the banknote handling apparatus 1, the number of rejected banknotes and the number of events of rejection are displayed in mutually different modes so that the operator can recognize which of the number of rejected banknotes and the number of events of rejection is displayed as the information displayed in the reject display region 206.

FIG. 21B illustrates an example of a screen that displays the number of events of rejection. As illustrated in the drawing, in displaying the number of events of rejection, an exclamation mark ("!") is displayed in the reject display region 206 and the number of events of rejection is displayed within parentheses. The mode of display in the reject display region 206 is changed, the number of rejected banknotes is displayed as illustrated in FIG. 21A and the number of events of rejection is displayed as illustrated in FIG. 21B. As a result, the operator can easily recognize which of the number of rejected banknotes and the number of events of rejection is displayed as the information displayed in the reject display region 206.

If both rejection of which the final number of rejected banknotes can be determined and rejection of which the final number of rejected banknotes cannot be determined have occurred, then the total of the finally determined number of rejected banknotes and the number of events of rejection is displayed as the number of events of rejection.

Specifically, for example, if rejection of which the final number of rejected banknotes can be determined has occurred after twenty-three banknotes have been stacked in the first banknote stacking unit 30 and ten banknotes have been stacked in the second banknote stacking unit 40, the number of rejected banknotes "1" is displayed in the reject display region 206 as illustrated in FIG. 21A. Further, if a subsequent rejection has occurred due to multi feeding or the like of which the final number of rejected banknotes cannot be determined, an exclamation mark and a parenthesized number "2" are displayed in the reject display region 206 as illustrated in FIG. 21B. The number "2" is obtained by adding "1" of the number of events of rejection for the subsequent rejection to the previously displayed number of rejected banknotes "1".

As described above, if the final number of the rejected banknotes can be determined, the number of rejected banknotes is displayed, so that after the processing is completed, the operator can verify the total number of processed banknotes on the basis of the total number of banknotes displayed in the total display region 203 and the number of rejected banknotes displayed in the reject display region 206. On the other hand, if the final number of rejected banknotes cannot be determined, the display is changed to the display of the number of events of rejection. In this case, the total number of the processed banknotes cannot be correctly determined; however, information that indicates an approximate total number of banknotes can be obtained.

When prompting the operator to take out the rejected banknotes from the reject unit 50, the display in the reject display region 206 on the screen is changed. Specifically, as illustrated in FIG. 21C, the background of the inside of the reject display region 206 is displayed in blue and the characters are displayed in white, similarly to the case where the number of banknotes stacked in the first banknote stacking unit 30 and the number of banknotes stacked in the second banknote stacking unit 40 have reached the number-of-banknotes for one batch.

Also, a light emitting device such as an LED that emits light in correspondence with the display in the reject display region 206 is provided in the stacking space of the reject unit 50. If the state of the apparatus has shifted to the standby state in which the apparatus stands by for the operator to take out of the rejected banknotes from the reject unit 50, the light emitting device in the reject unit 50 is flashed. In this state, the background of the reject display region 206 of the operation display unit 70 is displayed in blue and the light emitting device in the reject unit 50 is flashed in blue, the same color. Accordingly, the operator can recognize, by verifying the display on the operation display unit 70 and the flashing of the light emitting device in the reject unit 50, that it is necessary to take out the rejected banknotes from the reject unit 50.

The notification process for prompting the operator to take out the banknotes by changing the mode of display on the operation display unit 70 of the information about the banknote stacking unit 30, the second banknote stacking unit 40, and the reject unit 50 and the notification process for prompting the operator to take out the banknotes by flashing the light emitting device provided in the first banknote stacking unit 30, the second banknote stacking unit 40, and the reject unit 50 are performed when the number of stacked banknotes has reached a predetermined number such as, the number-of-banknotes for one batch, and an upper limit number of banknotes to be stacked (a full or a near-full number of banknotes to be stacked) and also when the processing of banknotes is completed.

In the banknote handling apparatus 1, if any error has occurred while processing of banknotes is performed, a return process may be performed. The return process is a process performed after the error recovery process has been completed, and is a process for restoring the states of the banknotes stacked in the first banknote stacking unit 30 and the second banknote stacking unit 40 to the states of the banknotes at the time of occurrence of the error.

Specifically, if an error has occurred and the apparatus has stopped, the transport paths in the apparatus are exposed as illustrated in FIGS. 7 and 8 and all the banknotes remaining in the transport paths are removed. Subsequently, when the state of the banknote handling apparatus 1 has changed such that the processing of the banknotes can be resumed, the banknotes removed from the transport paths in the apparatus and the banknotes having been stacked in the first banknote stacking unit 30 and the second banknote stacking unit 40 at the time of occurrence of the error are placed onto the receiving unit 20 to start the return process. In the banknote handling apparatus 1, information about the banknotes stacked in each of the first banknote stacking unit 30 and the second banknote stacking unit 40 at the time of occurrence of the error is saved. By using this saved information, the state of stacking of the banknotes at the time of occurrence of the error is reproduced by sorting and stacking the banknotes placed on the receiving unit 20 into the first banknote stacking unit 30 and the second banknote stacking unit 40.

FIG. 22 is a view that illustrates an example of a screen displayed on the operation display unit 70 when starting the return process. For example, if twenty-one sheets of banknotes have been stacked in the second banknote stacking unit 40 at the time of occurrence of an error and if the operator performs an operation for starting the return process via the operation display unit 70, as illustrated in FIG. 22, the number of banknotes "21", which is the number of banknotes having been stacked in the second banknote stacking unit 40, is displayed in the second display region 202 on the screen. The display, however, is displayed in a mode different from that for normal handling of banknotes.

Specifically, for example, the boundary between the inside and the outside of the region of the second display region 202 is highlighted by using a red line and characters within the region are displayed in red. The boundary is displayed in a color not used for the display for normal processing of banknotes and the characters are displayed in a color different from that used for displaying normal processing of banknotes, and thereby the operator can easily recognize that the process is not a process for normal process the banknotes.

When the return process has been started from the state of display of screen illustrated in FIG. 22 and the banknotes have been serially stacked into the second banknote stacking unit 40, the number of banknotes displayed in the second display region 202 is serially decremented by 1 as the stacking of the banknotes progresses, and when the number of sheets of banknotes stacked in the second banknote stacking unit 40 reaches "21", which is the number at the time of occurrence of the error, the display of the number of banknotes becomes "0". After the return process is completed, the processing of banknotes suspended due to the error is resumed, and the display in the second display region 202 returns to the display for normal processing. After the processing of the banknotes has been resumed, when a next banknote, which is the 22nd banknote, is stacked in the second banknote stacking unit 40, the display of the number of banknotes in the second display region 202 is changed from "0" to "22".

As described above, in the banknote handling apparatus 1, information about the processing of banknotes that is currently performed is displayed on the operation display unit 70 in such a manner that the operator can easily recognize the information, and thereby the operator can easily continuously perform the processing of the banknotes by easily verifying the information displayed on the operation display unit 70. For example, the number-of-banknotes for one batch and the number of successfully-processed batches are displayed in addition to the number of banknotes stacked in the banknote stacking units 30, 40, and if the number of successfully-processed batches has reached a predetermined number, it is notified, and thereby the batch process can be easily continuously performed. Moreover, not only the information about the recognized and counted banknotes but also information about rejected banknotes can be displayed, and thus the operator can recognize information about the total number of handled banknotes when the processing of the banknotes is completed.

Further, on the operation display unit 70, pieces of information about plural banknote stacking units are displayed in the locations on the screen corresponding to the actual locations of the banknote stacking units when viewed from the operator of the operation display unit 70, i.e., in accordance with the positional relationship among the banknote stacking units. Accordingly, the operator can easily recognize which information displayed on the screen corresponds to which banknote stacking unit.

Moreover, the banknote stacking units are provided with the light emitting device and at the timing at which it has become necessary to take out the banknotes after the number of banknotes stacked in the banknote stacking unit has reached a predetermined number, the light emitting device of the banknote stacking unit for which it is necessary to perform the banknote take-out operation flashes. Accordingly, the operator can easily recognize that it has become necessary to take out the banknotes and the location of the banknote stacking unit that requires taking out of the banknotes. In addition, the light emitting device of the banknote stacking unit that requires taking out of the banknotes is flashed in the same color as the color of the background of the display region that displays the information about the banknote stacking unit that requires taking out of the banknotes on the screen of the operation display unit 70. Accordingly, the operator can easily recognize which information on the screen corresponds to which banknote stacking unit.

[Preference Setting for the Banknote Stacking Unit]

In the banknote handling apparatus 1, preference for the first banknote stacking unit 30 and the second banknote stacking unit 40 can be set. For example, if a banknote that has been recognized by the recognition unit 100 is a banknote that can be stored in any of the first banknote stacking unit 30 and the second banknote stacking unit 40, the destination of transport of the banknote is determined on the basis of a preference setting that has been previously set.

Figures 23, 24:
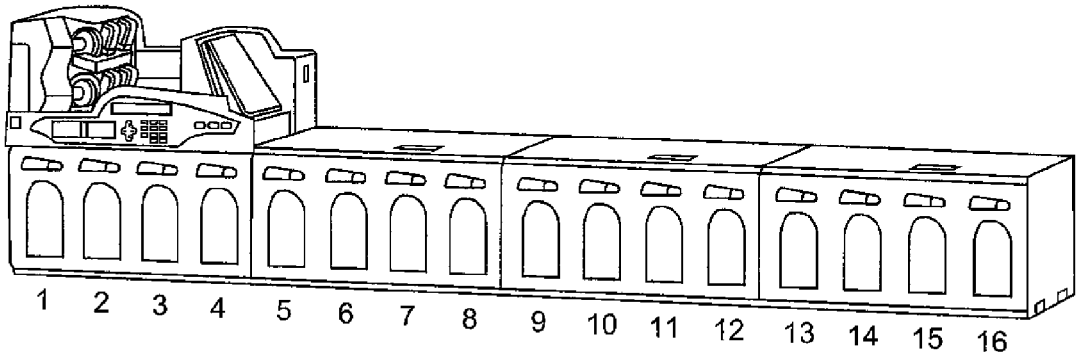
FIG. 23 is a view that illustrates preference settings for plural banknote stacking units arranged in the banknote handling apparatus.
FIG. 24 is an outline drawing that illustrates an example of a banknote handling apparatus provided with a large number of banknote stacking units.

FIG. 23 is a view that illustrates the preference setting for the banknote stacking units 30, 40 of the banknote handling apparatus 1. The preference for the first banknote stacking unit 30 and the second banknote stacking unit 40 is set and stored as patterns. The preference can be set simply by selecting a desired pattern in starting processing of banknotes. Although not illustrated in FIG. 23, in addition to the preference, information such as the denomination, the fitness, old/new, and the authenticity can be registered to the patterns.

For example, if the banknote handling apparatus 1 is to be installed at the teller window of a bank in a state in which the right side surface of the apparatus on which the receiving unit 20 and the reject unit 50 are provided is oriented toward the side of the customer present outside the teller window, the pattern 2 illustrated in FIG. 23 is selected. As a result, the second banknote stacking unit 40 located at a location close to the customer is prioritized as the destination of transport of the banknotes, and thereby the customer can easily verify the stacking of the banknotes. Moreover, if the operator of the banknote handling apparatus 1 is left-handed, for example, then the pattern 1 illustrated in FIG. 23 is selected to change the preference setting so that the first banknote stacking unit 30 is preferentially used and the processing of the banknotes is performed according to this setting, and thereby the operator can take out the banknotes stacked in the first banknote stacking unit 30 with his/her left hand, i.e., his/her dominant hand.

If the banknote handling apparatus 1 has a large number of banknote stacking units, a remarkable effect can be obtained by using the preference settings for the banknote stacking units. An example of a case will be described below where the kinds of banknotes to be stacked in the respective banknote stacking units are assigned on the basis of preference settings in a banknote handling apparatus including 16 banknote stacking units.

FIG. 24 illustrates an example of the banknote handling apparatus having 16 banknote stacking units. The 16 banknote stacking units each having an opening for taking out the banknotes are provided on the front side of the apparatus, and a receiving unit, a reject unit, an operation display unit, and the like are provided above the four banknote stacking units from the left.

For example, a single-operator pattern is set, which is a pattern for performing processing of banknotes with one operator, as the preference setting. In the single-operator pattern, it is set so that the preference becomes higher for the banknote stacking unit located closer to the left surface side. As a result, because the banknote stacking unit located on the left side of the apparatus where the receiving unit and the operation display unit are provided is prioritized, the operator can easily continuously perform the operation because the operator is not required to move over to the banknote stacking unit located on the right end in taking out the banknotes from the banknote stacking unit while performing an operation for placing the banknotes onto the receiving unit and an operation via the operation display unit.

For the preference setting, the preference can be set not only based on the positional relationship among the banknote stacking units but also based on information about processing of banknotes that has been performed in the past. For example, the preference setting for the banknote stacking unit is set to "left" and the denomination of the banknote to be assigned to the prioritized banknote stacking unit is set to "many", and thereby the denomination of the banknotes to be stacked in the respective banknote stacking unit is automatically assigned so that a larger number of banknotes are to be stacked for a banknote stacking unit located closer to the left surface side of the apparatus. The relationship between the denomination of the banknote and the number of the stacked banknotes is determined on the basis of information about the denomination and the number of processed banknotes that have been processed in the past.

Figure 25A:
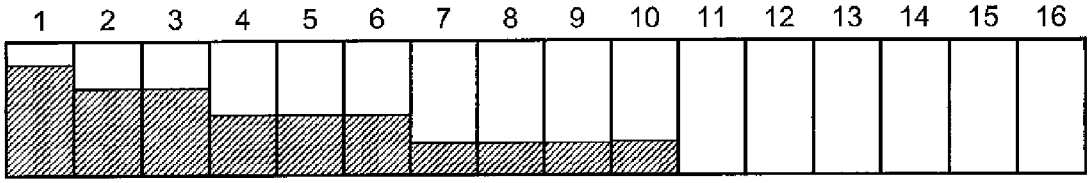
FIGS. 25A, 25B, 25C and 25D are schematic diagrams that illustrate a method of setting the kind of banknotes to be stacked in the respective banknote stacking units.

For example, the preference setting for the single-operator pattern is set so that banknotes of the denomination for which the number of processed banknotes is larger are to be stacked in a banknote stacking unit located closer to the left surface side. In this example, the denomination, for which the number of processed banknotes is the largest on the basis of data accumulated by past processing of banknotes, is assigned to the banknote stacking unit located at the leftmost location. The denominations are assigned starting from the leftmost banknote stacking unit in the descending order of larger number of handled banknotes, in such a manner that the denomination with the second largest number of processed banknotes is assigned to the banknote stacking unit located the second from the left end. As a result, when the processing of banknotes is performed, the number of stacked banknotes becomes larger for the banknote stacking unit located closer to the left surface side as illustrated in FIG. 25A. FIGS. 25A to 25D are schematic diagrams that illustrate the number of banknotes stacked in each of the 16 banknote stacking units. Referring to FIG. 25A, it is illustrated that more banknotes are stacked in a banknote stacking unit located closer to the left side.

For example, if one operator performs an operation for packing the banknotes taken out from the banknote stacking unit into transport containers such as transport cassettes, bags, and the like, the operator can perform the operation with the transport containers placed at a location closer to the left end of the apparatus. The operator can perform the operations for taking out the banknotes from the banknote stacking unit and packing the taken-out banknotes into the transport containers while performing an operation for placing banknotes onto the receiving unit and an operation via the operation display unit. In these operations, more banknotes are stacked in the banknote stacking unit located closer to the left surface side, and thus the number of times of moving over to the banknote stacking unit located in the rightmost location to take out the banknotes can be suppressed to a minimum. Moreover, because the number of the stacked banknotes becomes smaller as the distance from the transport containers becomes longer, the operator need not take out a large number of banknotes and carry them over to the transport containers by moving a long distance, and thereby the load of operations on the operator can be reduced.

For example, assume that the operations are performed by two operators, and one of them performs the operation for placing banknotes onto the receiving unit only and the other operator performs the operations for taking out the banknotes from the banknote stacking units and packing them in the transport containers only. In this example, the preference setting for a two-operator pattern is set so that banknotes of denominations with larger number of processed banknotes are stacked in a banknote stacking unit located closer to the right surface side.

Figure 25B:
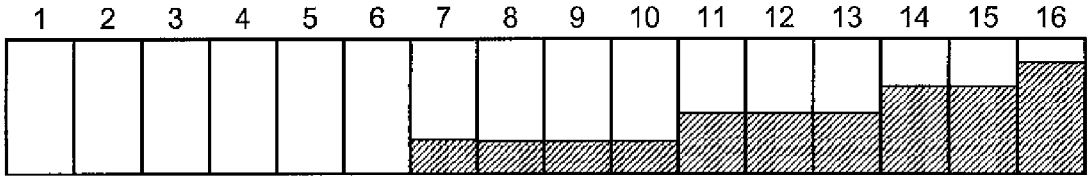

As a result, the denominations with more number of processed banknotes are assigned starting from the rightmost banknote stacking unit, and when the processing of the banknotes is performed, the state of stacking becomes the stacking state as illustrated in FIG. 25B. At the location close to the left side of the apparatus, one operator continuously performs the operation for placing the banknotes onto the receiving unit and the other operator performs the operation for placing the transport containers at a location close to the right end side of the apparatus, the operation for taking out the banknotes from the respective banknote stacking units, and the operation for packing them into the transport containers, and thereby the operations can be highly efficiently performed.

Moreover, for example, assume that two operators perform the operations and one of them performs both the operation for placing banknotes onto the receiving unit and the operation for taking out the banknotes from the banknote stacking units and the other operator performs the operation for taking out the banknotes from the banknote stacking units and packing them in the transport containers only. In this example, the preference setting for the two-operator pattern is set so that more banknotes are stacked in banknote stacking units located closer to the outer portion of the apparatus in the left-right direction.

Figure 25C:
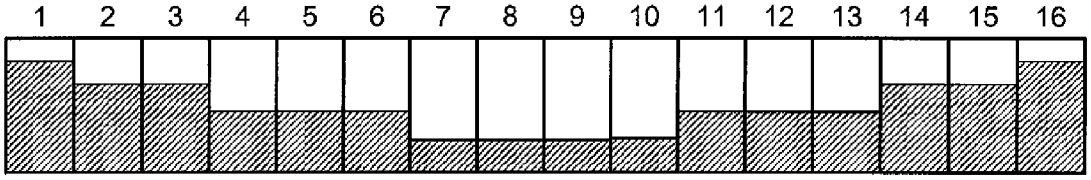

As a result, the denominations with more number of processed banknotes are assigned to the banknote stacking units in the ascending order of the distance from the left-right outer portions of the apparatus, and when the processing of the banknotes is performed, the stacking state becomes the stacking state illustrated in FIG. 25C. The transport containers are placed at the location located substantially the center in the arrangement of the banknote stacking units, and one operator performs the operation for taking out the banknotes stacked in the banknote stacking units and packing them in the transport containers while continuously performing the operation for placing the banknotes onto the receiving unit. The other operator performs the operation for taking out the banknotes from the respective banknote stacking units and packing them into the transport containers at the location to the right of the location of the transport containers placed in the substantially center location. Accordingly, the two operator may not move in a crossover manner and one of them performs the operation only in the area on the left side of the apparatus from the center of the banknote stacking units in the direction of arrangement of them while the other operator performs the operations only in the area to the right thereof, and thereby the operations can be highly efficiently performed. Moreover, because the numbers of banknotes handled by both operators may be close to each other, the load of operation between the operators would not be excessively unbalanced.

In a case where one operator performs both the operation for placing the banknotes onto the receiving unit and the operation for taking out the banknotes from the banknote stacking units and the other operator performs the operation for taking out the banknotes from the banknote stacking units and packing them into the transport containers only, the preference setting for the two-operator pattern may be set, by dividing the banknote stacking units into a group of eight banknote stacking units located closer to the left surface side and another group of eight banknote stacking units located closer to the right surface side, so that the number of banknotes to be stacked may be larger for the banknote stacking units located closer to the left surface side for the respective group.

Figure 25D:
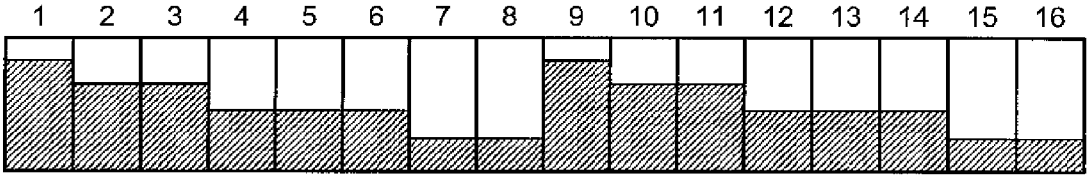

As a result, the denominations with the larger number of processed banknotes are assigned in the descending order of distance from the left surface side for each of the left group and the right group, and when the processing of the banknotes is performed, the stacking state becomes the stacking state as illustrated in FIG. 25D. The transport containers are placed in substantially the center location in the direction of arrangement of the banknote stacking units, and one operator performs the operation for taking out the banknotes stacked in the banknote stacking units and packing them into the transport containers while continuously performing the operation for placing the banknotes onto the receiving unit. The other operator performs the operation for taking out the banknotes from the respective banknote stacking units and packing them into the transport containers in the area to the right of the transport containers placed in the substantially center area, and because for the eight banknote stacking units in the right group, the number of stacked banknotes is larger for the banknote stacking units located close to the location in which the transport containers are placed, the operation for taking out the banknotes and packing them into the transport containers can be more easily performed than the case illustrated in FIG. 25C.

As described above, in the banknote handling apparatus 1, the preference setting based on the locations of the banknote stacking units and the preference setting based on the number of processed banknotes to be processed by the kind are performed, and thereby the kinds of the banknotes are appropriately assigned to each of the banknote stacking units, and thus the operator can easily perform the operations for the processing of the banknotes. If a large number of banknote stacking units are provided, the kinds of the banknotes to be stacked in the respective banknote stacking units can be automatically assigned on the basis of the previously set preference settings, and thus the operator need not perform an operation for determining and setting the kinds of the banknotes to be stacked in the respective banknote stacking units, and thus the operations can be highly efficiently performed by merely performing the processing of the banknotes by using the automatically set settings.

As described above, according to the present embodiment, by arranging the dust receiving unit including the dust tray 71 and the dust receiving plate 72 inside the apparatus, the dust and the paper dust falling from the banknotes being transported can be collected in the dust tray 71. Moreover, by having a configuration whereby the dust tray 71 can be taken out from the apparatus from the outside of the apparatus, the operations of taking out and disposing off the dust and the paper dust generated inside the apparatus can be performed easily.

INDUSTRIAL APPLICABILITY

As described above, the paper sheet handling apparatus according to the present invention is useful for removing the dust and the paper dust generated inside the apparatus out of the apparatus.

EXPLANATION OF REFERENCE NUMERALS

1 Paper sheet handling apparatus
11 Upper unit
12 Lower unit
13 Top cover
14 Rear unit
20 Receiving unit
30, 40 Banknote stacking unit
33, 43 Blade wheel
34, 44 Pushing member
50 Reject unit
61 Sub power switch
62 Memory card slot
63 USB port
64 LAN port
65 Dedicated port
66 Main power switch
67 Power inlet
70 Operation display unit
71 Dust tray
72 Dust receiving plate
80 to 87 Transported banknote detection sensor
90 to 95 Transport belt
100 Recognition unit
111, 112 Diverting member
140*a* to 140*e* Sensor brush
151 to 154 Stacked banknote detection sensor

The invention claimed is:

1. A paper sheet handling apparatus comprising:
a transport path that transports a paper sheet one by one;
a recognition unit that recognizes and counts the paper sheets being transported via the transport path; and
a dust tray that is arranged directly under the recognition unit and that receives dust removed from the paper sheet through the recognition unit and fallen down from the recognition unit, and that can be pulled out of the paper sheet handling apparatus.

2. The paper sheet handling apparatus according to claim 1, further comprising a dust receiving plate that collects the dust present outside the dust tray into the dust tray.

3. The paper sheet handling apparatus according to claim 2, constituted by a lower unit and an upper unit that can be opened and closed relative to the lower unit,
wherein the dust receiving plate is arranged inside the upper unit.

4. The paper sheet handling apparatus according to claim 3, wherein the dust receiving plate slants with the upper unit when the upper unit is opened or closed, and the dust receiving plate is arranged at a position where the dust slid down from the dust receiving plate is collected in the dust tray while the dust receiving plate slants.

5. The paper sheet handling apparatus according to claim 2, wherein the dust tray and the dust receiving plate are arranged under at least a part of the transport path.

6. The paper sheet handling apparatus according to claim 5, wherein a length of the dust receiving plate in a width direction of the transport path is greater than a width of the transport path in a direction perpendicular to a direction in which the paper sheet is transported.

7. The paper sheet handling apparatus according to claim 5, wherein the dust receiving plate is arranged under the recognition unit.

8. The paper sheet handling apparatus according to claim 7, wherein
the recognition unit includes a thickness detection sensor that detects a thickness of the paper sheet, and
at least one of the dust tray and the dust receiving plate is arranged under the thickness detection sensor.

9. The paper sheet handling apparatus according to claim 7, wherein
the recognition unit includes a magnetic detection sensor that detects magnetism of the paper sheet, and
at least one of the dust tray and the dust receiving plate is arranged under the magnetic detection sensor.

10. The paper sheet handling apparatus according to claim 7, wherein
the recognition unit includes a thickness detection sensor that detects a thickness of the paper sheet, and
a length of the dust receiving plate in a width direction of the transport path is greater than a length of the thickness detection sensor in the width direction of the transport path in a direction perpendicular to a direction in which the paper sheet is transported.

11. The paper sheet handling apparatus according to claim 7, wherein the recognition unit includes a magnetic detection sensor that detects magnetism of the paper sheet, and a length of the dust receiving plate in a width direction of the transport path is greater than a length of the magnetism detection sensor in the width direction of the transport path in a direction perpendicular to a direction in which the paper sheet is transported.

12. A paper sheet handling apparatus comprising:

a transport path that transports a paper sheet one by one;

a recognition unit that recognizes and counts the paper sheet being transported via the transport path; and a dust tray that is arranged directly under the recognition unit and has a flat surface.

13. The paper sheet handling apparatus according to claim 12, further comprising:

a dust receiving plate that is arranged in the vicinity of the dust tray and that has an inclined surface inclined toward the dust tray.

* * * * *